US007146702B2

(12) United States Patent
Cook et al.

(10) Patent No.: US 7,146,702 B2
(45) Date of Patent: Dec. 12, 2006

(54) METHOD AND APPARATUS FOR FORMING A MONO-DIAMETER WELLBORE CASING

(75) Inventors: Robert Lance Cook, Katy, TX (US); Lev Ring, Houston, TX (US); Edwin A. Zwald, Houston, TX (US); Andrei Gregory Filippov, Wassenaar (NL); Kevin K. Waddell, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 11/074,266

(22) Filed: Mar. 7, 2005

(65) Prior Publication Data

US 2005/0144772 A1 Jul. 7, 2005

Related U.S. Application Data

(60) Division of application No. 10/465,831, filed as application No. PCT/US02/00093 on Jan. 2, 2002, which is a continuation-in-part of application No. 10/406,648, filed as application No. PCT/US01/30256 on Sep. 27, 2001.

(60) Provisional application No. 60/259,486, filed on Jan. 3, 2001, provisional application No. 60/237,334, filed on Oct. 2, 2000.

(51) Int. Cl.
*B21D 39/00* (2006.01)
*E21B 23/00* (2006.01)

(52) U.S. Cl. ..... 29/507; 29/514; 29/523; 29/522.1; 166/378

(58) Field of Classification Search ..... 29/507, 29/514, 520, 523, 522.1, 421.1, 715, 283.5; 72/58, 61, 393; 166/207, 208, 212, 277, 166/378, 380, 382, 387
See application file for complete search history.

(56) References Cited

U.S. PATENT DOCUMENTS

| | | | |
|---|---|---|---|
| 46,818 | A | 3/1865 | Patterson |
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |

(Continued)

FOREIGN PATENT DOCUMENTS

| | | |
|---|---|---|
| AU | 767364 | 2/2004 |

(Continued)

OTHER PUBLICATIONS

International Search Report, Application PCT/US03/13787; May 28, 2004.

(Continued)

*Primary Examiner*—Essama Omgba
(74) *Attorney, Agent, or Firm*—Haynes and Boone LLP; Todd Mattingly

(57) ABSTRACT

A mono-diameter wellbore casing. The mono-diameter wellbore casing is formed by plastically deforming and radially expanding a first tubular member within a wellbore. A second tubular member is then plastically deformed and radially expanded in overlapping relation to the first tubular member. The second tubular member and the overlapping portion of the first tubular member are then radially expanded again.

5 Claims, 66 Drawing Sheets

U.S. PATENT DOCUMENTS

| | | | | |
|---|---|---|---|---|
| 806,156 | A | | 12/1905 | Marshall |
| 958,517 | A | | 5/1910 | Mettler |
| 984,449 | A | | 2/1911 | Stewart |
| 1,166,040 | A | | 12/1915 | Burlingham |
| 1,233,888 | A | | 7/1917 | Leonard |
| 1,494,128 | A | | 5/1924 | Primrose |
| 1,589,781 | A | | 6/1926 | Anderson |
| 1,590,357 | A | | 6/1926 | Feisthamel |
| 1,597,212 | A | | 8/1926 | Spengler |
| 1,613,461 | A | | 1/1927 | Johnson |
| 1,756,531 | A | | 4/1930 | Aldeen et al. |
| 1,880,218 | A | | 10/1932 | Simmons |
| 1,981,525 | A | | 11/1934 | Price |
| 2,046,870 | A | | 7/1936 | Clasen et al. |
| 2,087,185 | A | | 7/1937 | Dillom |
| 2,122,757 | A | | 7/1938 | Scott |
| 2,160,263 | A | | 5/1939 | Fletcher |
| 2,187,275 | A | | 1/1940 | McLennan |
| 2,204,586 | A | | 6/1940 | Grau |
| 2,214,226 | A | | 9/1940 | English |
| 2,226,804 | A | | 12/1940 | Carroll |
| 2,273,017 | A | | 2/1942 | Boynton |
| 2,301,495 | A | | 11/1942 | Abegg |
| 2,371,840 | A | | 3/1945 | Otis |
| 2,383,214 | A | | 8/1945 | Prout |
| 2,447,629 | A | | 8/1948 | Beissinger et al. |
| 2,500,276 | A | | 3/1950 | Church |
| 2,546,295 | A | | 3/1951 | Bolce |
| 2,583,316 | A | | 1/1952 | Bannister |
| 2,627,891 | A | | 2/1953 | Clark |
| 2,647,847 | A | | 8/1953 | Black et al. |
| 2,734,580 | A | | 2/1956 | Layne |
| 2,796,134 | A | | 6/1957 | Binkley |
| 2,812,025 | A | | 11/1957 | Teague et al. |
| 2,907,589 | A | | 10/1959 | Knox |
| 2,929,741 | A | | 1/1960 | Strock et al. |
| 3,015,362 | A | | 1/1962 | Moosman |
| 3,015,500 | A | | 1/1962 | Barnett |
| 3,018,547 | A | | 1/1962 | Marksell |
| 3,039,530 | A | | 6/1962 | Condra |
| 3,067,819 | A | | 12/1962 | Gore |
| 3,068,563 | A | | 12/1962 | Reverman |
| 3,104,703 | A | | 9/1963 | Rike et al. |
| 3,111,991 | A | | 11/1963 | O'Neal |
| 3,167,122 | A | | 1/1965 | Lang |
| 3,175,618 | A | | 3/1965 | Lang et al. |
| 3,179,168 | A | | 4/1965 | Vincent |
| 3,188,816 | A | | 6/1965 | Koch |
| 3,191,677 | A | | 6/1965 | Kinley |
| 3,191,680 | A | | 6/1965 | Vincent |
| 3,203,451 | A | | 8/1965 | Vincent |
| 3,203,483 | A | | 8/1965 | Vincent |
| 3,209,546 | A | | 10/1965 | Lawton |
| 3,210,102 | A | | 10/1965 | Joslin |
| 3,233,315 | A | | 2/1966 | Levake |
| 3,245,471 | A | | 4/1966 | Howard |
| 3,270,817 | A | | 9/1966 | Papaila |
| 3,297,092 | A | | 1/1967 | Jennings |
| 3,326,293 | A | | 6/1967 | Skipper |
| 3,343,252 | A | | 9/1967 | Reesor |
| 3,353,599 | A | | 11/1967 | Swift |
| 3,354,955 | A | | 11/1967 | Berry |
| 3,358,760 | A | | 12/1967 | Blagg |
| 3,358,769 | A | | 12/1967 | Berry |
| 3,364,993 | A | | 1/1968 | Skipper |
| 3,371,717 | A | | 3/1968 | Chanoweth |
| 3,412,565 | A | | 11/1968 | Lindsey et al. |
| 3,419,080 | A | | 12/1968 | Lebourg |
| 3,424,244 | A | | 1/1969 | Kinley |
| 3,477,506 | A | | 11/1969 | Malone |
| 3,489,220 | A | | 1/1970 | Kinley |
| 3,498,376 | A | | 3/1970 | Sizer et al. |
| 3,504,515 | A | | 4/1970 | Reardon |
| 3,520,049 | A | | 7/1970 | Lysenko et al. |
| 3,528,498 | A | | 9/1970 | Carothers |
| 3,568,773 | A | | 3/1971 | Chancellor |
| 3,578,081 | A | | 5/1971 | Bodine |
| 3,579,805 | A | | 5/1971 | Kast |
| 3,605,887 | A | | 9/1971 | Lambie |
| 3,631,926 | A | | 1/1972 | Young |
| 3,665,591 | A | | 5/1972 | Kowal |
| 3,667,547 | A | | 6/1972 | Ahlstone |
| 3,669,190 | A | | 6/1972 | Sizer et al. |
| 3,682,256 | A | | 8/1972 | Stuart |
| 3,687,196 | A | | 8/1972 | Mullins |
| 3,691,624 | A | | 9/1972 | Kinley |
| 3,693,717 | A | | 9/1972 | Wuenschel |
| 3,704,730 | A | | 12/1972 | Witzig |
| 3,711,123 | A | | 1/1973 | Arnold |
| 3,712,376 | A | | 1/1973 | Owen et al. |
| 3,746,068 | A | | 7/1973 | Deckert et al. |
| 3,746,091 | A | | 7/1973 | Owen et al. |
| 3,746,092 | A | | 7/1973 | Land |
| 3,764,168 | A | | 10/1973 | Kisling, III, et al. |
| 3,776,307 | A | | 12/1973 | Young |
| 3,779,025 | A | | 12/1973 | Godley et al. |
| 3,780,562 | A | | 12/1973 | Kinley |
| 3,781,966 | A | | 1/1974 | Lieberman |
| 3,785,193 | A | | 1/1974 | Kinely et al. |
| 3,797,259 | A | | 3/1974 | Kammerer, Jr. |
| 3,812,912 | A | | 5/1974 | Wuenschel |
| 3,818,734 | A | | 6/1974 | Bateman |
| 3,834,742 | A | | 9/1974 | McPhillips |
| 3,866,954 | A | | 2/1975 | Slator et al. |
| 3,885,298 | A | | 5/1975 | Pogonowski |
| 3,887,006 | A | | 6/1975 | Pitts |
| 3,893,718 | A | | 7/1975 | Powell |
| 3,898,163 | A | | 8/1975 | Mott |
| 3,915,478 | A | | 10/1975 | Al et al. |
| 3,935,910 | A | | 2/1976 | Gaudy et al. |
| 3,942,824 | A | | 3/1976 | Sable |
| 3,945,444 | A | | 3/1976 | Knudson |
| 3,948,321 | A | | 4/1976 | Owen et al. |
| 3,970,336 | A | | 7/1976 | O'Sickey et al. |
| 3,977,473 | A | | 8/1976 | Page, Jr. |
| 3,989,280 | A | | 11/1976 | Schwarz |
| 3,997,193 | A | | 12/1976 | Tsuda et al. |
| 4,011,652 | A | | 3/1977 | Black |
| 4,019,579 | A | | 4/1977 | Thuse |
| 4,026,583 | A | | 5/1977 | Gottlieb |
| 4,053,247 | A | | 10/1977 | Marsh, Jr. |
| 4,069,573 | A | | 1/1978 | Rogers, Jr. et al. |
| 4,076,287 | A | | 2/1978 | Bill et al. |
| 4,096,913 | A | | 6/1978 | Kenneday et al. |
| 4,098,334 | A | | 7/1978 | Crowe |
| 4,152,821 | A | | 5/1979 | Scott |
| 4,168,747 | A | | 9/1979 | Youmans |
| 4,190,108 | A | | 2/1980 | Webber |
| 4,204,312 | A | | 5/1980 | Tooker |
| 4,205,422 | A | | 6/1980 | Hardwick |
| 4,226,449 | A | * | 10/1980 | Cole ..... 285/382.2 |
| 4,253,687 | A | | 3/1981 | Maples |
| 4,257,155 | A | * | 3/1981 | Hunter ..... 29/511 |
| 4,274,665 | A | | 6/1981 | Marsh, Jr. |
| RE30,802 | E | | 11/1981 | Rogers, Jr. |
| 4,304,428 | A | | 12/1981 | Grigorian et al. |
| 4,328,983 | A | | 5/1982 | Gibson |
| 4,355,664 | A | | 10/1982 | Cook et al. |
| 4,359,889 | A | | 11/1982 | Kelly |
| 4,363,358 | A | | 12/1982 | Ellis |
| 4,366,971 | A | | 1/1983 | Lula |
| 4,368,571 | A | | 1/1983 | Cooper, Jr. |
| 4,379,471 | A | | 4/1983 | Kuenzel |
| 4,380,347 | A | | 4/1983 | Sable |

4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,423,889 A 1/1984 Weise
4,423,986 A 1/1984 Skogberg
4,429,741 A 2/1984 Hyland
4,440,233 A 4/1984 Baugh et al.
4,442,586 A * 4/1984 Ridenour ..... 29/511
4,444,250 A 4/1984 Keithahn et al.
4,449,713 A 5/1984 Ishido et al.
4,462,471 A 7/1984 Hipp
4,467,630 A 8/1984 Kelly
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,501,327 A 2/1985 Retz
4,505,017 A 3/1985 Schukei
4,505,987 A 3/1985 Yamada et al.
4,507,019 A 3/1985 Thompson
4,508,129 A 4/1985 Brown
4,511,289 A 4/1985 Herron
4,519,456 A 5/1985 Cochran
4,526,232 A 7/1985 Hughson et al.
4,526,839 A 7/1985 Herman et al.
4,530,231 A 7/1985 Main
4,541,655 A 9/1985 Hunter
4,553,776 A 11/1985 Dodd
4,573,248 A 3/1986 Hackett
4,576,386 A 3/1986 Benson et al.
4,581,817 A 4/1986 Kelly
4,590,227 A 5/1986 Nakamura et al.
4,590,995 A 5/1986 Evans
4,592,577 A 6/1986 Ayres et al.
4,601,343 A 7/1986 Lindsey, Jr. et al.
4,605,063 A 8/1986 Ross
4,611,662 A 9/1986 Harrington
4,614,233 A 9/1986 Menard
4,629,218 A 12/1986 Dubois
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,735,444 A 4/1988 Skipper
4,739,654 A 4/1988 Pilkington et al.
4,739,916 A 4/1988 Ayres et al.
4,754,781 A 7/1988 Putter
4,776,394 A 10/1988 Lynde et al.
4,778,088 A 10/1988 Miller
4,779,445 A * 10/1988 Rabe ..... 72/393
4,793,382 A 12/1988 Szalvay
4,796,668 A 1/1989 Depret
4,817,710 A 4/1989 Edwards et al.
4,817,712 A 4/1989 Bodine
4,817,716 A 4/1989 Taylor et al.
4,826,347 A 5/1989 Baril et al.
4,827,594 A 5/1989 Cartry et al.
4,828,033 A 5/1989 Frison
4,830,109 A 5/1989 Wedel
4,832,382 A 5/1989 Kapgan
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,930,573 A 6/1990 Lane et al.
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,052,483 A 10/1991 Hudson
5,059,043 A 10/1991 Kuhne
5,079,837 A 1/1992 Vanselow
5,083,608 A 1/1992 Abdrakhmanov et al.
5,093,015 A 3/1992 Oldiges
5,095,991 A 3/1992 Milberger
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster 5,226,492 A 7/1993 Solaeche et al.
5,242,017 A 9/1993 Hailey
5,253,713 A 10/1993 Gregg et al.
5,275,242 A 1/1994 Payne
5,282,508 A 2/1994 Ellingsen et al.
5,286,393 A 2/1994 Oldiges et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,413,180 A 5/1995 Ross et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,507,343 A 4/1996 Carlton et al.
5,511,620 A 4/1996 Baugh et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,789 A 5/1999 Donnelly et al.
5,918,677 A 7/1999 Head
5,924,745 A 7/1999 Campbell
5,931,511 A 8/1999 DeLange et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,012,521 A 1/2000 Zunkel et al.
6,012,522 A 1/2000 Donnelly et al.
6,012,523 A 1/2000 Campbell et al.
6,012,874 A 1/2000 Groneck et al.
6,015,012 A 1/2000 Reddick
6,017,168 A 1/2000 Fraser et al.
6,021,850 A 2/2000 Woo et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,692 A 6/2000 Wood et al.
6,074,133 A 6/2000 Kelsey
6,078,031 A 6/2000 Bliault et al.
6,079,495 A 6/2000 Ohmer
6,085,838 A 7/2000 Vercaemer et al.

6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,158,963 A 12/2000 Hollis
6,167,970 B1 1/2001 Stout
6,182,775 B1 2/2001 Hipp
6,196,336 B1 3/2001 Fincher et al.
6,226,855 B1 5/2001 Maine
6,231,086 B1 5/2001 Tierling
6,250,385 B1 6/2001 Montaron
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,275,556 B1 8/2001 Kinney et al.
6,283,211 B1 9/2001 Vloedman
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.
6,446,724 B1 9/2002 Baugh et al.
6,450,261 B1 9/2002 Baugh
6,454,013 B1 9/2002 Metcalfe
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bernat
6,470,966 B1 10/2002 Cook et al.
6,470,996 B1 10/2002 Kyle et al.
6,478,092 B1 11/2002 Voll et al.
6,491,108 B1 12/2002 Slup et al.
6,497,289 B1 12/2002 Cook et al.
6,516,887 B1 2/2003 Nguyen et al.
6,517,126 B1 2/2003 Peterson et al.
6,527,049 B1 3/2003 Metcalfe et al.
6,543,545 B1 4/2003 Chatterji et al.
6,543,552 B1 4/2003 Metcalfe et al.
6,550,539 B1 4/2003 Maguire et al.
6,550,821 B1 4/2003 DeLange et al.
6,557,640 B1 5/2003 Cook et al.
6,561,227 B1 5/2003 Cook et al.
6,561,279 B1 5/2003 MacKenzie et al.
6,564,875 B1 5/2003 Bullock
6,568,471 B1 5/2003 Cook et al.
6,568,488 B1 5/2003 Wentworth et al.
6,575,240 B1 6/2003 Cook et al.
6,578,630 B1 6/2003 Simpson et al.
6,585,053 B1 7/2003 Coon
6,591,905 B1 7/2003 Coon
6,598,677 B1 7/2003 Baugh et al.
6,598,678 B1 7/2003 Simpson
6,604,763 B1 8/2003 Cook et al.
6,607,220 B1 8/2003 Sivley, IV
6,619,696 B1 9/2003 Baugh et al.
6,622,797 B1 9/2003 Sivley, IV
6,629,567 B1 10/2003 Lauritzen et al.
6,631,759 B1 10/2003 Cook et al.
6,631,760 B1 10/2003 Cook et al.
6,631,765 B1 10/2003 Baugh et al.
6,631,769 B1 10/2003 Cook et al.
6,634,431 B1 10/2003 Cook et al.
6,640,895 B1 11/2003 Murray
6,640,903 B1 11/2003 Cook et al.
6,648,075 B1 11/2003 Badrak et al.
6,668,937 B1 12/2003 Murray
6,672,759 B1 1/2004 Feger
6,679,328 B1 1/2004 Davis et al.
6,681,862 B1 1/2004 Freeman
6,684,947 B1 2/2004 Cook et al.
6,688,397 B1 2/2004 McClurkin et al.
6,695,012 B1 2/2004 Ring et al.
6,695,065 B1 2/2004 Simpson et al.
6,698,517 B1 3/2004 Simpson
6,701,598 B1 * 3/2004 Chen et al. ..... 29/421.1
6,702,030 B1 * 3/2004 Simpson ..... 166/380
6,705,395 B1 3/2004 Cook et al.
6,708,767 B1 3/2004 Harrall et al.
6,712,154 B1 3/2004 Cook et al.
6,712,401 B1 3/2004 Coulon et al.
6,719,064 B1 4/2004 Price-Smith et al.
6,722,427 B1 4/2004 Gano et al.
6,722,437 B1 4/2004 Vercaemer et al.
6,722,443 B1 4/2004 Metcalfe
6,725,919 B1 4/2004 Cook et al.
6,725,934 B1 4/2004 Coronado et al.
6,725,939 B1 4/2004 Richard
6,732,806 B1 5/2004 Mauldin et al.
6,739,392 B1 5/2004 Cook et al.
6,745,845 B1 6/2004 Cook et al.
6,758,278 B1 7/2004 Cook et al.
6,796,380 B1 9/2004 Xu
6,814,147 B1 11/2004 Baugh
6,820,690 B1 11/2004 Vercaemer et al.
6,823,937 B1 11/2004 Cook et al.
6,832,649 B1 12/2004 Bode et al.
6,843,322 B1 * 1/2005 Burtner et al. ..... 166/382
6,857,473 B1 2/2005 Cook et al.
6,892,819 B1 * 5/2005 Cook et al. ..... 166/380
6,902,000 B1 * 6/2005 Simpson et al. ..... 166/277
6,907,652 B1 * 6/2005 Heijnen ..... 29/447
6,923,261 B1 * 8/2005 Metcalfe et al. ..... 166/277
6,935,429 B1 * 8/2005 Badrak ..... 166/380
6,935,430 B1 * 8/2005 Harrall et al. ..... 166/380
6,976,539 B1 * 12/2005 Metcalfe et al. ..... 166/798
7,007,760 B1 * 3/2006 Lohbeck ..... 166/384
7,021,390 B1 * 4/2006 Cook et al. ..... 166/384
2001/0002626 A1 6/2001 Frank et al.
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.

2002/0066578 A1 6/2002 Broome
2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075337 A1 4/2003 Sivley, IV
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0168222 A1 9/2003 Maguire et al.
2003/0173090 A1 9/2003 Cook et al.
2003/0192705 A1 10/2003 Cook et al.
2003/0222455 A1 12/2003 Cook et al.
2004/0011534 A1 1/2004 Simonds et al.
2004/0045616 A1 3/2004 Cook et al.
2004/0045718 A1 3/2004 Brisco et al.
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0159446 A1 8/2004 Haugen et al.
2004/0188099 A1 9/2004 Cook et al.
2004/0216873 A1 11/2004 Frost, Jr. et al.
2004/0221996 A1 11/2004 Burge
2004/0231839 A1 11/2004 Ellington et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1* 2/2005 Lohbeck ..... 166/242.1
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1* 3/2005 Ring et al. ..... 166/384
2005/0077051 A1* 4/2005 Cook et al. ..... 166/378
2005/0081358 A1* 4/2005 Cook et al. ..... 29/507
2005/0098323 A1* 5/2005 Cook et al. ..... 166/384
2005/0103502 A1 5/2005 Watson et al.
2005/0123639 A1 6/2005 Ring et al.
2005/0133225 A1* 6/2005 Oosterling ..... 166/298
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0173108 A1 8/2005 Cook et al.
2005/0175473 A1 8/2005 Cook et al.
2005/0183863 A1 8/2005 Cook et al.
2005/0205253 A1 9/2005 Cook et al.
2005/0217866 A1 10/2005 Watson et al.
2005/0246883 A1* 11/2005 Alliot et al. ..... 29/507
2006/0054330 A1* 3/2006 Ring et al. ..... 166/380
2006/0096762 A1* 5/2006 Brisco ..... 166/384
2006/0124319 A1* 6/2006 MacKay ..... 166/384
2006/0169460 A1* 8/2006 Brisco ..... 166/380

FOREIGN PATENT DOCUMENTS

AU 770008 7/2004
AU 770359 7/2004
AU 771884 8/2004
AU 776580 1/2005
CA 736288 6/1966
CA 771462 11/1967
CA 1171310 7/1984
CA 2292171 6/2000
CA 2298139 8/2000
CA 2234386 3/2003
DE 174521 4/1953
DE 2458188 6/1975
DE 203767 11/1983
DE 233607 A1 3/1986
DE 278517 A1 5/1990
EP 0084940 A1 8/1983
EP 0272511 12/1987
EP 0294264 5/1988
EP 0553566 A1 12/1992
EP 0633391 A2 1/1995
EP 0713953 B1 11/1995
EP 0823534 2/1998
EP 0881354 12/1998
EP 0881359 12/1998
EP 0899420 3/1999
EP 0937861 8/1999
EP 0952305 10/1999
EP 0952306 10/1999
EP 1141515 A 10/2001
EP 1152120 A2 11/2001
EP 1152120 A3 11/2001
EP 1235972 A 9/2002
EP 1555386 A1 7/2005
FR 1325596 6/1962
FR 2717855 A1 9/1995
FR 2741907 A1 6/1997
FR 2771133 A 5/1999
FR 2780751 1/2000
FR 2841626 A1 1/2004
GB 557823 12/1943
GB 788150 12/1957
GB 851096 10/1960
GB 961750 6/1964
GB 1000383 10/1965
GB 1062610 3/1967
GB 1111536 5/1968
GB 1448304 9/1976

| | | | |
|---|---|---|---|
| GB | 1460864 | | 1/1977 |
| GB | 1542847 | | 3/1979 |
| GB | 1563740 | | 3/1980 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2390628 | B | 3/2004 |
| GB | 2391033 | B | 3/2004 |
| GB | 2392686 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |

| | | | |
|---|---|---|---|
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2399120 | B | 3/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408277 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2398326 | B | 8/2005 |
| GB | 2403970 | B | 8/2005 |
| GB | 2403971 | B | 8/2005 |
| GB | 2403972 | B | 8/2005 |
| GB | 2412681 | A | 10/2005 |
| GB | 2412682 | A | 10/2005 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1786241 | A1 | 1/1993 |
| SU | 1804543 | A3 | 3/1993 |
| SU | 1810482 | A1 | 4/1993 |
| SU | 1818459 | A1 | 5/1993 |
| SU | 1295799 | A1 | 2/1995 |
| SU | 1432190 | A1 | 10/1998 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |

| | | | |
|---|---|---|---|
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO02/25059 | A1 | 3/2002 |
| WO | WO02/29199 | A1 | 4/2002 |
| WO | WO02/40825 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO04/003337 | A1 | 1/2004 |
| WO | WO04/009950 | A1 | 1/2004 |
| WO | WO04/010039 | A2 | 1/2004 |
| WO | WO04/010039 | A3 | 1/2004 |
| WO | WO04/011776 | A2 | 2/2004 |
| WO | WO04/011776 | A3 | 2/2004 |
| WO | WO04/018823 | A2 | 3/2004 |
| WO | WO04/018823 | A3 | 3/2004 |
| WO | WO04/018824 | A2 | 3/2004 |
| WO | WO04/018824 | A3 | 3/2004 |
| WO | WO04/020895 | A2 | 3/2004 |
| WO | WO04/020895 | A3 | 3/2004 |
| WO | WO04/023014 | A2 | 3/2004 |
| WO | WO04/023014 | A3 | 3/2004 |
| WO | WO04/026017 | A2 | 4/2004 |
| WO | WO04/026017 | A3 | 4/2004 |
| WO | WO04/026073 | A2 | 4/2004 |
| WO | WO04/026073 | A3 | 4/2004 |
| WO | WO04/026500 | A2 | 4/2004 |
| WO | WO04/026500 | A3 | 4/2004 |
| WO | WO04/027200 | A2 | 4/2004 |
| WO | WO04/027200 | A3 | 4/2004 |
| WO | WO04/027204 | A2 | 4/2004 |
| WO | WO04/027204 | A3 | 4/2004 |
| WO | WO04/027205 | A2 | 4/2004 |
| WO | WO04/027205 | A3 | 4/2004 |
| WO | WO04/027392 | A1 | 4/2004 |
| WO | WO04/027786 | A2 | 4/2004 |
| WO | WO04/027786 | A3 | 4/2004 |
| WO | WO04/053434 | A2 | 6/2004 |
| WO | WO04/053434 | A3 | 6/2004 |
| WO | WO04/067961 | A2 | 8/2004 |
| WO | WO04/072436 | A1 | 8/2004 |
| WO | WO04/074622 | A2 | 9/2004 |
| WO | WO04/076798 | A2 | 9/2004 |
| WO | WO04/081346 | A2 | 9/2004 |
| WO | WO04/083591 | A2 | 9/2004 |
| WO | WO04/083592 | A2 | 9/2004 |
| WO | WO04/083592 | A3 | 9/2004 |
| WO | WO04/083593 | A2 | 9/2004 |
| WO | WO04/083594 | A2 | 9/2004 |
| WO | WO04/083594 | A3 | 9/2004 |
| WO | WO04/085790 | A2 | 10/2004 |
| WO | WO04/089608 | A2 | 10/2004 |

| | | | |
|---|---|---|---|
| WO | WO04/092527 | A2 | 10/2004 |
| WO | WO04/092528 | A2 | 10/2004 |
| WO | WO04/092530 | A2 | 10/2004 |
| WO | WO04/094766 | A2 | 11/2004 |
| WO | WO05/017303 | A2 | 2/2005 |
| WO | WO05/021921 | A2 | 3/2005 |
| WO | WO05/021921 | A3 | 3/2005 |
| WO | WO05/021922 | A2 | 3/2005 |
| WO | WO05/028803 | A2 | 3/2005 |
| WO | WO05/071212 | A1 | 4/2005 |
| WO | WO05/081803 | A1 | 9/2005 |
| WO | WO05/086614 | A2 | 9/2005 |

OTHER PUBLICATIONS

International Examination Report, Application PCT/US03/13787; Mar. 2, 2005.
International Search Report, Application PCT/US03/14153; May 28, 2004.
International Search Report, Application PCT/US03/15020; Jul. 30, 2003.
International Search Report, Application PCT/US03/18530; Jun. 24, 2004.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/20870; Sep. 30, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Examination Report, Application PCT/US03/25676, Aug. 17, 2004.
International Search Report, Application PCT/US03/25677; May 21, 2004.
International Examination Report, Application PCT/US03/25677, Aug. 17, 2004.
International Search Report, Application PCT/US03/25707; Jun. 23, 2004.
International Search Report, Application PCT/US03/25715; Apr. 9, 2004.
International Search Report, Application PCT/US03/25716; Jan. 13, 2005.
International Search Report, Application PCT/US03/25742; May 27, 2004.
International Search Report, Application PCT/US03/25742; Dec. 20, 2004.
International Search Report, Application PCT/US03/29460; May 25, 2004.
International Examination Report, Application PCT/US03/29460; Dec. 8, 2004.
International Search Report, Application PCT/US03/25667; Feb. 26, 2004.
International Search Report, Application PCT/US03/29858; Jun. 30, 2003.
International Search Report, Application PCT/US03/29859; May 21, 2004.
International Examination Report, Application PCT/US03/29859, Aug. 16, 2004.
International Search Report, Application PCT/US03/38550; Jun. 15, 2004.
Search Report to Application No. EP 02806451.7; Feb. 9, 2005.
Search Report to Application No. GB 0003251.6, Jul. 13, 2000.
Search Report to Application No. GB 0004282.0, Jul. 31, 2000.
Search Report to Application No. GB 0004282.0 Jan. 15, 2001.
Search and Examination Report to Application No. GB 0004282.0, Jun. 3, 2003.
Search Report to Application No. GB 0004285.3, Jul. 12, 2000.
Search Report to Application No. GB 0004285.3, Jan. 17, 2001.
Search Report to Application No. GB 0004285.3, Jan. 19, 2001.
Search Report to Application No. GB 0004285.3, Aug. 28, 2002.
Examination Report to Application No. 0004285.3, Mar. 28, 2003.
Examination Report to Application No. GB 0005399.1; Jul. 24, 2000.
Search Report to Application No. GB 0005399.1, Feb. 15, 2001.
Examination Report to Application No. GB 0005399.1; Oct. 14, 2002.
Search Report to Application No. GB 0013661.4, Oct. 20, 2000.
Search Report to Application No. GB 0013661.4, Apr. 17, 2001.
Search Report to Application No. GB 0013661.4, Feb. 19, 2003.
Examination Report to Application No. GB 0013661.4, Nov. 25, 2003.
Search Report to Application No. GB 0013661.4, Oct. 20, 2003.
Examination Report to Application No. GB 0208367.3, Apr. 4, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb. 9, 2004.
Search Report to Application No. GB 0219757.2, Nov. 25, 2002.
Search Report to Application No. GB 0219757.2, Jan. 20, 2003.
Examination Report to Application No. GB 0219757.2, May 10, 2004.
Search Report to Application No. GB 0220872.6, Dec. 5, 2002.
Search Report to Application GB 0220872.6, Mar. 13, 2003.
Examination Report to Application GB 0220872.6, Oct. 29, 2004.
Search Report to Application No. GB 0225505.7, Mar. 5, 2003.
Search and Examination Report to Application No. GB 0225505.7, Jul. 1, 2003.
Examination Report to Application No. GB 0225505.7, Oct. 27, 2004.
Examination Report to Application No. GB 0225505.7, Feb. 15, 2005.
Examination Report to Application No. GB 0300085.8, Nov. 28, 2003.
Examination Report to Application No. GB 030086.6, Dec. 1, 2003.
Examination Report to Application No. GB 0306046.4, Sep. 10, 2004.
Search and Examination Report to Application No. GB 0308290.6, Jun. 2, 2003.
Search and Examination Report to Application No. GB 0308293.0, Jun. 2, 2003.
Search and Examination Report to Application No. GB 0308293.0, Jul. 14, 2003.
Search and Examination Report to Application No. GB 0308294.8, Jun. 2, 2003.
Search and Examination Report to Application No. GB 0308294.8, Jul. 14, 2003.
Search and Examination Report to Application No. GB 0308295.5, Jun. 2, 2003.
Search and Examination Report to Application No. GB 0308295.5, Jul. 14, 2003.
Search and Examination Report to Application No. GB 0308296.3, Jun. 2, 2003.
Search and Examination Report to Application No. GB 0308296.3, Jul. 14, 2003.
Search and Examination Report to Application No. GB 0308297.1, Jun. 2, 2003.
Search and Examination Report to Application No. GB 0308297.1, Jul. 2003.
Search and Examination Report to Application No. GB 0308299.7, Jun. 2, 2003.
Search and Examination Report to Application No. GB 0308299.7, Jun. 14, 2003.

Search and Examination Report to Application No. GB 0308302.9, Jun. 2, 2003.
Search and Examination Report to Application No. GB 0308303.7, Jun. 2, 2003.
Search and Examination Report to Application No. GB 0308303.7, Jul. 14, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Examination Report to Application No. GB 0310836.2, Aug. 7, 2003.
Examination Report to Application No. GB 0311596.1, May 18, 2004.
Search and Examination Report to Application No. GB 0313406.1, Sep. 3, 2003.
Search and Examination Report to Application No. GB 0313406.1, Sep. 3, 2003.
Examination Report to Application No. GB 0314846.7, Jul. 15, 2004.
Search and Examination Report to Application No. GB 0316883.8, Aug. 14, 2003.
Search and Examination Report to Application No. GB 0316883.8, Nov. 25, 2003.
Search and Examination Report to Application No. GB 0316886.1, Aug. 14, 2003.
Search and Examination Report to Application No. GB 0316886.1, Nov. 25, 2003.
Search and Examination Report to Application No. GB 0316887.9, Aug. 14, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.
Examination Report to Application No. GB 0325072.7; Apr. 13, 2004.
Examination Report to Application No. GB 0400018.8; Oct. 29, 2004.
Examination Report to Application No. GB 0400019.6; Oct. 29, 2004.
Search and Examination Report to Application No. GB 0403891.5, Jun. 9, 2004.
Examination Report to Application No. GB 0403891.5, Feb. 14, 2005.
Search and Examination Report to Application No. GB 0403893.1, Jun. 9, 2004.
Search and Examination Report to Application No. GB 0403894.9, Jun. 9, 2004.
Examination Report to Application No. GB 0403894.9, Feb. 15, 2005.
Search and Examination Report to Application No. GB 0403897.2, Jun. 9, 2004.
Search and Examination Report to Application No. GB 0403920.2, Jun. 10, 2004.
Search and Examination Report to Application No. GB 0403921.0, Jun. 10, 2004.
Examination Report to Application No. GB 0403921.0, Feb. 15, 2005.
Search and Examination Report to Application No. GB 0403926.9, Jun. 10, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404833.6, Aug. 19, 2004.
Search and Examination Report to Application No. GB 0404837.7, May 17, 2004.
Examination Report to Application No. GB 0404837.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406257.6, Jan. 25, 2005.

Examination Report to Application No. GB 0406258.4, May 20, 2004.
Examination Report to Application No. GB 0406258.4; Jan. 12, 2005.
Examination Report to Application No. GB 0408672.4, Jul. 12, 2004.
Examination Report to Application No. GB 0404830.2, Aug. 17, 2004.
Search and Examination Report to Application No. GB 0411698.4, Jun. 30, 2004.
Examination Report to Application No. GB 0411698.4, Jan. 24, 2005.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search Report to Application No. GB 0415835.8, Dec. 2, 2004.
Examination Report to Application No. 0416625.2 Jan. 20, 2005.
Search and Examination Report to Application No. GB 0416834.0, Aug. 11, 2004.
Search and Examination Report to Application No. GB 0416834.0, Nov. 16, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Examination Report to Application No. GB 9926450.9, May 15, 2002.
Examination Report to Application No. GB 9926450.9, Nov. 22, 2002.
Search Report to Application No. GB 9930398.4, Jun. 27, 2000.
Search Report to Application No. Norway 1999 5593, Aug. 20, 2002.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25608 Sep. 13, 2004.
Written Opinion to Application No. PCT/US02/25608 Feb. 2, 2005.
Written Opinion to Application No. PCT/US02/25675 Nov. 24, 2004.
Written Opinion to Application No. PCT/US02/25727; May 17, 2004.
Written Opinion to Application No. PCT/US02/39418; Jun. 9, 2004.
Written Opinion to Application No. PCT/US02/39425; Nov. 22, 2004.
Written Opinion to Application No. PCT/US03/06544; Feb. 18, 2005.
Written Opinion to Application No. PCT/US03/11765 May 11, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Written Opinion to Application No. PCT/US03/29858 Jan. 21, 2004.
Written Opinion to Application No. PCT/US03/38550 Dec. 10, 2004.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.

Combined Search Report and Written Opinion to Application No. PCT/US04/28438 Mar. 14, 2005.
Halliburton Energy Services, "Halliburton Completion Products" 1996, Page Packers 5-37, United States of America.
Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;"Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including.." (2004).
www.tribtech.com. "Trib-gel A Chemical Cold Welding Agent" G R Linzell (Sep. 14, 1999).
www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
Michigan Metrology "3D Surface Finish Roughness Texture Wear WYKO Veeco" C.A. Brown, PHD; Charles, W.A. Johnsen, S. Chester.
International Search Report, Application PCT/IL00/00245, Sep. 18, 2000.
International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477; Oct. 31, 2003.
International Search Report, Application PCT/US02/20477; Apr. 6, 2004.
International Search Report, Application PCT/US02/24399; Feb. 27, 2004.
International Examination Report, Application PCT/US02/24399, Aug. 6, 2004.
International Search Report, Application PCT/US02/25608; May 24, 2004.
International Search Report, Application PCT/US02/25727; Feb. 19, 2004.
Examination Report, Application PCT/US02/25727; Jul. 7, 2004.
International Search Report, Application PCT/US02/29856, Dec. 16, 2002.
International Search Report, Application PCT/US02/36157; Sep. 29, 2003.
International Search Report, Application PCT/US02/36157; Apr. 14, 2004.
International Search Report, Application PCT/US02/36267; May 21, 2004.
International Examination Report, Application PCT/US02/36267, Jan. 4, 2004.
International Search Report, Application PCT/US02/39418, Mar. 24, 2003.
International Examination Report, Application PCT/US02/39418, Feb. 18, 2005.
International Search Report, Application PCT/US02/39425, May 28, 2004.
International Search Report, Application PCT/US03/00609, May 20, 2004.
International Search Report, Application PCT/US03/04837, May 28, 2004.
International Examination Report, Application PCT/US03/04837, Dec. 9, 2004.
International Search Report, Application PCT/US03/06544, Jun. 9, 2004.
International Search Report, Application PCT/US03/10144; Oct. 31, 2003.
Examination Report, Application PCT/US03/10144; Jul. 7, 2004.
International Search Report, Application PCT/US03/11765; Nov. 13, 2003.
International Examination Report, Application PCT/US03/11765; Dec. 10, 2004.
International Examination Report, Application PCT/US03/11765;; Jan. 25, 2005.
Blasingame et al., "Solid Expandable Tubular Technology in Mature Basins," *Society of Petroleum Engineers* 2003.
Brass et al., "Water Production Management—PDO's Successful Application of Expandable Technology," *Society of Petroleum Engineers*, 2002.
Brock et al., "An Expanded Horizon," Hart's E&P, Feb. 2000.
Buckler et al., "Expandable Cased-hole Liner Remediates Prolific Gas Well and Minimizes Loss of Production," *Offshore Technology Conference*, 15151.
Bullock, "Advances Grow Expandable Applications," *The American Oil & Gas Reporter*, Sep. 2004.

Cales, "The Development and Applications of Solid Expandable Tubular Technology," *Enventure Global Technology*, Paper 2003-136, 2003.
Cales et al., "Reducing Non-Productive Time Through the Use of Solid Expandable Tubulars: How to Beat the Curve Through Pre-Planning," *Offshore Technology Conference*, 16669, 2004.
Cales et al., "Subsidence Remediation—Extending Well Life Through the Use of Solid Expandable Casing Systems," *AADE Houston Chapter*, Mar. 27, 2001.
Campo et al., "Case Histories—Drilling and Recompletion Applications Using Solid Expandable Tubular Technology," *Society of Petroleum Engineers*, SPE/IADC 72304, 2002.
Carstens et al., "Solid Expandable Tubular Technology: The Value of Planned Installations vs. Contingency,".
Case History, "Eemskanaal—2 Groningen," Enventure Global Technology, Feb. 2002.
Case History, "Graham Ranch No. 1 Newark East Barnett Field" Enventure Global Technology, Feb. 2002.
Case History, "K.K. Camel No.1 Ridge Field Lafayette Parish, Louisiana," Enventure Global Technology, Feb. 2002.
Case History, "Mississippi Canyon 809 URSA TLP, OSC-G 5868, No. A-12," Enventure Global Technology, Mar. 2004.
Case History, "Unocal Sequoia Mississippi Canyon 941 Well No. 2" Enventure Global Technology, 2005.
Case History, "Yibal 381 Oman," Enventure Global Technology, Feb. 2002.
Cook, "Same Internal Casing Diameter From Surface to TD," *Offshore*, Jul. 2002.
Cottrill, "Expanadable Tubulars Close in on the Holy Grail of Drilling," *Upstream*, Jul. 26, 2002.
Daigle et al., "Expandable Tubulars: Field Examples of Application in Well Construction and Remediation," *Society of Petroleum Engineers*, SPE 62958, 2000.
Daneshy, "Technology Strategy Breeds Value," E&P, May 2004.
Data Sheet, "Enventure Cased-Hole Liner (CHL) System" Enventure Global Technology, Dec. 2002.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
Dean et al., "Monodiameter Drilling Liner—From Concept to Reality," *Society of Petroleum Engineers*, SPE/IADC 79790, 2003.
Demong et al., "Breakthroughs Using Solid Expandable Tubulars to Construct Extended Reach Wells," *Society of Petroleum Engineers*, IADC/SPE 87209, 2004.
Demong et al., "Casing Design in Complex Wells: The Use of Expandables and Multilateral Technology to Attack the size Reduction Issue".
Demong et al., "Expandable Tubulars Enable Multilaterals Without Compromise on Hole Size," *Offshore*, Jun. 2003.
Demong et al., "Planning the Well Construction Process for the Use of Solid Expandable Casing," *Society of Petroleum Engineers*, SPE 85303, 2003.
Demoulin, "Les Tubes Expansibles Changent La Face Du Forage Petrolier," *L'Usine Nouvelle*, 2878:50-52, 3 Juillet 2003.
Dupal et al., "Realization of the MonoDiameter Well: Evolution of a Game-Changing Technology," *Offshore Technology Conference*, OTC 14312, 2002.
Dupal et al., "Solid Expandable Tubular Technology—A Year of Case Histories in the Drilling Environment," *Society of Petroleum Engineers*, SPE/IADC 67770, 2001.
Dupal et al., "Well Design with Expandable Tubulars Reduces Cost and Increases Success in Deepwater Applications," *Deep Offshore Technology*, 2000.
Duphorne, "Letter Re: Enventure Claims of Baker Infringement of Enventure's Expandable Patents," Apr. 1, 2005.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
"Enventure Ready to Rejuvenate the North Sea," *Rostabout*, Sep. 2004.
Escobar et al., "Increasing Solid Expandable Tubular Technology Reliability in a Myriad of Downhole Environments," *Society of Petroleum Engineers*, SPE/IADC 81094, 2003.
Etsion, "A Laser Surface Textured Hydrostatic Mechanical Seal," *Sealing Technology*, Mar. 2003.
"Expandable Casing Accesses Remote Reservoirs," *Petroleum Engineer International*, Apr. 1999.
"Expandable Sand Screens," *Weatherford Completion Systems*, 2002.
Filippov et al., "Expandable Tubular Solutions," *Society of Petroleum Engineers*, SPE 56500, 1999.
"First ever SET Workshop Held in Aberdeen," *Roustabout*, Oct. 2004.
Fischer, "Expandables and the Dream of the Monodiameter Well: A Status Report", *World Oil*, Jul. 2004.
Fontova, "Solid Expandable Tubulars (SET) Provide Value to Operators Worldwide in a Variety of Applications," *EP Journal of Technology*, Apr. 2005.
Fraunhofer IWU, "Research Area: Sheet Metal Forming—Superposition of Vibrations," 2001.
Furlow, "Casing Expansion, Test Process Fine Tuned on Ultra-deepwater Well," *Offshore*, Dec. 2000.
Furlow, "Expandable Casing Program Helps Operator Hit TD With Larger Tubulars," *Offshore*, Jan. 2000.
Furlow, "Expandable Solid Casing Reduces Telescope Effect," *Offshore*, Aug. 1998.
Furlow, "Agbada Well Solid Tubulars Expanded Bottom Up, Screens Expanded Top Down," *Offshore*, 2002.
Grant et al., "Deepwater Expandable Openhole Liner Case Histories: Learnings Through Field Applications," *Offshore Technology Conference*, OCT 14218, 2002.
Gusevik et al., "Reaching Deep Reservoir Targets Using Solid Expandable Tubulars" *Society of Petroleum Engineers*, SPE 77612, 2002.
Halliburton Completion Products, 1996.
Haut et al., "Meeting Economic Challenges of Deepwater Drilling with Expandable-Tubular Technology," *Deep Offshore Technology Conference*, 1999.
Hull, "Monodiameter Technology Keeps Hole Diameter to TD," *Offshore* Oct. 2002.
"Innovators Chart the Course,".
Langley, "Case Study: Value in Drilling Derived From Application-Specific Technology," Oct. 2004.
Linzell, "Trib-Gel A Chemical Cold Welding Agent," 1999.
Lohoefer et al., "Expandable Liner Hanger Provides Cost-Effective Alternative Solution," *Society of Petroleum Engineers*, IADC/SPE 59151, 2000.
Mack et al., "How in Situ Expansion Affects Casing and Tubing Properties," *World Oil*, Jul. 1999. pp. 69-71.
Mack et al., "In-Situ Expansion of Casing and Tubing—Effect on Mechanical Properties and Resistance to Sulfide Stress Cracking,".
Merritt, "Casing Remediation—Extending Well Life Through The Use of Solid Expandable Casing Systems,".
Merritt et al., "Well Remediation Using Expandable Cased-Hole Liners", *World Oil.*, Jul. 2002.
Merritt et al., "Well Remediation Using Expandable Cased-Hole Liners—Summary of Case Histories".
Moore et al., "Expandable Liner Hangers: Case Histories," *Offshore Technology Conference*, OTC 14313, 2002.
Moore et al., "Field Trial Proves Upgrades to Solid Expandable Tubulars," *Offshore Technology Conference*, OTC 14217, 2002.
News Release, "Shell and Halliburton Agree to Form Company to Develop and Market Expandable Casing Technology," Jun. 3, 1998.
Nor, et at., "Transforming Conventional Wells to Bigbore Completions Using Solid Expandable Tubular Technology," *Offshore Technology Conference*, OTC 14315, 2002.
Patin et al., "Overcoming Well Control Challenges with Solid Expandable Tubular Technology," *Offshore Technology Conference*, OTC 15152, 2003.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers*, SPE 90828, 2004.

Rivenbark, "Expandable Tubular Technology—Drill Deeper, Farther, More Economically," Enventure Global Technology.
Rivenbark et al., "Solid Expandable Tubular Technology: The Value of Planned Installation vs. Contingency," *Society of Petroleum Engineers*, SPE 90821, 2004.
Rivenbark et al., "Window Exit Sidetrack Enhancements Through the Use of Solid Expandable Casing," *Society of Petroleum Engineers*, IADC/SPE 88030, 2004.
Roca et al., "Addressing Common Drilling Challenges Using Solid Expandable Tubular Technology," *Society of Petroleum Engineers*, SPE 80446, 2003.
Sanders et al., Practices for Providing Zonal Isolation in Conjunction with Expandable Casing Jobs-Case Histories, 2003.
Sanders et al., "Three Diverse Applications on Three Continents for a Single Major Operator," *Offshore Technology Conference*, OTC 16667, 2004.
"SET Technology: The Facts" 2004.
Siemers et al., "Development and Field Testing of Solid Expandable Corrosion Resistant Cased-hole Liners to Boost Gas Production in Corrosive Environments," *Offshore Technology Conference*, OTC 15149, 2003.
"Slim Well:Stepping Stone to MonoDiameter," *Hart's E&P*, Jun. 2003.
Smith, "Pipe Dream Reality," *New Technology Magazine*, Dec. 2003.
"Solid Expandable Tubulars," *Hart's E&P*, Mar. 2002.
Sparling et al., "Expanding Oil Field Tubulars Through a Window Demonstrates Value and Provides New Well Construction Option," *Offshore Technology Conference*, OTC 16664, 2004.
Sumrow, "Shell Drills World's First Monodiameter Well in South Texas," *Oil and Gas*, Oct. 21, 2002.
Touboul et al., "New Technologies Combine to Reduce Drilling Cost in Ultradeepwater Applications," *Society of Petroleum Engineers*, SPE 90830, 2004.
Turcotte et al., "Geodynamics Applications of Continuum Physics to Geological Problems," 1982.
Van Noort et al., "Using Solid Expandable Tubulars for Openhole Water Shutoff," *Society of Petroleum Engineers*, SPE 78495, 2002.
Van Noort et al., "Water Production Reduced Using Solid Expandable Tubular Technology to "Clad," in Fractured Carbonate Formation" *Offshore Technology Conference*, OTC 15153, 2003.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
Waddell et al., "Advances in Single-diameter Well Technology: The Next Step to Cost-Effective Optimization," *Society of Petroleum Engineers*, SPE 90818, 2004.
Waddell et al., "Installation of Solid Expandable Tubular Systems Through Milled Casing Windows," *Society of Petroleum Engineers*, IADC/SPE 87208, 2004.
Williams, "Straightening the Drilling Curve," *Oil and Gas Investor*, Jan. 2003.
www.JETLUBE.com, "Oilfield Catalog—Jet-Lok Product Applicatin Descriptions," 1998.
www.MITCHMET.com, "3d Surface Texture Parameters," 2004.
"Expand Your Oppurtunities." *Enventure*. CD-ROM. Jun. 1999.
"Expand Your Oppurtunities." *Enventure*. CR-ROM. May 2001.
International Search Report, Application PCT/US04/00631, Mar. 28, 2005.
International Preliminary Examination Report, Application PCT/US02/24399, Aug. 6, 2004.
International Preliminary Examination Report, Application PCT/US02/25608, Jun. 1, 2005.
International Preliminary Examination Report, Application PCT/US02/25727, Jul. 7, 2004.
International Preliminary Examination Report PCT/US02/36157, Apr. 14, 2004.
International Preliminary Examination Report, Application PCT/US02/36267, Jan. 4, 2004.
International Preliminary Examination Report, Application PCT/US02/39418, Feb. 18, 2005.
International Preliminary Examination Report, Application PCT/US03/04837, Dec. 9, 2004.
International Preliminary Examination Report, Application PCT/US03/06544, May 10, 2005.
International Preliminary Examination Report, Application PCT/US03/10144, Jul. 7, 2004.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US01/11765, Aug. 15, 2005 (Corrected).
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/20870, Sep. 30, 2004.
International Preliminary Examination Report, Application PCT/US03/25667, May 25, 2005.
International Preliminary Examination Report, Application PCT/US03/25675, Aug. 30, 2005.
International Preliminary Examination Report, Application PCT/US03/25676, Aug. 17, 2004.
International Preliminary Examination Report, Application PCT/US03/25677, Aug. 17, 2004.
International Preliminary Examination Report, Application PCT/US03/25742, Dec. 20, 2004.
International Preliminary Examination Report, Application PCT/US03/29460, Dec. 8, 2004.
International Preliminary Examination Report, Application PCT/US03/29858, May 23, 2005.
International Preliminary Examination Report, Application PCT/US03/29859, Aug. 16, 2004.
International Preliminary Examination Report, Application PCT/US03/38550, May 23, 2005.
International Preliminary Report on Patentability, Application PCT/US04/02122, May 13, 2005.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/11177, Jun. 9, 2005.
International Preliminary Report on Patentability, Application PCT/US04/28438, Sep. 20, 2005.
Written Opinion to Application No. PCT/US03/25675, May 9, 2005.
Combined Search Report and Written Opinion to Application No. PCT/US04/10762, Sep. 1, 2005.
Combined Search Report and Written Opinion to Application No. PCT/US04/11973, Sep. 27, 2005.
Combined Search Report and Written Opinion to Application No. PCT/US04/28423, Jul. 13, 2005.
Search Report to Application No. GB 0415835.8, Dec. 2, 2004.
Search Report to Application No. GB 0415835.8, Mar. 10, 2005.
Examination Report to Application No. GB 0400018.8, May 17, 2005.
Examination Report to Application No. GB 0400019.6, May 19, 2005.
Examination Report to Application No. GB 0403891.5, Jun. 30, 2005.

Examination Report to Application No. GB 0404796.5, Apr. 14, 2005.
Examination Report to Application No. GB 0406257.6, Jun. 16, 2005.
Examination Report to Application No. GB 0406257.6, Sep. 2, 2005.
Examination Report to Application No. GB 0406258.4, Jul. 27, 2005.
Examination Report to Application No. GB 0408672.4, Mar. 21, 2005.
Examination Report to Application No. GB 0412533.2, May 20, 2005.
Examination Report to Application No. GB 0428141.6, Sep. 15, 2005.
Examination Report to Application No. GB 0500184.7, Sep. 12, 2005.
Examination Report to Application No. GB 0500600.2, Sep. 6, 2005.
Examination Report to Application No. GB 0501667.0, May 27, 2005.
Examination Report to Application No. GB 0503470.7, Sep. 22, 2005.
Examination Report to Application No. GB 0506699.8, Sep. 21, 2005.
Examination Report to Application No. GB 0507979.3, Jun. 16, 2005.
Search and Examination Report to Application No. GB 0425948.7, Apr. 14, 2005.
Search and Examination Report to Application No. GB 0425951.1, Apr. 14, 2005.
Search and Examination Report to Application No. GB 0425956.0, Apr. 14, 2005.
Search and Examination Report to Application No. GB 050503938, Jul. 22, 2005.
Search and Examination Report to Application No. GB 0506697.2, May 20, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Examination Report to Application No. AU 2001278196, Apr. 21, 2005.
Examination Report to Application No. AU 2002237757, Apr. 28, 2005.
Examination Report to Application No. AU 2002240366, Apr. 13, 2005.
Search Report to Application No. EP 02806451.7; Feb. 9, 2005.
Search Report to Application No. Norway 1999 5593, Aug. 20, 2002.

* cited by examiner

METHOD AND APPARATUS FOR FORMING A MONO-DIAMETER WELLBORE CASING

CROSS REFERENCE TO RELATED APPLICATIONS

This application is a divisional of U.S. application Ser. No. 10/465,831, filed Jun. 13, 2003, (now allowed), which is the National Phase of the International Application No. PCT/US02/00093, filed Jan. 2, 2002 which is based on U.S. application Ser. No. 60/259,486, filed on Jan. 3, 2001, which was a Continuation-In-Part of U.S. application Ser. No. 10/406,648 filed Mar. 31, 2003, which is a National Phase of the International Application No. PCT/US01/30256, filed Sep. 27, 2002, which is based on U.S. application Ser. No. 60/237,334, filed on Oct. 2, 2000, the disclosure of which is incorporated herein by reference.

This application is related to the following co-pending applications: (1) U.S. Pat. No. 6,497,289, which was filed as U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. Pat. No. 6,328,113, which was filed as U.S. patent application Ser. No. 09/440,338, filed on Nov. 15, 1999, (5) U.S. Pat. No. 6,640,903, which was filed as U.S. patent application Ser. No. 09/523,460, filed on Mar. 10, 2000, (6) U.S. Pat. No. 6,568,471, which was filed as U.S. patent application Ser. No. 09/512,895, filed on Feb. 24, 2000, (7) U.S. Pat. No. 6,575,240, which was filed as U.S. patent application Ser. No. 09/511,941, filed on Feb. 24, 2000, (8) U.S. Pat. No. 6,557,640, which was filed as U.S. patent application Ser. No. 09/588,946, filed on Jun. 7, 2000, (9) U.S. Pat. No. 6,604,763, which was filed as U.S. patent application Ser. No. 09/559,122, filed on Apr. 26, 2000, (10) U.S. patent application Ser. No. 10/030,593, filed on Jan. 8, 2002, which claims priority from PCT patent application Ser. No. PCT/US00/18635, filed on Jul. 9, 2000, (11) U.S. patent application Ser. No. 10/111,982, filed on Apr. 30, 2002, which claims priority from U.S. provisional patent application Ser. No. 60/162,671, filed on Nov. 1, 1999, (12) U.S. provisional patent application Ser No. 60/154,047, filed on Sep. 16, 1999, (13) U.S. Pat. No. 6,564,875, which was filed as application Ser. No. 09/679,907, on Oct. 5, 2000, which claims priority from U.S. provisional patent application Ser. No. 60/159,082, filed on Oct. 12, 1999, (14) U.S. patent application Ser. No. 10/089,419, filed on Mar. 27, 2002, which claims priority from U.S. provisional patent application Ser. No. 60/159,039, filed on Oct. 12, 1999, (15) U.S. patent application Ser. No. 09/679,906, filed on Oct. 5, 2000, which claims priority from U.S. provisional patent application Ser. No. 60/159,033, filed on Oct. 12, 1999, (16) U.S. patent application Ser. No. 10/303,992, filed on Nov. 22, 2002, which claims priority from U.S. provisional patent application Ser. No. 60/212,359, filed on Jun. 19, 2000, (17) U.S. provisional patent application Ser. No. 60/165,228, filed on Nov. 12, 1999, (18) U.S. patent application Ser. No. 10/311,412, filed on Dec. 12, 2002, which claims priority from U.S. provisional patent application Ser. No. 60/221,443, filed on Jul. 28, 2000, (19) U.S. patent application Ser. No. 10/, filed on Dec. 18, 2002, which claims priority from U.S. provisional patent application Ser. No. 60/221,645, filed on Jul. 28, 2000, (20) U.S. patent application Ser. No. 10/322,947, filed on Jan. 22, 2003, which claims priority from U.S. provisional patent application Ser. No. 60/233,638, filed on Sep. 18, 2000, and (21) U.S. patent application Ser. No. 10/406,648, filed on Mar. 31, 2003, which claims priority U.S. provisional patent application Ser. No. 60/237,334, filed on Oct. 2, 2000. Applicants incorporate by reference the disclosures of these applications.

This application is also related to each of the following; (1) U.S. utility patent application Ser. No. 11/068,595, filed on Feb. 28, 2005; (2) U.S. utility patent application Ser. No. 11/069,698, filed on Mar. 1, 2005; (3) U.S. utility patent application Ser. No. 11/070,147, filed on Mar. 2, 2005; (4) U.S. utility patent application Ser. No. 11/071,409, filed on Mar. 3, 2005; (5) U.S. utility patent application Ser. No. 11/071,557, filed on Mar. 3, 2005; (6) U.S. utility patent application Ser. No. 11/072,893, filed on Mar. 4, 2005; (7) U.S. utility patent application Ser. No. 11/072,594, filed on Mar. 4, 2005; (8) U.S. utility patent application Ser. No. 11/074,366, filed on Mar. 7, 2005; and (9) U.S. utility patent application Ser. No. 11/074,266, filed on Mar. 7, 2005.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 14, 2003), which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003 which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2003, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91)

U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001,(now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999; (122) PCT patent application Ser. No. PCT/US2004/06246, filed on Feb. 26, 2004; (123) PCT patent application Ser. No. PCT/US2004/08170, filed on Mar. 15, 2004; (124) PCT patent application Ser. No. PCT/US2004/08171, filed on Mar. 15, 2004; (125) PCT patent application Ser. No. PCT/US2004/08073, filed on Mar. 18, 2004; (126) PCT patent application Ser. No. PCT/US2004/07711, filed on Mar. 11, 2004; (127) PCT patent application Ser. No. PCT/US2004/029025, filed on Mar. 26, 2004; (128) PCT patent application Ser. No. PCT/US2004/010317, filed on Mar. 2, 2004; (129) PCT patent application Ser. No. PCT/US2004/010712, filed on Apr. 6, 2004; (130) PCT patent application Ser. No. PCT/US2004/010762, filed on Mar. 6, 2004; (131) PCT patent application Ser. No. PCT/US2004/011973, filed on Apr. 15, 2004; (132) U.S. provisional patent application Ser. No. 60/495,056, filed on Aug. 14, 2003; (133) U.S. provisional patent application Ser. No. 60/600,679, filed on Aug. 11, 2004; (134) PCT patent application Ser. No. PCT/US2005/027318, filed on Jul. 29, 2005; (135) PCT patent application Ser. No. PCT/US2005/028936, filed on Aug. 12, 2005; (136) PCT patent application Ser. No. PCT/US2005/028669, filed on Aug. 11, 2005; (137) PCT patent application Ser. No. PCT/US2005/028453, filed on Aug. 11, 2005; (138) PCT patent application Ser. No. PCT/US2005/028641, filed on Aug. 11, 2005; (139) PCT patent application Ser. No. PCT/US2005/028819, filed on Aug. 11, 2005; (140) PCT patent application Ser. No. PCT/US2005/028446, filed on Aug. 11, 2005; (141) PCT patent application Ser. No. PCT/US2005/028642, filed on Aug. 11, 2005; (142) PCT patent application Ser. No. PCT/US2005/028451, filed on Aug. 11, 2005, and (143). PCT patent application Ser. No. PCT/US2005/028473, filed on Aug. 11, 2005, (144) U.S. utility patent application Ser. No. 10/546,082, filed on Aug. 16, 2005, (145) U.S. utility patent application Ser. No. 10/546,076, filed on Aug. 16, 2005, (146) U.S. utility patent application Ser. No. 10/545,936, filed on Aug. 16, 2005, (147) U.S. utility patent application Ser. No. 10/546,079, filed on Aug. 16, 2005 (148) U.S. utility patent application Ser. No. 10/545,941, filed on Aug. 16, 2005, (149) U.S. utility patent application Ser. No. 10/546,078, filed on Aug. 17, 2005, (150) U.S. utility patent application Ser. No. 10/545,941, filed on Aug. 16, 2005, (151) U.S. utility patent application Ser. No. 11/249,967, filed on Oct. 13, 2005, (152) U.S. provisional patent application Ser. No. 60/734,302, filed on Nov. 7, 2005, (153) U.S. provisional patent application Ser. No. 60/725,181, filed on Oct. 11, 2005, (154) PCT patent application Ser. No. PCT/US2005/023391, filed Jun. 29, 2005 which claims priority from U.S. provisional patent application Ser. No. 60/585,370, filed on Jul. 2, 2004, (155) U.S. provisional patent application Ser. No. 60/721,579, filed on Sep. 28, 2005, (156) U.S. provisional patent application Ser. No.60/717,391, filed on Sep. 15, 2005, (157) U.S. provisional patent application Ser. No. 60/702,935, filed on Jul. 27, 2005, (158) U.S. provisional patent application Ser. No. 60/663,913, filed on Mar. 21, 2005, (159) U.S. provisional patent application Ser. No. 60/652,564, filed on Feb. 14, 2005, (160) U.S. provisional patent application Ser. No. 60/645,840, filed on Jan. 21, 2005, (161) PCT patent application Ser. No. PCT/US2005/043122, filed on Nov. 29, 2005 which claims priority from U.S. provisional patent application Ser. No. 60/631,703, filed on Nov. 30, 2004, (162) U.S. provisional patent application Ser. No. 60/752,787, filed on Dec. 22, 2005, (163) U.S. National Stage application Ser. No. 10/548,934, filed on Sep. 12, 2005; (164) U.S. National Stage application Ser. No. 10/549,410, filed on Sep. 13, 2005; (165) U0.5. Provisional Patent Application No. 60/717,391, filed on Sep. 15, 2005; (166) U.S. National Stage application Ser. No. 10/550,906, filed on Sep. 27, 2005; (167) U.S. National Stage application Ser. No. 10/551,880, filed on Sep. 30, 2005; (168) U.S. National Stage application Ser. No. 10/552,253, filed on Oct. 4, 2005; (169) U.S. National Stage application Ser. No. 10/552,790, filed on Oct. 11, 2005; (170) U.S. Provisional Patent Application No. 60/725,181, filed on Oct. 11, 2005; (171) U.S. National Stage application Ser. No. 10/553,094, filed on Oct. 13, 2005; (172) U.S. National Stage application Ser. No. 10/553,566, filed on Oct. 17, 2005; (173) PCT patent application No. PCT/US2006/002449, filed on Jan. 20, 2006, and (174) PCT patent application No. PCT/US2006/004809, filed on Feb. 9, 2006; (175) U.S. Utility patent application Ser. No. 11/356,899, filed on Feb. 17, 2006. (176) U.S. National Stage application Ser. No. 10/568,200, filed on Feb. 13, 2006. (177) U.S. National Stage application Ser. No. 10/568,719, filed on Feb. 16, 2006. (178) U.S. National Stage application Ser. No. 10/569,323, (179) U.S. National State patent application Ser. No. 10/571,041, filed on Mar. 3, 2006; (180) U.S. National State Patent application Ser. No. 10/571,017, filed on Mar. 3, 2006; (181) U.S. National State patent application Ser. No. 10/571,086, filed on Mar. 6, 2006; and (182) U.S. National State patent application Ser. No. 10/571,085, filed on Mar. 6, 2006. (183) U.S. utility Patent application Ser. No. 10/938,788, filed on Sep. 10, 2004. (184) U.S. utility patent application Ser. No. 10/938,225, filed on Sep. 10, 2004. (185) U.S. utility patent application Ser. No. 10/952,288, filed on Sep. 28, 2004. (186) U.S. utility patent application Ser. No. 10/952,416, filed on Sep. 28, 2004. (187) U.S. utility patent application Ser. No. 10/950,749, filed on Sep. 27, 2004, and (188) U.S. utility patent application Ser. No. 10/950,869, filed on Sep. 27, 2004.

BACKGROUND OF THE INVENTION

This invention relates generally to wellbore casings, and in particular to wellbore casings that are formed using expandable tubing.

Conventionally, when a wellbore is created, a number of casings are installed in the borehole to prevent collapse of the borehole wall and to prevent undesired outflow of drilling fluid into the formation or inflow of fluid from the formation into the borehole. The borehole is drilled in intervals whereby a casing which is to be installed in a lower borehole interval is lowered through a previously installed casing of an upper borehole interval. As a consequence of this procedure the casing of the lower interval is of smaller diameter than the casing of the upper interval. Thus, the casings are in a nested arrangement with casing diameters decreasing in downward direction. Cement annuli are provided between the outer surfaces of the casings and the borehole wall to seal the casings from the borehole wall. As a consequence of this nested arrangement a relatively large borehole diameter is required at the upper part of the wellbore. Such a large borehole diameter involves increased costs due to heavy casing handling equipment, large drill bits and increased volumes of drilling fluid and drill cuttings. Moreover, increased drilling rig time is involved due to required cement pumping, cement hardening, required equipment changes due to large variations in hole diameters drilled in the course of the well, and the large volume of cuttings drilled and removed.

The present invention is directed to overcoming one or more of the limitations of the existing procedures for forming wellbores.

SUMMARY OF THE INVENTION

According to one aspect of the invention, an apparatus for plastically deforming and radially expanding a tubular member is provided that includes means for plastically deforming and radially expanding a first portion of the tubular member to a first outside diameter, and means for plastically deforming and radially expanding a second portion of the tubular member to a second outside diameter.

According to another aspect of the present invention, an apparatus for plastically deforming and radially expanding a tubular member is provided that includes a tubular support member including a first fluid passage, an expansion cone coupled to the tubular support member having a second fluid passage fluidicly coupled to the first fluid passage and an outer conical surface, a removable annular conical sleeve coupled to the outer conical surface of the expansion cone, an annular expansion cone launcher coupled to the conical sleeve and a lower portion of the tubular member, and a shoe having a valveable passage coupled to an end of the expansion cone launcher.

According to another aspect of the present invention, a method of plastically deforming and radially expanding a tubular member is provided that includes plastically deforming and radially expanding a portion of the tubular member to a first outside diameter, and plastically deforming and radially expanding another portion of the tubular member to a second outside diameter.

According to another aspect of the present invention, a method of coupling a first tubular member to a second tubular member is provided that includes plastically deforming and radially expanding a first portion of the first tubular member to a first outside diameter, plastically deforming and radially expanding another portion of the first tubular member to a second outside diameter, positioning the second tubular member inside the first tubular member in overlapping relation to the first portion of the first tubular member, plastically deforming and radially expanding the second tubular member to a third outside diameter, and plastically deforming and radially expanding the second tubular member to a fourth outside diameter. The inside diameters of the first and second tubular members after the plastic deformations and radial expansions are substantially equal.

According to another aspect of the present invention, an apparatus for coupling a first tubular member to a second tubular member is provided that includes means for plastically deforming and radially expanding a first portion of the first tubular member to a first outside diameter, means for plastically deforming and radially expanding another portion of the first tubular member to a second outside diameter, means for positioning the second tubular member inside the first tubular member in overlapping relation to the first portion of the first tubular member, means for plastically deforming and radially expanding the second tubular member to a third outside diameter, and means for plastically deforming and radially expanding the second tubular member to a fourth outside diameter. The inside diameters of the first and second tubular members after the plastic deformations and radial expansions are substantially equal.

According to another aspect of the present invention, an apparatus for forming a wellbore casing within a wellbore is provided that includes means for supporting a tubular member within the wellbore, means for plastically deforming and radially expanding a first portion of the tubular member to a first outside diameter, and means for plastically deforming and radially expanding a second portion of the tubular member to a second outside diameter.

According to another aspect of the present invention, an apparatus for forming a wellbore casing within a wellbore is provided that includes a tubular support member including a first fluid passage, an expansion cone coupled to the tubular support member having a second fluid passage fluidicly coupled to the first fluid passage and an outer conical surface, a removable annular conical sleeve coupled to the outer conical surface of the expansion cone, an annular expansion cone launcher coupled to the conical sleeve and a lower portion of the tubular member, and a shoe having a valveable passage coupled to an end of the expansion cone launcher.

According to another aspect of the present invention, a method of forming a wellbore casing within a wellbore is provided that includes supporting a tubular member within a wellbore, plastically deforming and radially expanding a portion of the tubular member to a first outside diameter, and plastically deforming and radially expanding another portion of the tubular member to a second outside diameter.

According to another aspect of the present invention, a method of forming a mono-diameter wellbore casing within a wellbore is provided that includes supporting a first tubular member within the wellbore, plastically deforming and radially expanding a first portion of the first tubular member to a first outside diameter, plastically deforming and radially expanding another portion of the first tubular member to a second outside diameter, positioning the second tubular member inside the first tubular member in overlapping relation to the first portion of the first tubular member, plastically deforming and radially expanding the second tubular member to a third outside diameter, and plastically deforming and radially expanding the second tubular member to a fourth outside diameter. The inside diameters of the first and second tubular members after the plastic deformations and radial expansions are substantially equal.

According to another aspect of the present invention, an apparatus for coupling a first tubular member to a second tubular member is provided that includes means for plastically deforming and radially expanding a first portion of the first tubular member to a first outside diameter, means for plastically deforming and radially expanding another portion of the first tubular member to a second outside diameter, means for positioning the second tubular member inside the first tubular member in overlapping relation to the first portion of the first tubular member, means for plastically deforming and radially expanding the second tubular member to a third outside diameter, and means for plastically deforming and radially expanding the second tubular member to a fourth outside diameter. The inside diameters of the first and second tubular members after the plastic deformations and radial expansions are substantially equal.

According to another aspect of the present invention, an apparatus for plastically deforming and radially expanding a tubular member is provided that includes means for providing a lipped portion in a portion of the tubular member, and means for plastically deforming and radially expanding another portion of the tubular member.

According to another aspect of the present invention, an apparatus for plastically deforming and radially expanding a tubular member is provided that includes a tubular support member including a first fluid passage, an expansion cone coupled to the tubular support member having a second fluid passage fluidicly coupled to the first fluid passage and an outer conical surface, an annular expansion cone launcher including: a first annular portion coupled to a lower portion of the tubular member, a second annular portion coupled to the first annular portion that mates with the outer conical surface of the expansion cone, a third annular portion coupled to the second annular portion having a first outside diameter, and a fourth annular portion coupled to the third annular portion having a second outside diameter, wherein the second outside diameter is less than the first outside diameter, and a shoe having a valveable passage coupled to fourth annular portion of the expansion cone launcher.

According to another aspect of the present invention, a method of plastically deforming and radially expanding a tubular member is provided that includes providing a lipped portion in a portion of the tubular member, and plastically deforming and radially expanding another portion of the tubular member.

According to another aspect of the present invention, a method of coupling a first tubular member to a second tubular member is provided that includes providing a lipped portion in a portion of the first tubular member, plastically deforming and radially expanding another portion of the first tubular member, positioning the second tubular member inside the first tubular member in overlapping relation to the lipped portion of the first tubular member, and plastically deforming and radially expanding the second tubular member. The inside diameters of the first and second tubular members after the plastic deformations and radial expansions are substantially equal.

According to another aspect of the present invention, an apparatus for coupling a first tubular member to a second tubular member is provided that includes means for providing a lipped in the first tubular member, means for plastically deforming and radially expanding another portion of the first tubular member, means for positioning the second tubular member inside the first tubular member in overlapping relation to the lipped portion of the first tubular member, and means for plastically deforming and radially expanding the second tubular member. The inside diameters of the first and second tubular members after the plastic deformations and radial expansions are substantially equal.

According to another aspect of the present invention, an apparatus for forming a wellbore casing within a wellbore is provided that includes means for supporting a tubular member within the wellbore, means for providing a lipped portion in the tubular member, and means for plastically deforming and radially expanding another portion of the tubular member to a second outside diameter.

According to another aspect of the present invention, an apparatus for forming a wellbore casing within a wellbore is provided that includes a tubular support member including a first fluid passage, an expansion cone coupled to the tubular support member having a second fluid passage fluidicly coupled to the first fluid passage and an outer conical surface, an annular expansion cone launcher including: a first annular portion coupled to a lower portion of the tubular member, a second annular portion coupled to the first annular portion that mates with the outer conical surface of the expansion cone, a third annular portion coupled to the second annular portion having a first outside diameter, and a fourth annular portion coupled to the third annular portion having a second outside diameter, wherein the second outside diameter is less than the first outside diameter, and a shoe having a valveable passage coupled to fourth annular portion of the expansion cone launcher.

According to another aspect of the present invention, a method of forming a wellbore casing in a wellbore is provided that includes supporting a tubular member within the wellbore, providing a lipped portion in a portion of the tubular member, and plastically deforming and radially expanding another portion of the tubular member.

According to another aspect of the present invention, a method of forming a mono-diameter wellbore casing within a wellbore is provided that includes supporting a first tubular member within the wellbore, providing a lipped portion in a portion of the first tubular member, plastically deforming and radially expanding another portion of the first tubular member, positioning the second tubular member inside the first tubular member in overlapping relation to the lipped portion of the first tubular member, and plastically deforming and radially expanding the second tubular member. The inside diameters of the first and second tubular members after the plastic deformations and radial expansions are substantially equal.

According to another aspect of the present invention, an apparatus for forming a mono-diameter wellbore casing within a wellbore is provided that includes means for providing a lipped in the first tubular member, means for plastically deforming and radially expanding another portion of the first tubular member, means for positioning the second tubular member inside the first tubular member in overlapping relation to the lipped portion of the first tubular member, and means for plastically deforming and radially expanding the second tubular member. The inside diameters of the first and second tubular members after the plastic deformations and radial expansions are substantially equal.

According to another aspect of the present invention, an apparatus for plastically deforming and radially expanding a tubular member is provided that includes means for plastically deforming and radially expanding a first end of the tubular member, and means for plastically deforming and radially expanding a second end of the tubular member.

According to another aspect of the present invention, an apparatus for plastically deforming and radially expanding a tubular member is provided that includes a tubular support member including a first passage, an expansion cone coupled to the tubular support having a second passage fluidicly coupled to the first passage and an outer conical surface, an annular expansion cone launcher movably coupled to outer conical surface of the expansion cone, an expandable tubular member coupled to an end of the annular expansion cone launcher, a shoe coupled to another end of the annular expansion cone launcher having a valveable fluid passage, and another annular expansion cone movably coupled to the tubular support member. The annular expansion cones are positioned in opposite orientations.

According to another aspect of the present invention, a method of plastically deforming and radially expanding a tubular member is provided that includes plastically deforming and radially expanding a first end of the tubular member, and plastically deforming and radially expanding a second end of the tubular member.

According to another aspect of the present invention, a method of coupling a first tubular member to a second tubular member is provided that includes positioning the second tubular member inside the first tubular member in an overlapping relationship, plastically deforming and radially expanding the end of the second tubular member that overlaps with the first tubular member, and plastically deforming and radially expanding the remaining portion of the second tubular member.

According to another aspect of the present invention, an apparatus for coupling a first tubular member to a second tubular member is provided that includes means for positioning the second tubular member inside the first tubular member in an overlapping relationship, means for plastically deforming and radially expanding the end of the second tubular member that overlaps with the first tubular member, and means for plastically deforming and radially expanding the remaining portion of the second tubular member.

According to another aspect of the present invention, an apparatus for forming a wellbore casing within a wellbore is provided that includes means for supporting a tubular member within the wellbore, means for plastically deforming and radially expanding a first end of the tubular member, and means for plastically deforming and radially expanding a second end of the tubular member.

According to another aspect of the present invention, an apparatus for forming a wellbore casing within a wellbore is provided that includes a tubular support member including a first passage, an expansion cone coupled to the tubular support having a second passage fluidicly coupled to the first passage and an outer conical surface, an annular expansion cone launcher movably coupled to outer conical surface of the expansion cone, an expandable tubular member coupled to an end of the annular expansion cone launcher, a shoe coupled to another end of the annular expansion cone launcher having a valveable fluid passage, and another annular expansion cone movably coupled to the tubular support member. The annular expansion cones are positioned in opposite orientations.

According to another aspect of the present invention, a method of forming a wellbore casing within a wellbore is provided that includes plastically deforming and radially expanding a first end of the tubular member, and plastically deforming and radially expanding a second end of the tubular member.

According to another aspect of the present invention, a method of forming a wellbore casing within a wellbore is provided that includes plastically deforming and radially expanding a first tubular member within the wellbore, positioning a second tubular member inside the first tubular member in an overlapping relationship, plastically deforming and radially expanding the end of the second tubular member that overlaps with the first tubular member, and plastically deforming and radially expanding the remaining portion of the second tubular member.

According to another aspect of the present invention, an apparatus for forming a wellbore casing within a wellbore is provided that includes means for plastically deforming and radially expanding a first tubular member within the wellbore, means for positioning the second tubular member inside the first tubular member in an overlapping relationship, means for plastically deforming and radially expanding the end of the second tubular member that overlaps with the first tubular member, and means for plastically deforming and radially expanding the remaining portion of the second tubular member.

According to another aspect of the present invention, an apparatus for bridging an axial gap between opposing pairs of wellbore casing within a wellbore is provided that includes means for supporting a tubular member in overlapping relation to the opposing ends of the wellbore casings, means for plastically deforming and radially expanding the tubular member, and means for plastically deforming and radially expanding the tubular member and the opposing ends of the wellbore casings.

According to another aspect of the present invention, a method of bridging an axial gap between opposing pairs of wellbore casing within a wellbore is provided that includes supporting a tubular member in overlapping relation to the opposing ends of the wellbore casings, plastically deforming and radially expanding the tubular member, and plastically deforming and radially expanding the tubular member and the opposing ends of the wellbore casings.

According to another aspect of the present invention, a method of forming a structure having desired strength characteristics is provided that includes providing a first tubular member, and plastically deforming and radially expanding additional tubular members onto the interior surface of the first tubular member until the desired strength characteristics are achieved.

According to another aspect of the present invention, a method of forming a wellbore casing within a wellbore having desired strength characteristics is provided that includes plastically deforming and radially expanding a first tubular member within the wellbore, and plastically deforming and radially expanding additional tubular members onto the interior surface of the first tubular member until the desired strength characteristics are achieved.

According to another aspect of the present invention, a method of coupling a first tubular member to a second tubular member, the first tubular member having an original outside diameter $OD_0$ and an original wall thickness $t_0$, is provided that includes plastically deforming and radially expanding a first portion of the first tubular member to a first outside diameter, plastically deforming and radially expanding another portion of the first tubular member to a second outside diameter, positioning the second tubular member inside the first tubular member in overlapping relation to the first portion of the first tubular member, plastically deforming and radially expanding the second tubular member to a third outside diameter, and plastically deforming and radially expanding the second tubular member to a fourth outside diameter. The inside diameters of the first and second tubular members after the plastic deformations and radial expansions are substantially equal, and the ratio of the original outside diameter $OD_0$ of the first tubular member to the original wall thickness $t_0$ of the first tubular member is greater than or equal to 16.

According to another aspect of the present invention, a method of forming a mono-diameter wellbore casing is provided that includes positioning a first tubular member within a wellbore, the first tubular member having an original outside diameter $OD_0$ and an original wall thickness $t_0$, plastically deforming and radially expanding a first portion of the first tubular member to a first outside diameter, plastically deforming and radially expanding another portion of the first tubular member to a second outside diameter, positioning the second tubular member inside the first tubular member in overlapping relation to the first portion of the first tubular member, plastically deforming and radially expanding the second tubular member to a third outside diameter, and plastically deforming and radially expanding the second tubular member to a fourth outside diameter. The inside diameters of the first and second tubular members after the plastic deformations and radial expansions are substantially equal, and the ratio of the original outside diameter $OD_0$ of the first tubular member to the original wall thickness $t_0$ of the first tubular member is greater than or equal to 16.

According to another aspect of the present invention, an apparatus is provided that includes a plastically deformed and radially expanded tubular member having a first portion having a first outside diameter and a remaining portion having a second outside diameter. The ratio of the original outside diameter $OD_0$ of the first tubular member to the original wall thickness $t_0$ of the first tubular member is greater than or equal to 16.

According to another aspect of the present invention, an apparatus is provided that includes a plastically deformed and radially expanded first tubular member having a first portion having a first outside diameter and a remaining portion having a second outside diameter, and a plastically deformed and radially expanded second tubular member coupled to the first portion of the first tubular member. The ratio of the original outside diameter $OD_0$ of the first tubular member to the original wall thickness $t_0$ of the first tubular member is greater than or equal to 16.

According to another aspect of the present invention, a wellbore casing formed in a wellbore is provided that includes a plastically deformed and radially expanded first tubular member having a first portion having a first outside diameter and a remaining portion having a second outside diameter, and a plastically deformed and radially expanded second tubular member coupled to the first portion of the first tubular member. The ratio of the original outside diameter $OD_0$ of the first tubular member to the original wall thickness $t_0$ of the first tubular member is greater than or equal to 16.

According to another aspect of the present invention, an apparatus is provided that includes a plastically deformed and radially expanded tubular member. The ratio of the original outside diameter $OD_0$ of the tubular member to the original wall thickness $t_0$ of the tubular member is greater than or equal to 16.

DETAILED DESCRIPTION

Several embodiments of methods and apparatus for forming a mono-diameter wellbore casing are disclosed. In several alternative embodiments, the methods and apparatus may be used for form or repair mono-diameter wellbore casings, pipelines, or structural supports. Furthermore, while the present illustrative embodiments are described with reference to the formation of mono-diameter wellbore casings, the teachings of the present disclosure have general application to the formation or repair of wellbore casings, pipelines, and structural supports.

Figure 1A:
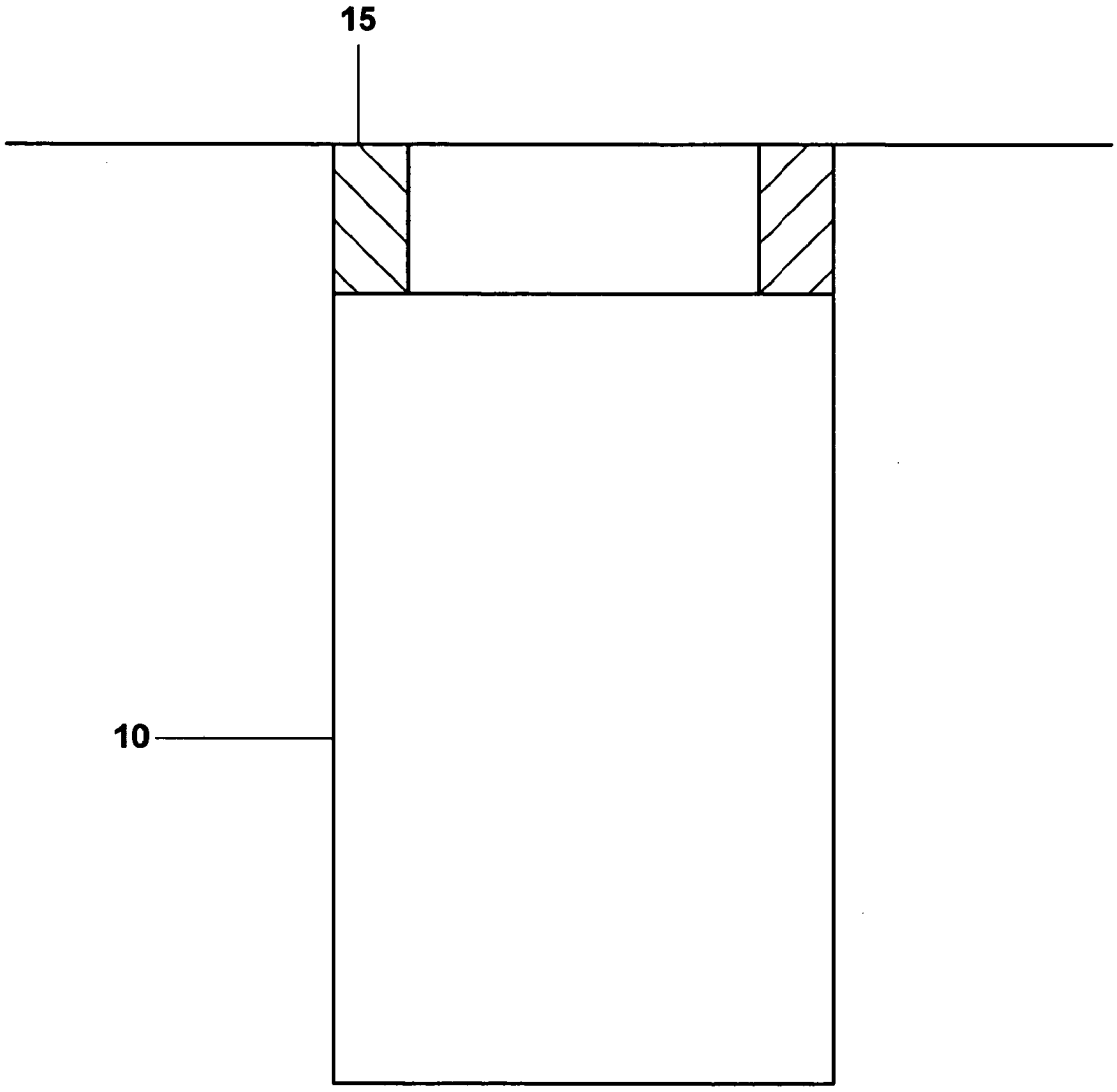
FIG. 1*a* is a cross sectional illustration of a wellbore including a preexisting wellbore casing.

Referring initially to FIG. 1*a*, a wellbore 10 includes a preexisting wellbore casing 15. The wellbore 10 may be oriented in any orientation from the vertical to the horizontal. The preexisting wellbore casing 15 may be coupled to the upper portion of the wellbore 10 using any number of conventional methods. In a preferred embodiment, the wellbore casing 15 is coupled to the upper portion of the wellbore 10 using one or more of the methods and apparatus disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference. More generally, the preexisting wellbore casing 15 may be coupled to another preexisting wellbore casing and/or may include one or more concentrically positioned tubular members.

Figure 1B:
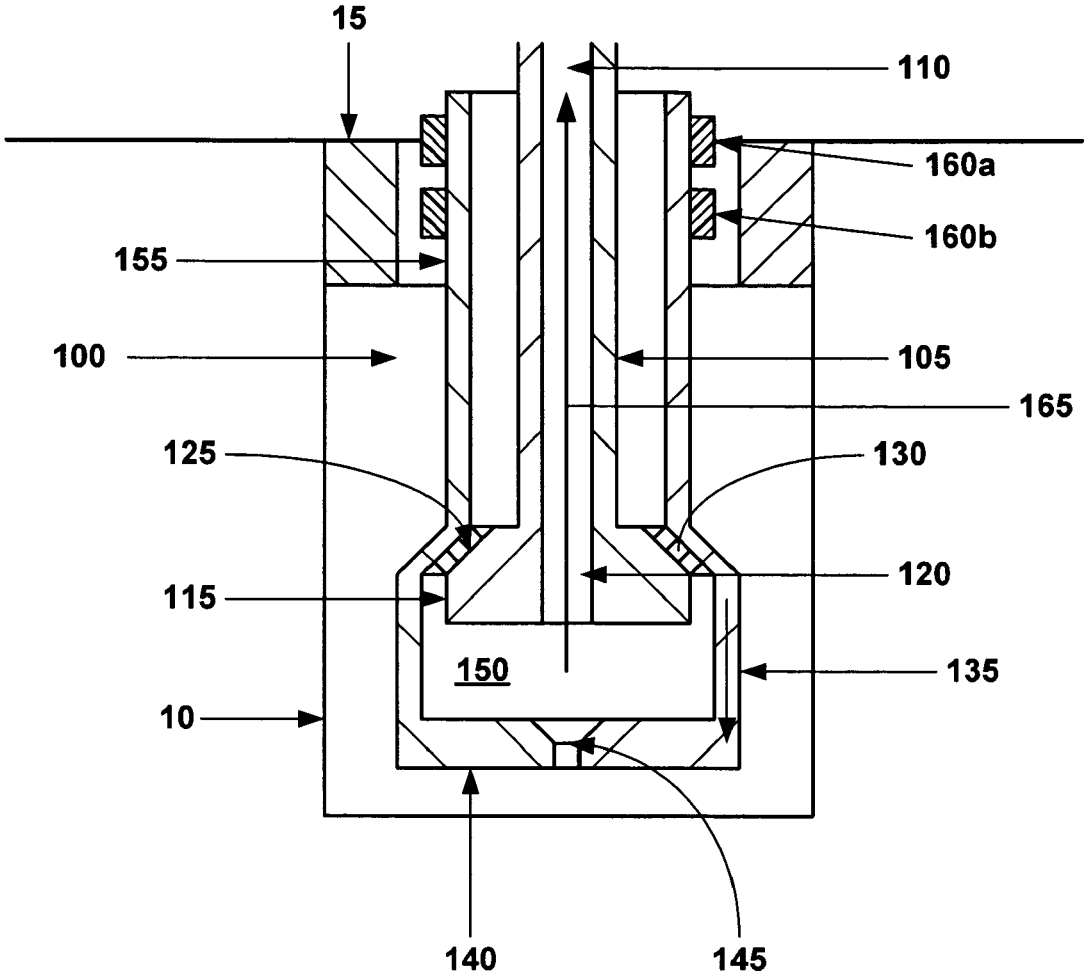
FIG. 1*b* is a cross-sectional illustration of the placement of an embodiment of an apparatus for radially expanding a tubular member into the wellbore of FIG. 1*a*.

Referring to FIG. 1*b*, an apparatus 100 for radially expanding a tubular member may then be positioned within the wellbore 10. The apparatus 100 includes a tubular support member 105 defining a passage 110 for conveying fluidic materials. An expansion cone 115 defining a passage 120 and having an outer conical surface 125 for radially expanding tubular members is coupled to an end of the tubular support member 105. An annular conical over-expansion sleeve 130 mates with and is removably coupled to the outer conical surface 125 of the expansion cone 115. In several alternative embodiments, the over-expansion sleeve 130 is fabricated from frangible materials such as, for example, ceramic materials, in order to facilitate the removal of the over-expansion sleeve during operation of the apparatus 100. In this manner, the amount of radial expansion provided by the apparatus may be decreased following the removal of the over-expansion sleeve 130.

An expansion cone launcher 135 is movably coupled to and supported by the expansion cone 115 and the over-expansion sleeve 130. The expansion cone launcher 135 include an upper portion having an upper outer diameter, an intermediate portion that mates with the expansion cone 115 and the over-expansion sleeve 130, an a lower portion having a lower outer diameter. The lower outer diameter is greater than the upper outer diameter. A shoe 140 defining a valveable passage 145 is coupled to the lower portion of the expansion cone launcher 135. In a preferred embodiment, the valveable passage 145 may be controllably closed in order to fluidicly isolate a region 150 below the expansion cone 115 and bounded by the lower portion of the expansion cone launcher 135 and the shoe 140 from the region outside of the apparatus 100.

An expandable tubular member 155 is coupled to the upper portion of the expansion cone launcher 135. One or more sealing members 160*a* and 160*b* are coupled to the exterior of the upper portion of the expandable tubular member 155. In several alternative embodiments, the sealing members 160*a* and 160*b* may include elastomeric elements and/or metallic elements and/or composite elements. In several alternative embodiments, one or more anchoring elements may substituted for, or used in addition to, the sealing members 160*a* and 160*b*.

In a preferred embodiment, the support member 105, the expansion cone 115, the expansion cone launcher 135, the shoe 140, and the expandable tubular member 155 are provided substantially as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference.

As illustrated in FIG. 1*b*, in a preferred embodiment, during placement of the apparatus 100 within the wellbore 10, fluidic materials 165 within the wellbore 10 are conveyed through the apparatus 100 through the passages 110, 120 and 145 to a location above the apparatus 100. In this manner, surge pressures during placement of the apparatus 100 within the wellbore 10 are reduced. In a preferred embodiment, the apparatus 100 is initially positioned within the wellbore 10 such that the top portion of the tubular member 155 overlaps with the preexisting casing 15. In this manner, the upper portion of the expandable tubular member 155 may be radially expanded into contact with and coupled to the preexisting casing 15. As will be recognized by persons having ordinary skill in the art, the precise initial position of the expandable tubular member 155 will vary as a function of the amount of radial expansion, the amount of axial shrinkage during radial expansion, and the material properties of the expandable tubular member.

Figure 1C:
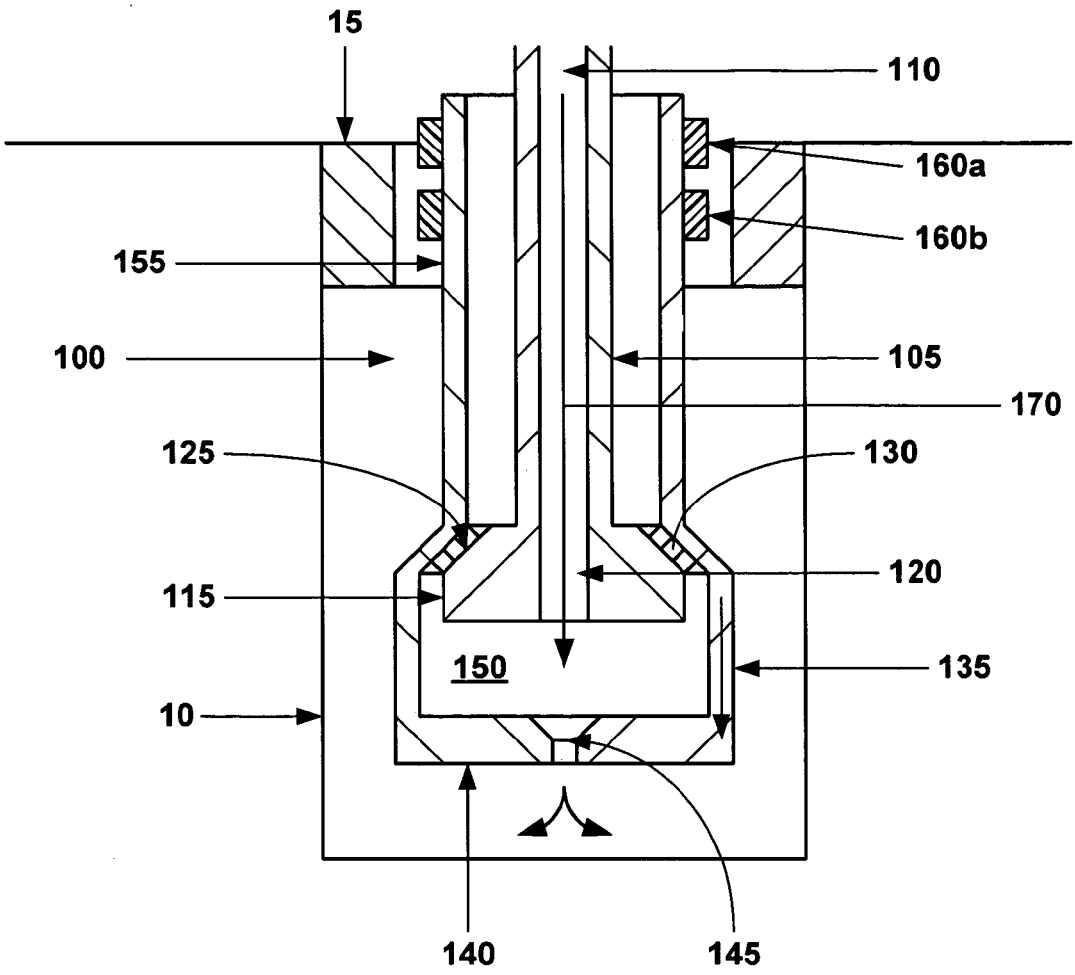
FIG. 1*c* is a cross-sectional illustration of the injection of fluidic materials through the apparatus of FIG. 1*b*.

As illustrated in FIG. 1*c*, a fluidic material 170 may then be injected through the apparatus 100 through the passages 110, 120, and 145 in order to test the proper operation of these passages.

Figure 1D:
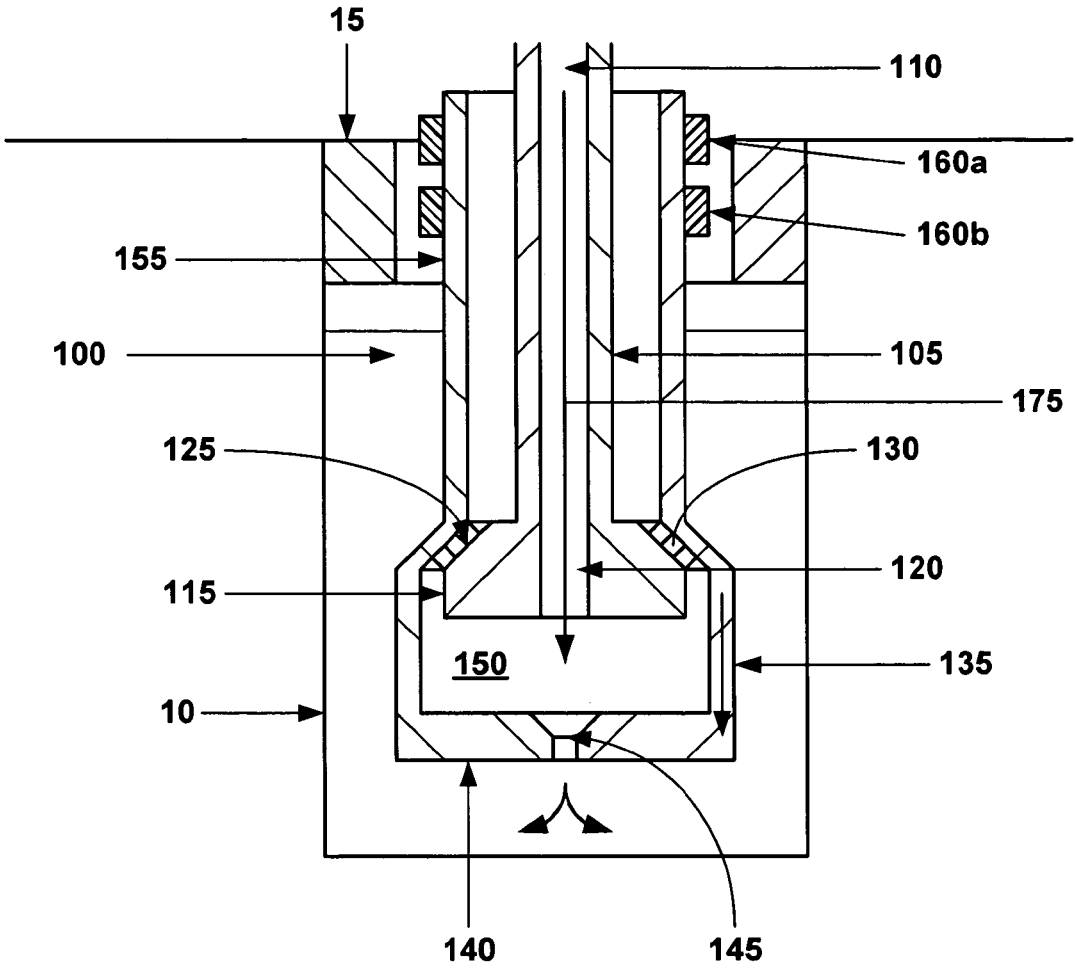
FIG. 1*d* is a cross-sectional illustration of the injection of hardenable fluidic sealing materials through the apparatus of FIG. 1*c*.

As illustrated in FIG. 1*d*, a hardenable fluidic sealing material 175 may then be injected through the apparatus 100 through the passages 110, 120 and 145 into the annulus between the apparatus and the wellbore 10. In this manner, an annular barrier to fluid migration into and out of the wellbore 10 may be formed around the radially expanded expansion cone launcher 135 and expandable tubular member 155. The hardenable fluidic sealing material may include, for example, a cement mixture. In several alternative embodiments, the injection of the hardenable fluidic sealing material 175 may be omitted. In several alternative embodiments, the hardenable fluidic sealing material 175 is compressible, before, during and/or after, the curing process.

Figure 1E:
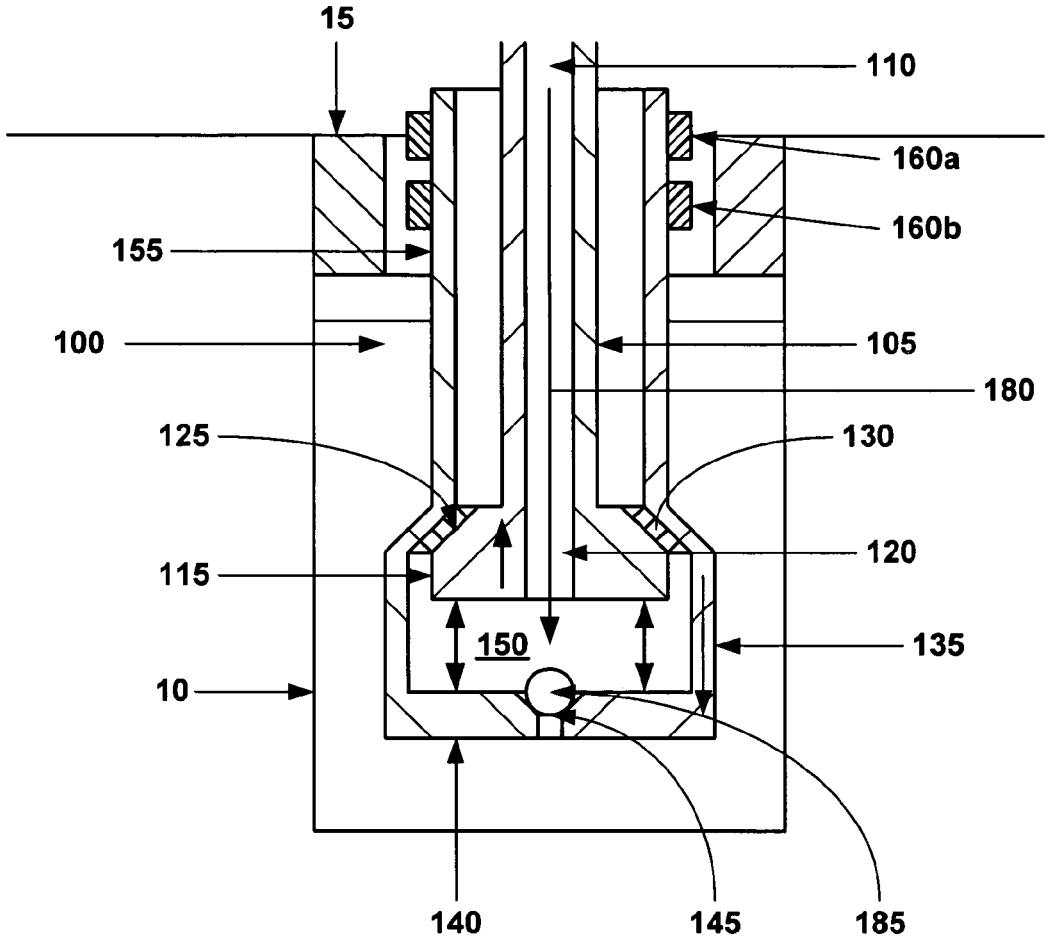
FIG. 1*e* is a cross-sectional illustration of the pressurization of the region below the expansion cone of the apparatus of FIG. 1*d*.

As illustrated in FIG. 1*e*, a non-hardenable fluidic material 180 may then be injected into the apparatus through the passages 110 and 120. A ball plug 185, or other similar device, may then be injected with the fluidic material 180 to thereby seal off the passage 145. In this manner, the region 150 may be pressurized by the continued injection of the fluidic material 180 into the apparatus 100.

Figure 1F:
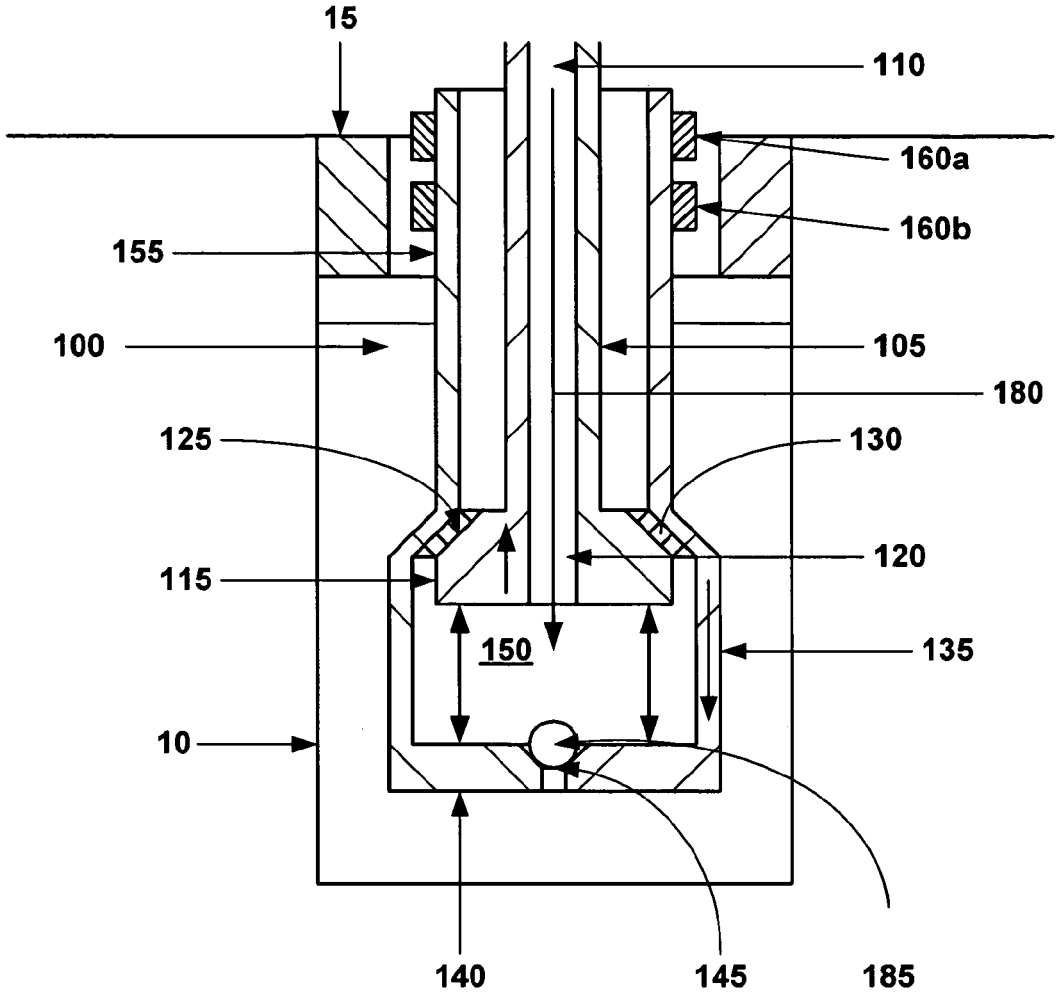
FIG. 1*f* is a cross-sectional illustration of the continued pressurization of the region below the expansion cone of the apparatus of FIG. 1*e*.

As illustrated in FIG. 1*f*, the continued injection of the fluidic material 180 into the apparatus 100 causes the expansion cone launcher 135 and expandable tubular member 155 to be plastically deformed and radially expanded off of the over-expansion sleeve 130. In this manner, the expansion cone 115 and over-expansion sleeve 130 are displaced relative to the expansion cone launcher 135 and expandable tubular member 155 in the axial direction.

After a predetermined time period and/or after a predetermined axial displacement of the expansion cone 115 relative to the expansion cone launcher 135 and expandable tubular member 155, the over-expansion sleeve 130 may be removed from the outer conical surface 125 of the expansion cone 115 by the application of a predetermined upward shock load to the support member 105. In a preferred embodiment, the shock load causes the frangible over-expansion sleeve 130 to fracture into small pieces that are then forced off of the outer conical surface 125 of the expansion cone 115 by the continued pressurization of the region 150. In a preferred embodiment, the pieces of the over-expansion sleeve 130 are pulverized into grains of material by the continued pressurization of the region 150.

Figure 1G:
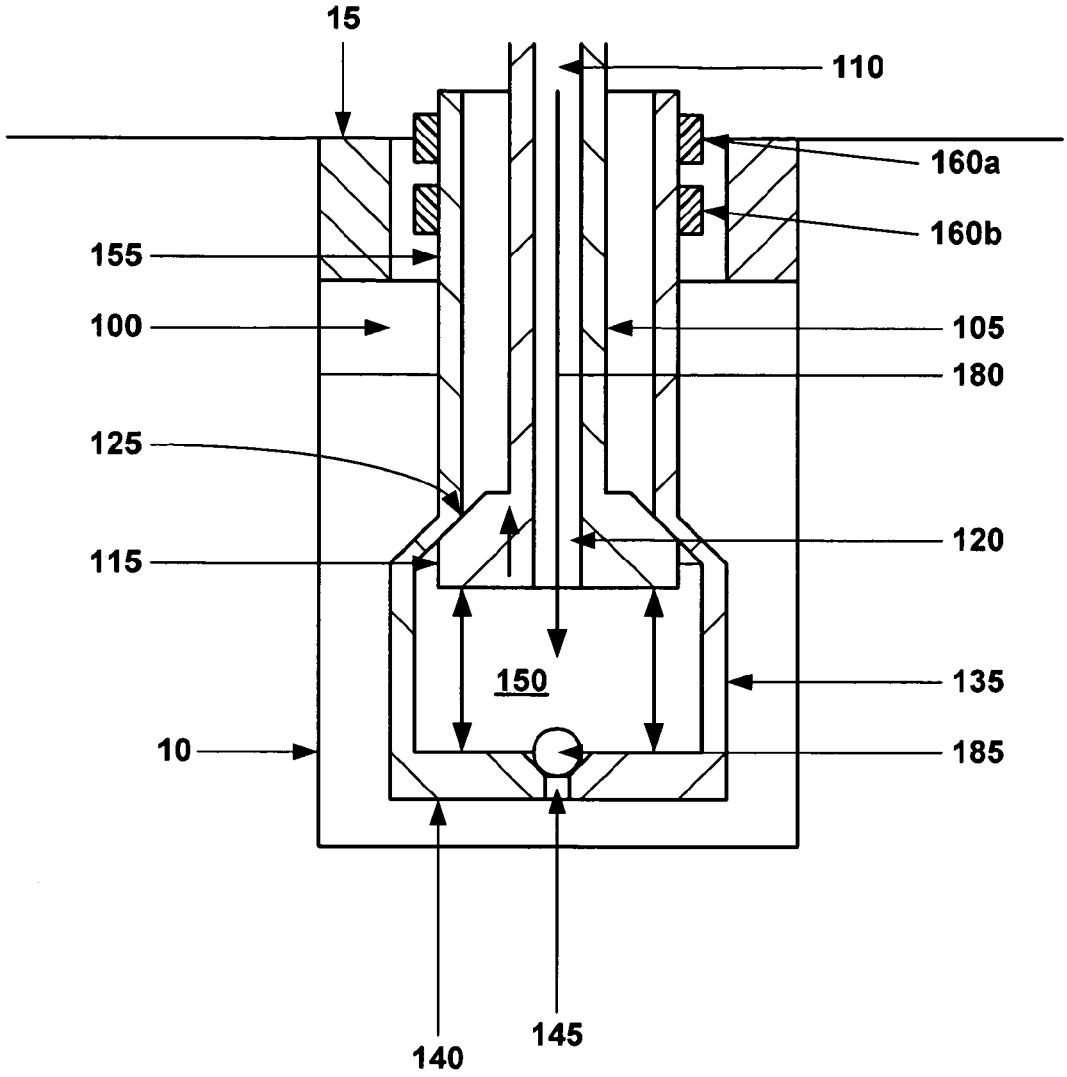
FIG. 1*g* is a cross-sectional illustration of the continued pressurization of the region below the expansion cone of the apparatus of FIG. 1*f* following the removal of the over-expansion sleeve.
Figure 1H:
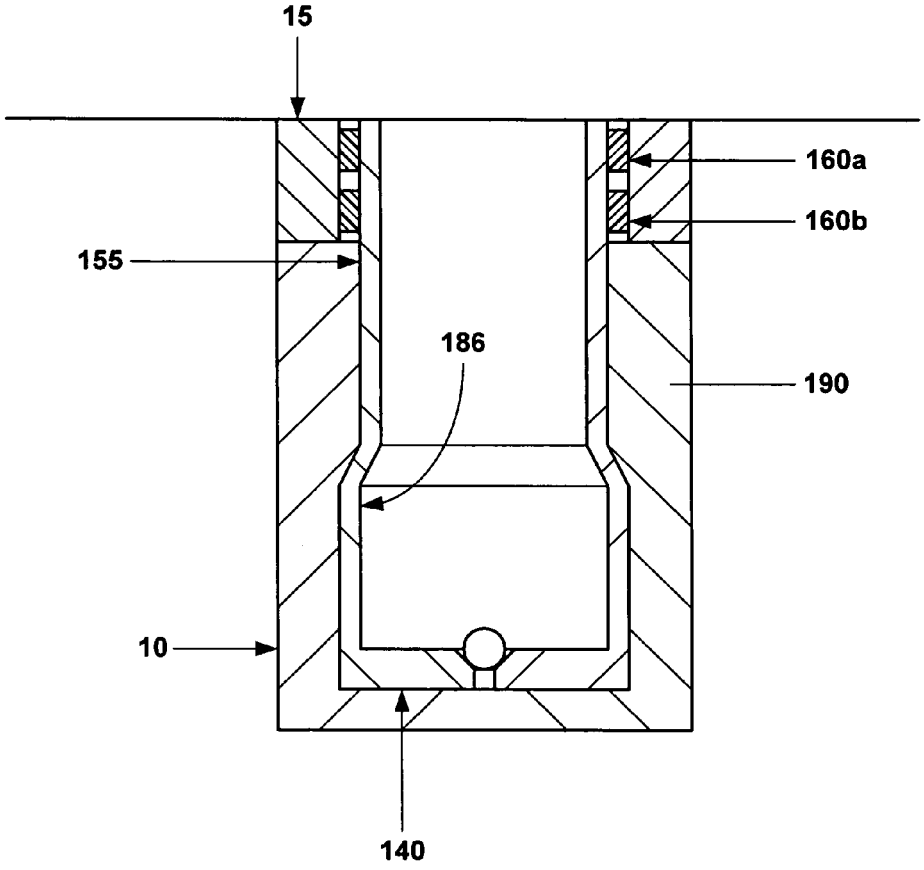
FIG. 1*h* is a cross-sectional illustration of the completion of the radial expansion of the expandable tubular member of the apparatus of FIG. 1*g*.

Referring to FIG. 1*g*, following the removal of the frangible over-expansion sleeve 130, the continued pressurization of the region 150 causes the expandable tubular member 155 to be plastically deformed and radially expanded and extruded off of the outer conical surface 125 of the expansion cone 115. Note that the amount of radial expansion provided by the outer conical surface 125 of expansion cone 115 is less than the amount of radial expansion provided by the combination of the over-expansion sleeve 130 and the expansion cone 115. In this manner, as illustrated in FIG. 1*h*, a recess 186 is formed in the radially expanded tubular member 155.

After completing the plastic deformation and radial expansion of the tubular member 155, the hardenable fluidic sealing material is allowed to cure to thereby form an annular body 190 that provides a barrier to fluid flow into or out of the wellbore 10.

Figure 1I:
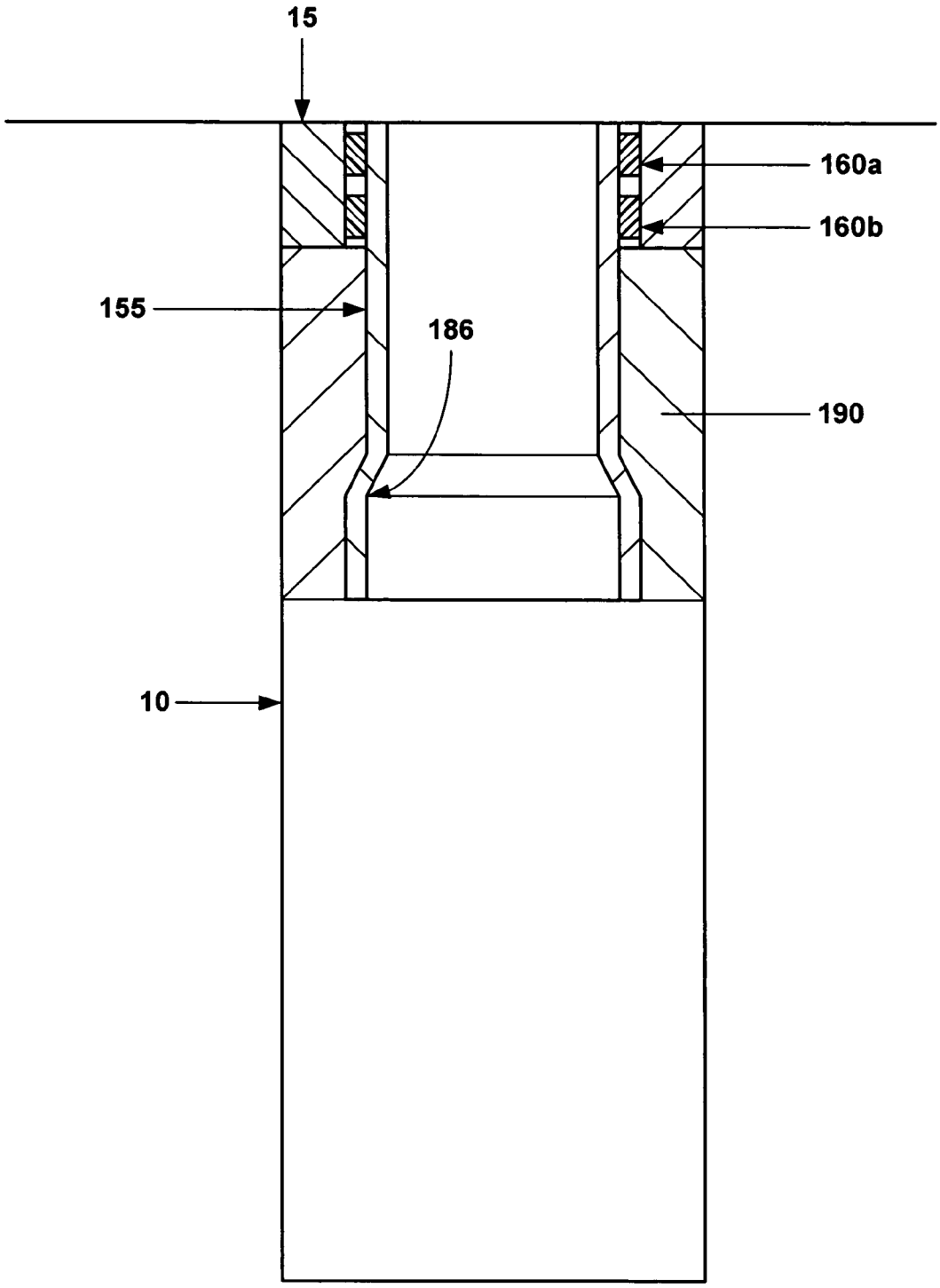
FIG. 1*i* is a cross-sectional illustration of the drilling out of a new section of the wellbore below the apparatus of FIG. 1*h*.

Referring to FIG. 1*i*, the shoe 140 may then removed by drilling out the shoe using a conventional drilling device. A new section of the wellbore 10 may also be drilled out in order to permit additional expandable tubular members to be coupled to the bottom portion of the plastically deformed and radially expanded tubular member 155.

Figure 1J:
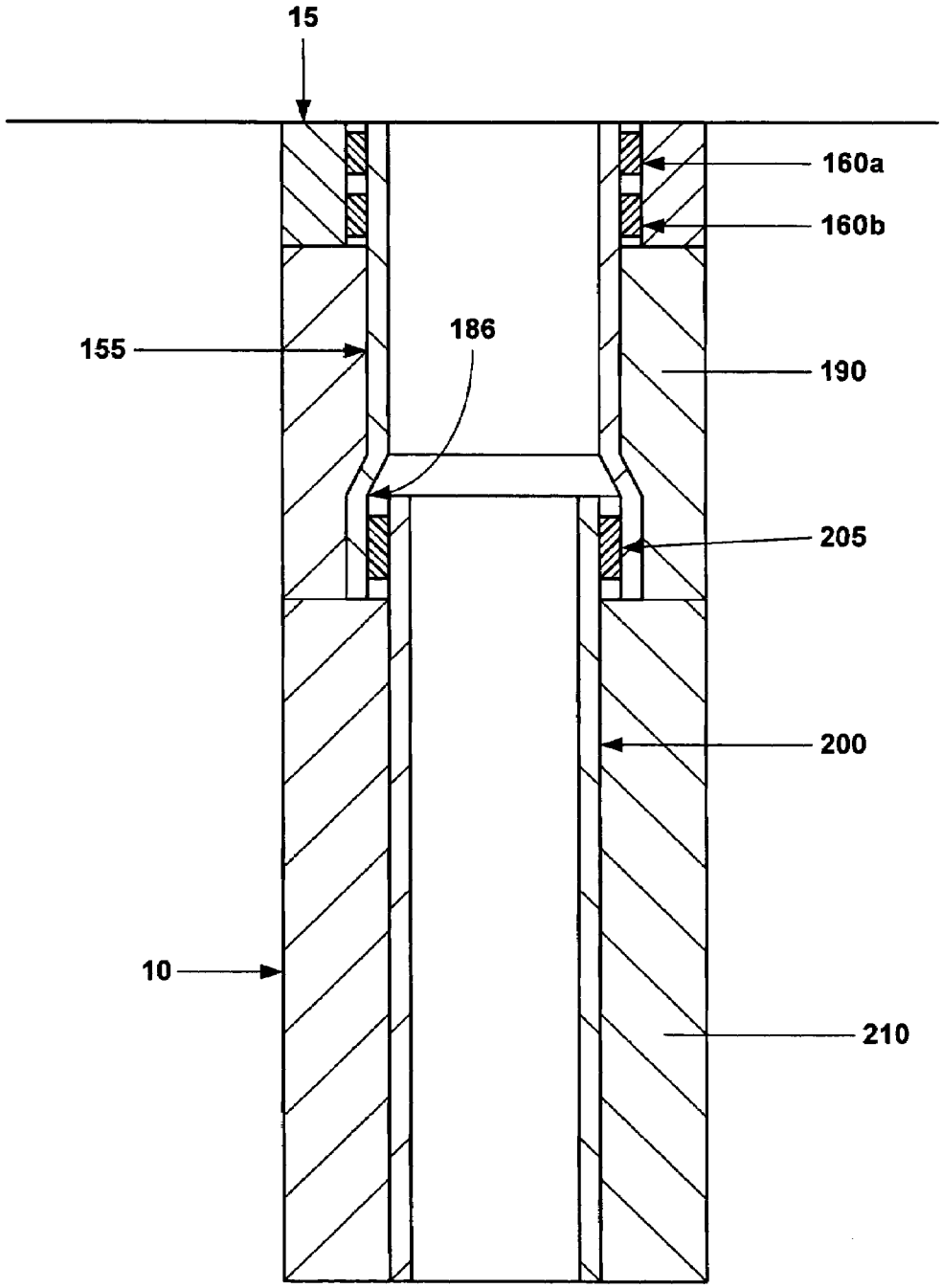
FIG. 1*j* is a cross-sectional illustration of the radial expansion of another expandable tubular member that overlaps with the apparatus of FIG. 1*i*.

Referring to FIG. 1*j*, a tubular member 200 may then be plastically deformed and radially expanded using any number of conventional methods of radially expanding a tubular member. In a preferred embodiment, the upper portion of the radially expanded tubular member 200 overlaps with and mates with the recessed portion 186 of the tubular member 155. In a preferred embodiment, one or more sealing members 205 are coupled to the exterior surface of the upper portion of the tubular member 200. In a preferred embodiment, the sealing members 205 seal the interface between the upper portion of the tubular member 200 and the recessed portion 186 of the tubular member 155. In several alternative embodiments, the sealing members 205 may include elastomeric elements and/or metallic elements and/or composite elements. In several alternative embodiments, one or more anchoring elements may substituted for, or used in addition to, the sealing members 205. In a preferred embodiment, an annular body 210 of a hardenable fluidic sealing material is also formed around the tubular member 200 using one or more conventional methods.

In a preferred embodiment, the tubular member 200 is plastically deformed and radially expanded, and the annular body 210 is formed using one or more of the apparatus and methods disclosed in the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference.

In an alternative embodiment, the annular body 210 may be omitted. In several alternative embodiments, the annular body 210 may be radially compressed before, during and/or after curing.

Figure 1K:
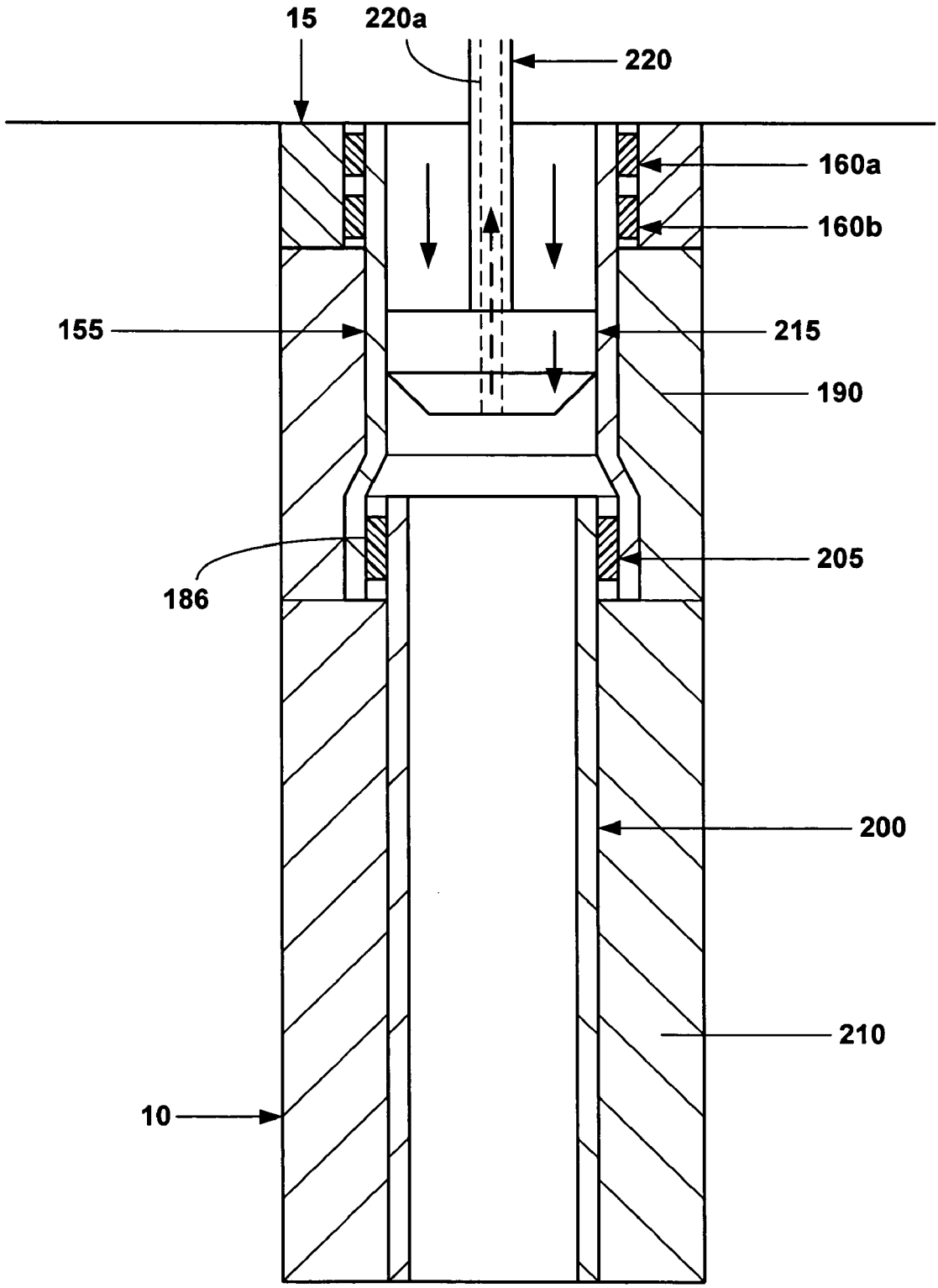
FIG. 1*k* is a cross-sectional illustration of the secondary radial expansion of the other expandable tubular member of the apparatus of FIG. 1*l*.
Figure 1L:
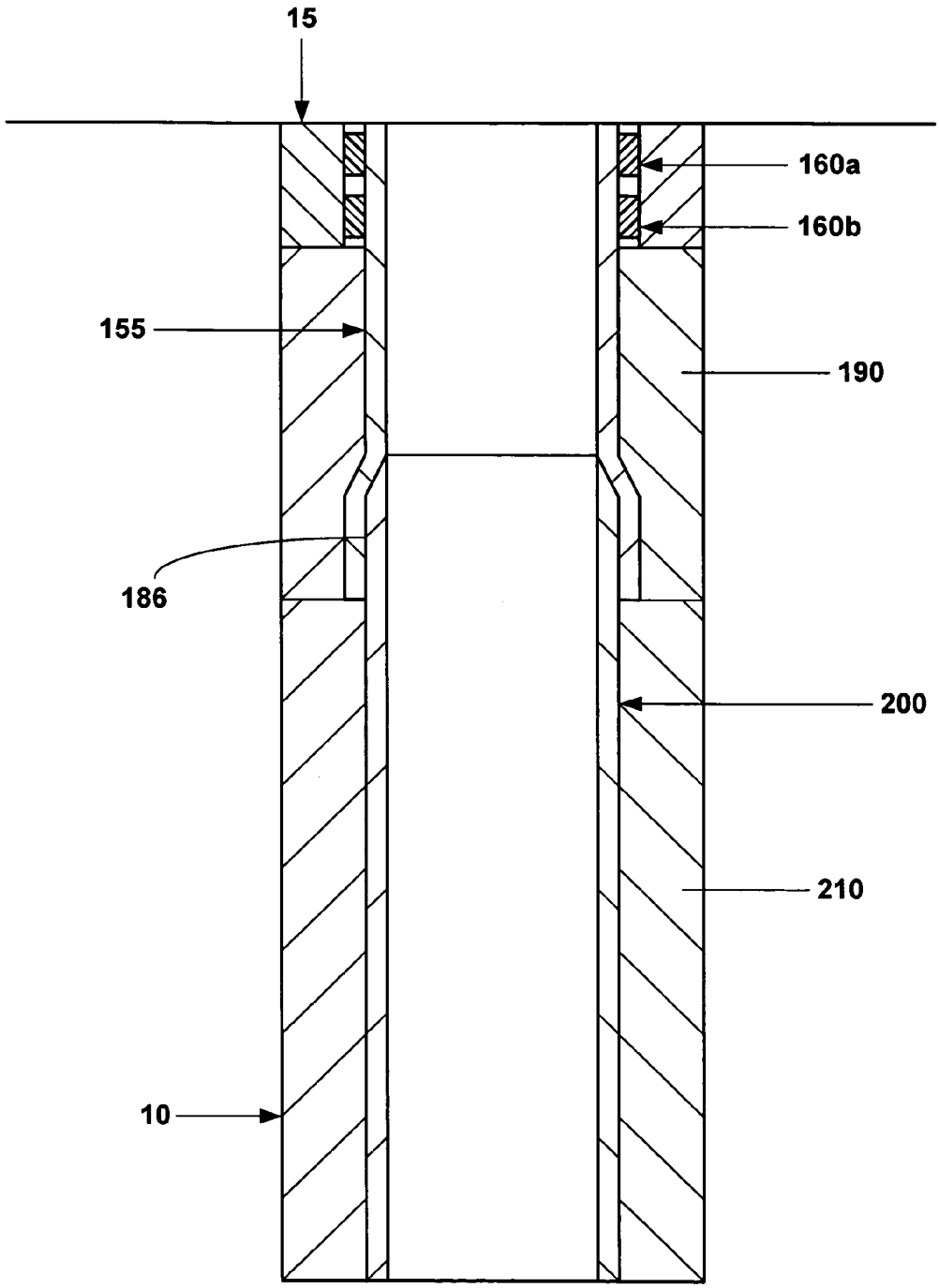
FIG. 1*l* is a cross-sectional illustration of the completion of the secondary radial expansion of the other expandable tubular member of FIG. 1*k* to form a mono-diameter wellbore casing.

Referring to FIG. 1*k*, an expansion cone 215 may then be driven in a downward direction by fluid pressure and/or by a support member 220 to plastically deform and radially expand the tubular member 200 such that the interior diameter of the tubular members 155 and 200 are substantially equal. In this manner, as illustrated in FIG. 1*l*, a mono-diameter wellbore casing may be formed. In a preferred embodiment, during the displacement of the expansion cone 215 in the downward direction, fluidic materials displaced by the expansion cone are conveyed out of the wellbore by an internal passage 220*a* defined within the support member 220.

Figure 2A:
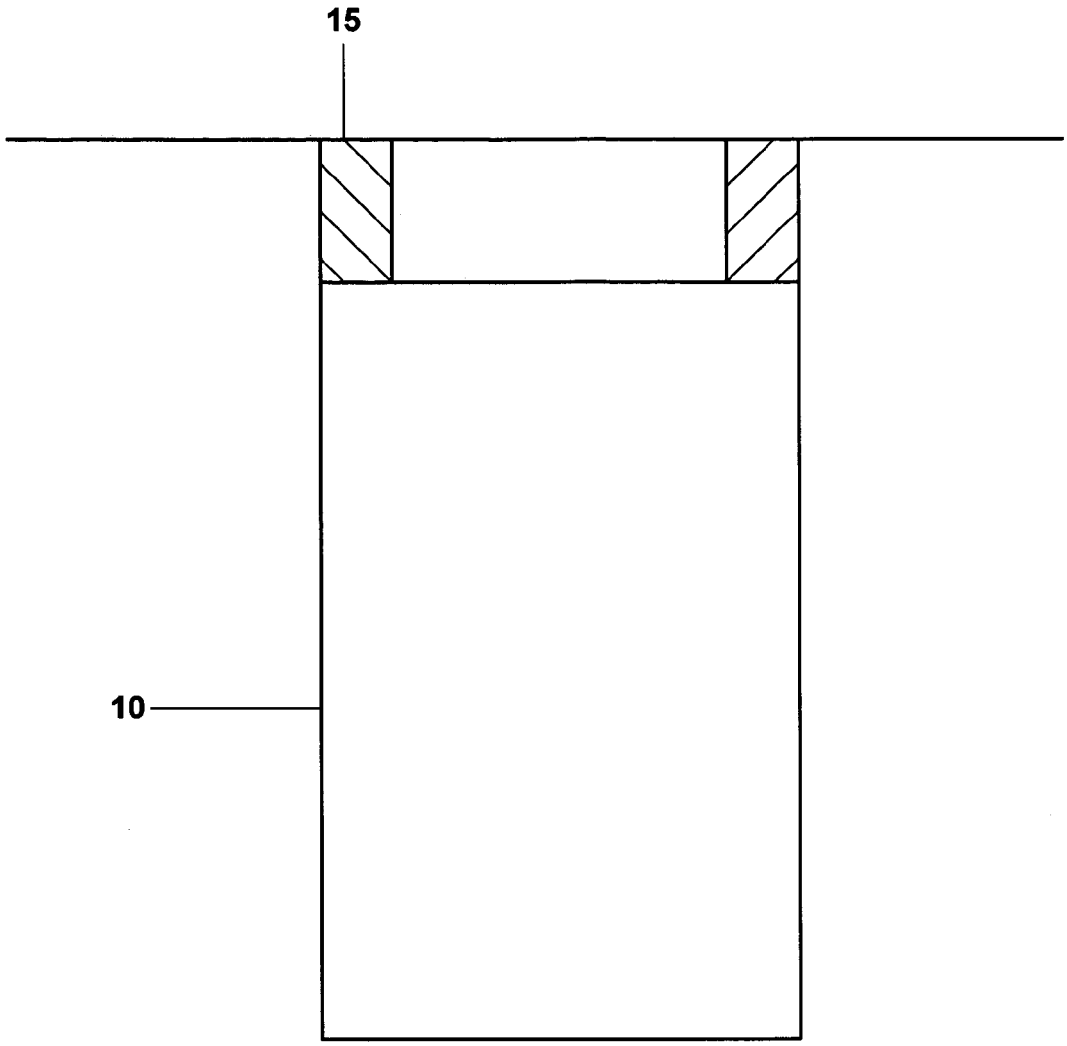
FIG. 2*a* is a cross sectional illustration of a wellbore including a preexisting wellbore casing.
Figure 2B:
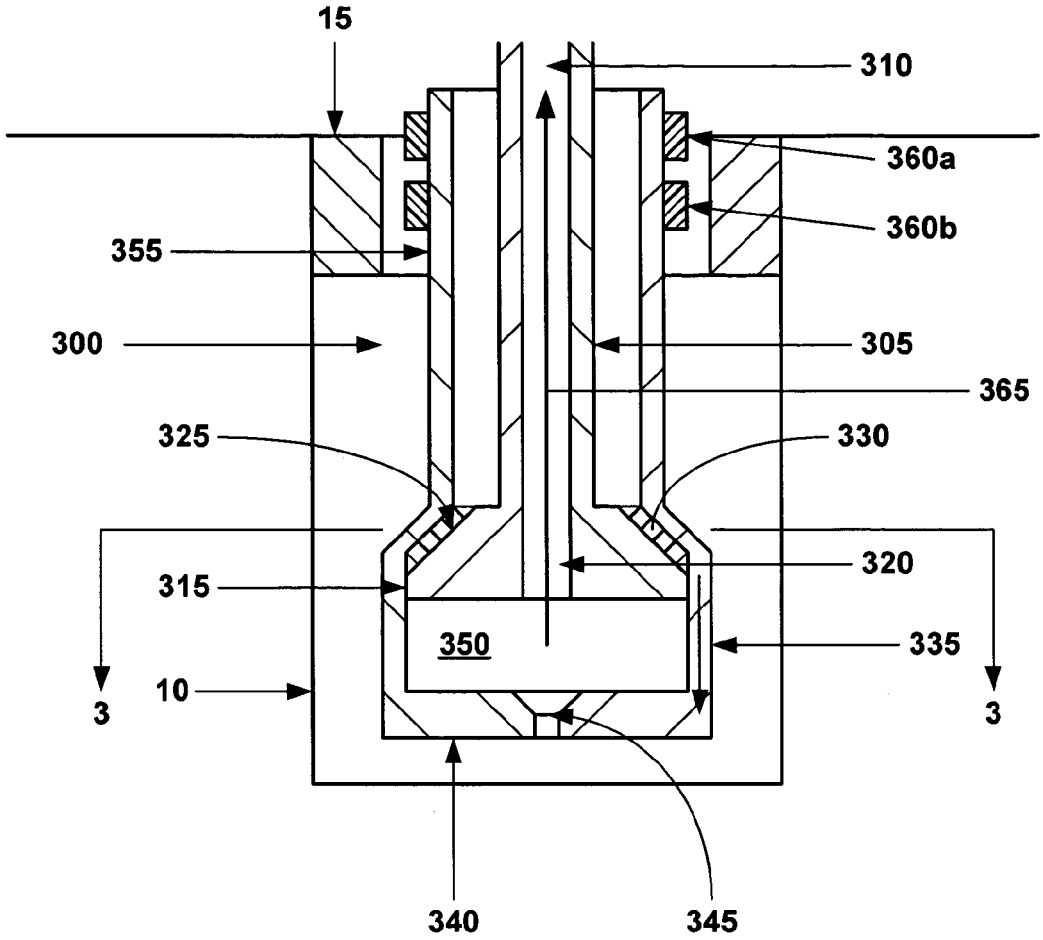
FIG. 2*b* is a cross-sectional illustration of the placement of an embodiment of an apparatus for radially expanding a tubular member into the wellbore of FIG. 2*a*.

Referring to FIGS. 2*a* and 2*b*, in an alternative embodiment, an apparatus 300 for radially expanding a tubular member may then be positioned within the wellbore 10. The apparatus 300 includes a tubular support member 305 defining a passage 310 for conveying fluidic materials. An expansion cone 315 defining a passage 320 and having an outer conical surface 325 for radially expanding tubular members is coupled to an end of the tubular support member 305. An annular conical over-expansion insert 330 mates with and is removably coupled to the outer conical surface 325 of the expansion cone 315.

An expansion cone launcher 335 is movably coupled to and supported by the expansion cone 315 and the over-expansion insert 330. The expansion cone launcher 335 includes an upper portion having an upper outer diameter, an intermediate portion that mates with the expansion cone 315 and the over-expansion insert 330, an a lower portion having a lower outer diameter. The lower outer diameter is greater than the upper outer diameter. A shoe 340 defining a valveable passage 345 is coupled to the lower portion of the expansion cone launcher 335. In a preferred embodiment, the valveable passage 345 may be controllably closed in order to fluidicly isolate a region 350 below the expansion cone 315 and bounded by the lower portion of the expansion cone launcher 335 and the shoe 340 from the region outside of the apparatus 300.

Figure 3:
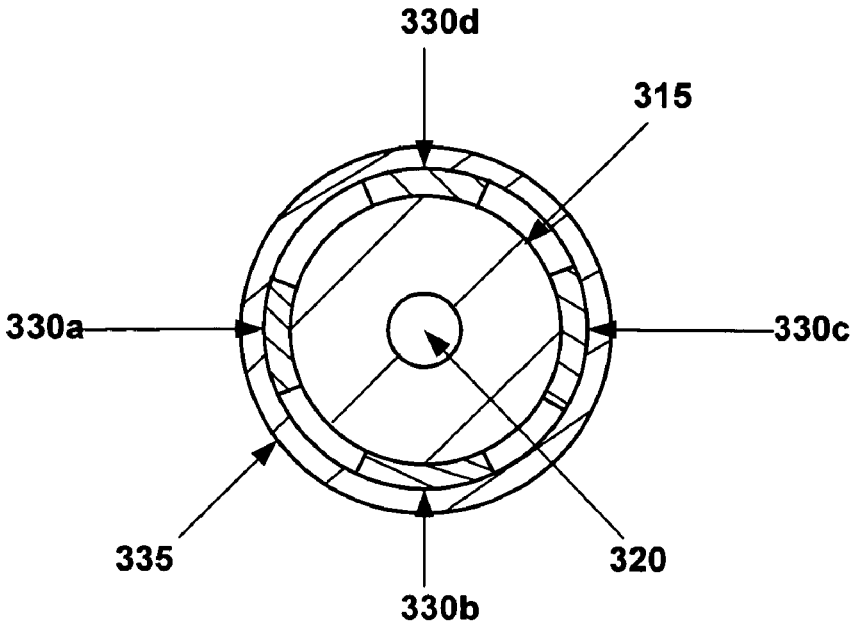
FIG. 3 is a cross-sectional illustration of the apparatus of FIG. 2*b* illustrating the design and construction of the over-expansion insert.

In a preferred embodiment, as illustrated in FIG. 3, the over-expansion insert 330 includes a plurality of spaced-apart arcuate inserts 330*a*, 330*b*, 330*c* and 330*d* that are positioned between the outer conical surface 325 of the expansion cone 315 and the inner surface of the intermediate portion of the expansion cone launcher 335. In this manner, the relative axial displacement of the expansion cone 315 and the expansion cone launcher 335 will cause the expansion cone to over-expand the intermediate portion of the expansion cone launcher. In this manner, a recess may be formed in the radially expanded expansion cone launcher 335. In several alternative embodiments, the inserts 330*a*, 330*b*, 330*c*, and 330*d* fall out of the recess and/or are removed from the recess using a conventional retrieval tool upon the completion of the radial expansion process.

Figure 3A:
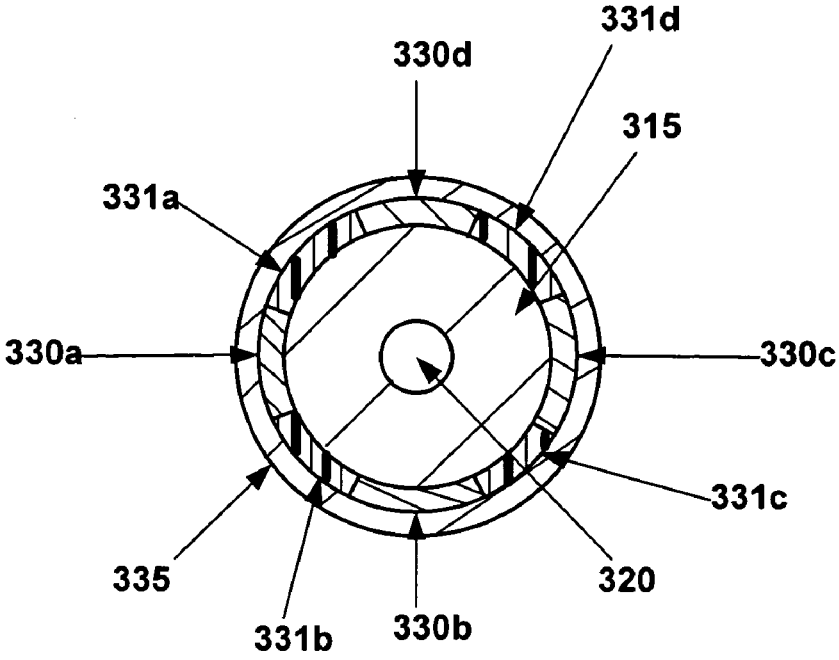
FIG. 3*a* is a cross-sectional illustration of an alternative embodiment of the over-expansion insert of FIG. 3.

In an alternative embodiment, as illustrated in FIG. 3*a*, the over expansion insert 330 further includes intermediate resilient members 331*a*, 331*b*, 331*c*, and 331*d* for resiliently coupling the inserts 330*a*, 330*b*, 330*c*, and 330*d*. In this manner, upon the completion of the radial expansion process, the resilient force exerted by the resilient members 331 causes the over-expansion insert to collapse in the radial direction and thereby fall out of the recess.

An expandable tubular member 355 is coupled to the upper portion of the expansion cone launcher 335. One or more sealing members 360*a* and 360*b* are coupled to the exterior of the upper portion of the expandable tubular member 355. In several alternative embodiments, the sealing members 360*a* and 360*b* may include elastomeric elements and/or metallic elements and/or composite elements. In several alternative embodiments, one or more anchoring elements may substituted for, or used in addition to, the sealing members 360*a* and 360*b*.

In a preferred embodiment, the support member 305, the expansion cone 315, the expansion cone launcher 335, the shoe 340, and the expandable tubular member 355 are provided substantially as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No.

60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference.

As illustrated in FIG. 2*b*, in a preferred embodiment, during placement of the apparatus 300 within the wellbore 10, fluidic materials 365 within the wellbore 10 are conveyed through the apparatus 300 through the passages 310, 320 and 345 to a location above the apparatus 300. In this manner, surge pressures during placement of the apparatus 300 within the wellbore 10 are reduced. In a preferred embodiment, the apparatus 300 is initially positioned within the wellbore 10 such that the top portion of the tubular member 355 overlaps with the preexisting casing 15. In this manner, the upper portion of the expandable tubular member 355 may be radially expanded into contact with and coupled to the preexisting casing 15. As will be recognized by persons having ordinary skill in the art, the precise initial position of the expandable tubular member 355 will vary as a function of the amount of radial expansion, the amount of axial shrinkage during radial expansion, and the material properties of the expandable tubular member.

Figure 2C:
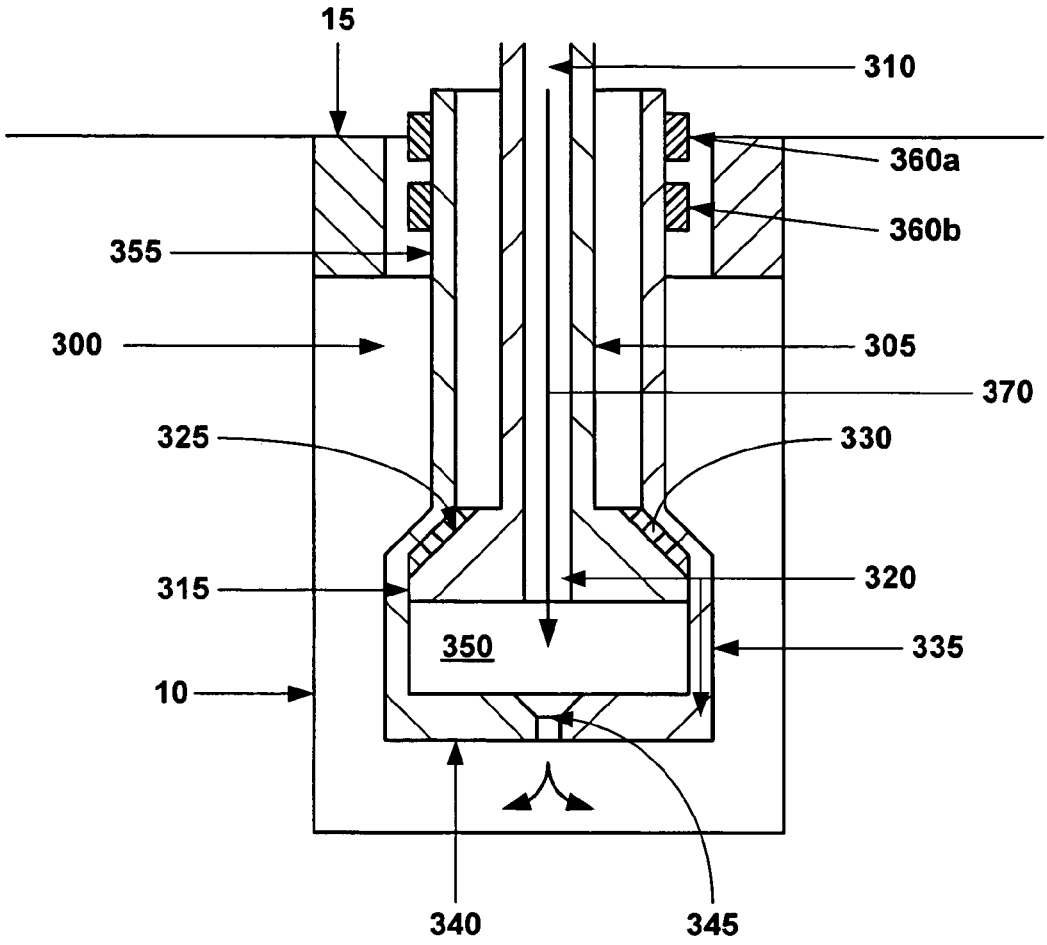
FIG. 2*c* is a cross-sectional illustration of the injection of fluidic materials through the apparatus of FIG. 2*b*.

As illustrated in FIG. 2*c*, a fluidic material 370 may then be injected through the apparatus 300 through the passages 310, 320, and 345 in order to test the proper operation of these passages.

Figure 2D:
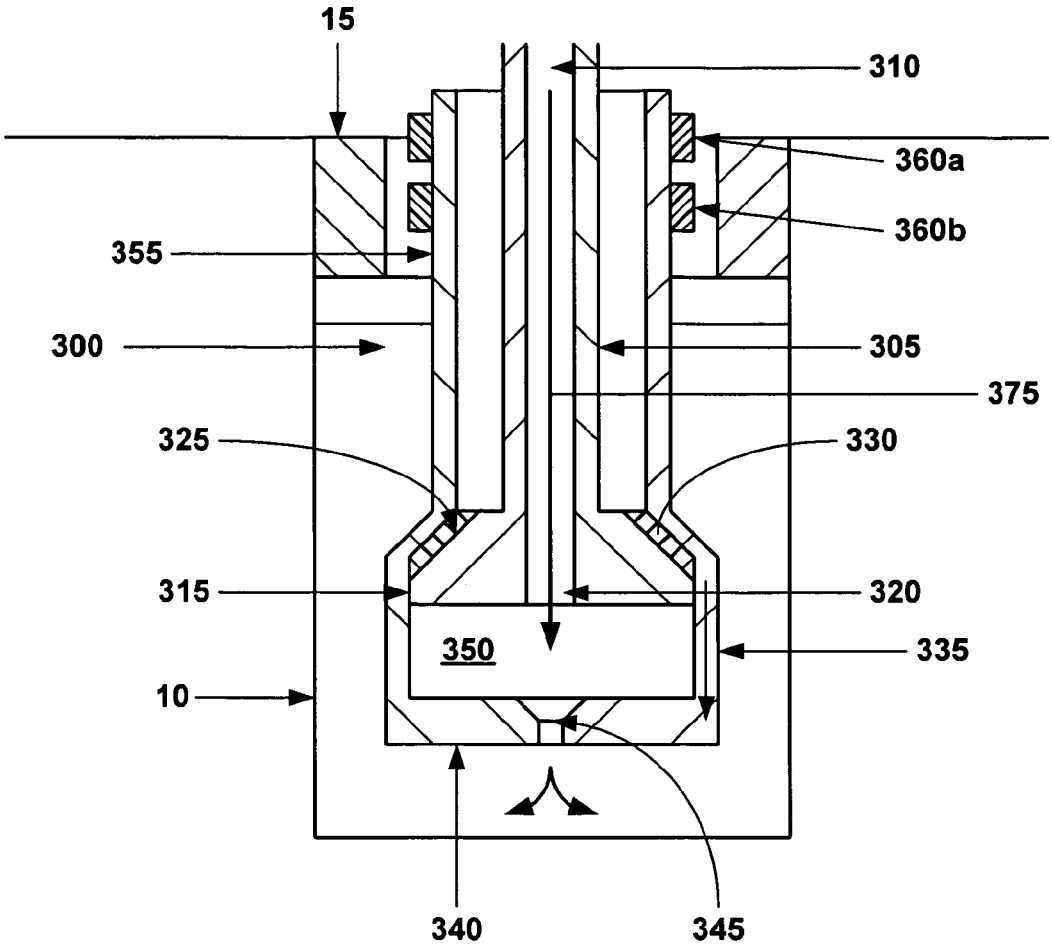
FIG. 2*d* is a cross-sectional illustration of the injection of hardenable fluidic sealing materials through the apparatus of FIG. 2*c*.

As illustrated in FIG. 2*d*, a hardenable fluidic sealing material 375 may then be injected through the apparatus 300 through the passages 310, 320 and 345 into the annulus between the apparatus and the wellbore 10. In this manner, an annular barrier to fluid migration into and out of the wellbore 10 may be formed around the radially expanded expansion cone launcher 335 and expandable tubular member 355. The hardenable fluidic sealing material may include, for example, a cement mixture. In several alternative embodiments, the injection of the hardenable fluidic sealing material 375 may be omitted. In several alternative embodiments, the hardenable fluidic sealing material 375 is compressible, before, during and/or after, the curing process.

Figure 2E:
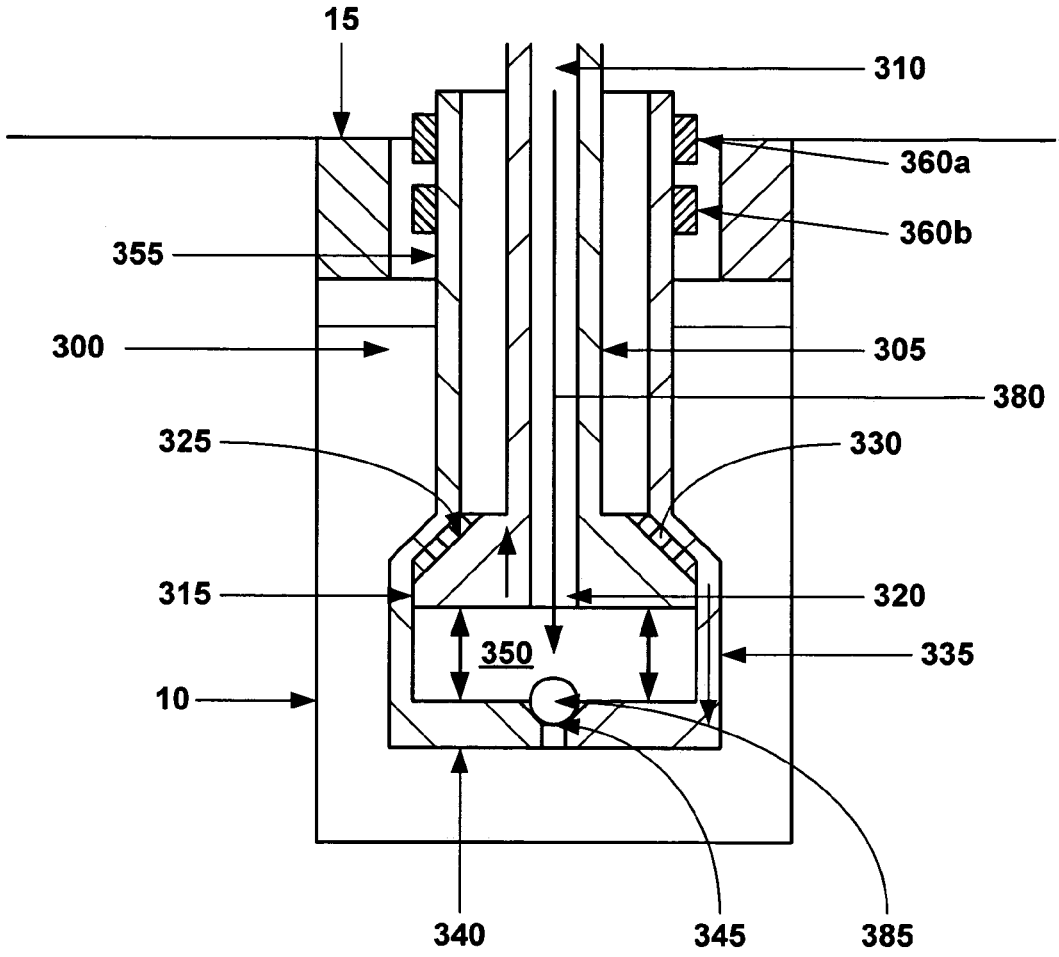
FIG. 2*e* is a cross-sectional illustration of the pressurization of the region below the expansion cone of the apparatus of FIG. 2*d*.

As illustrated in FIG. 2*e*, a non-hardenable fluidic material 380 may then be injected into the apparatus through the passages 310 and 320. A ball plug 385, or other similar device, may then be injected with the fluidic material 380 to thereby seal off the passage 345. In this manner, the region 350 may be pressurized by the continued injection of the fluidic material 380 into the apparatus 300.

Figure 2F:
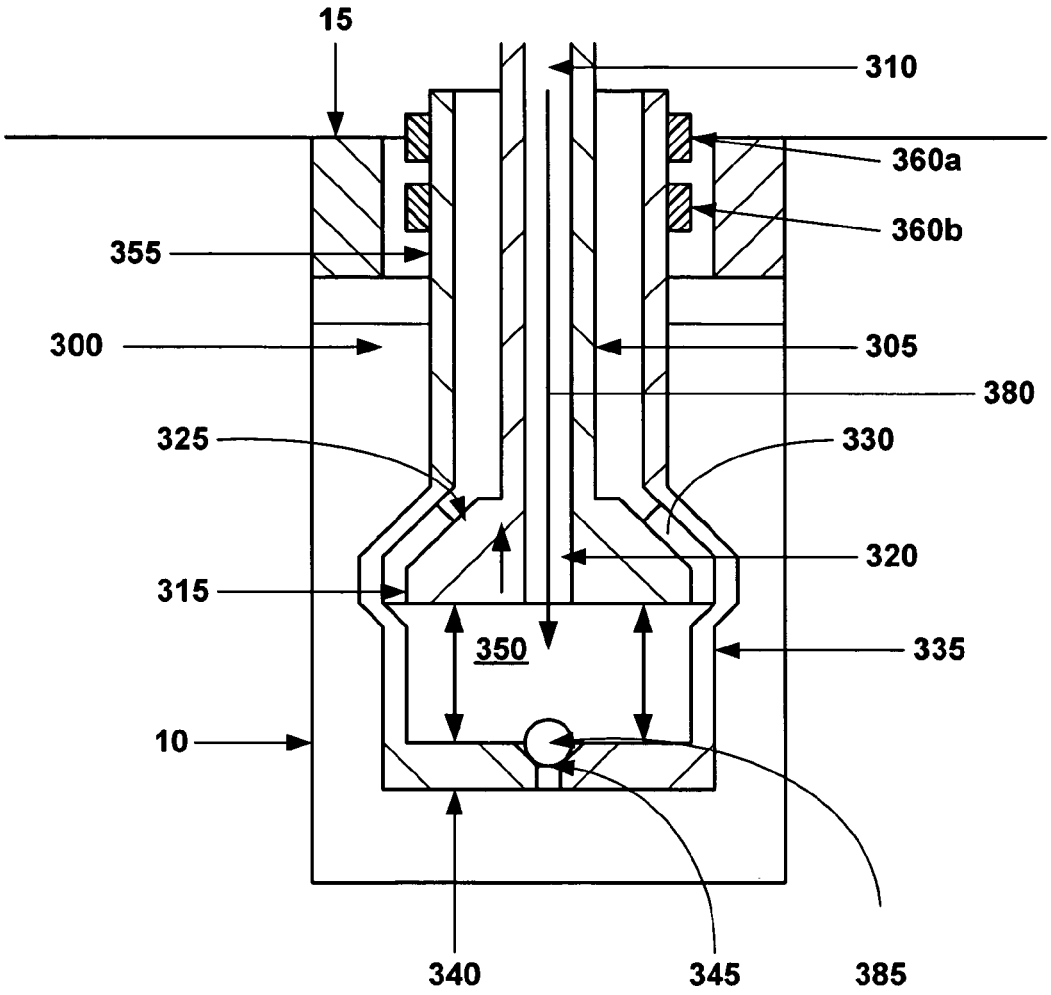
FIG. 2*f* is a cross-sectional illustration of the continued pressurization of the region below the expansion cone of the apparatus of FIG. 2*e*.

As illustrated in FIG. 2*f*, the continued injection of the fluidic material 380 into the apparatus 300 causes the expansion cone launcher 335 to be plastically deformed and radially expanded off of the over-expansion insert 330. In this manner, the expansion cone 315 is displaced relative to the expansion cone launcher 335 and expandable tubular member 355 in the axial direction.

Figure 2G:
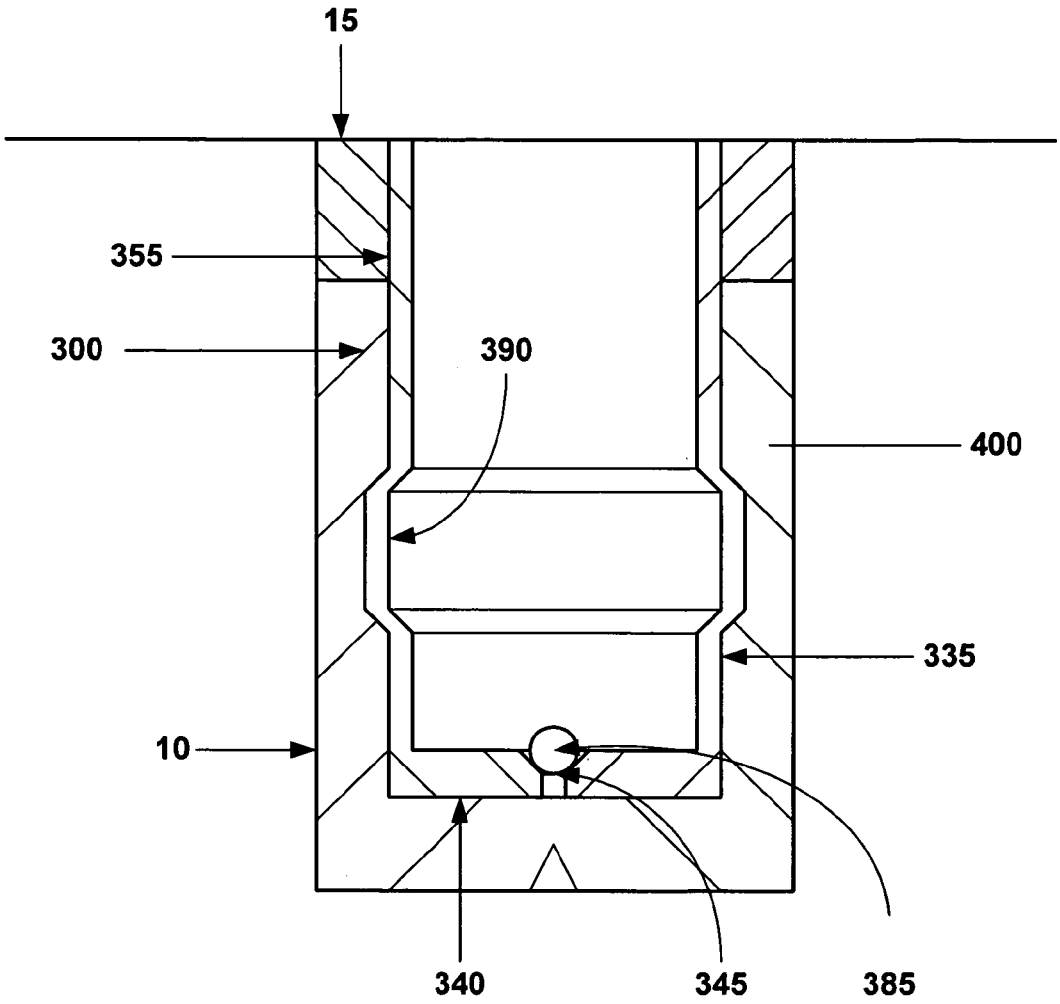
FIG. 2*g* is a cross-sectional illustration of the completion of the radial expansion of the expandable tubular member of the apparatus of FIG. 2*f*.

Once the radial expansion process has progressed beyond the over-expansion insert 330, the radial expansion of the expansion cone launcher 335 and expandable tubular member 355 is provided solely by the outer conical surface 325 of the expansion cone 315. Note that the amount of radial expansion provided by the outer conical surface 325 of expansion cone 315 is less than the amount of radial expansion provided by the combination of the over-expansion insert 330 and the expansion cone 315. In this manner, as illustrated in FIG. 2*g*, a recess 390 is formed in the radially expanded tubular member 355.

Figure 4:
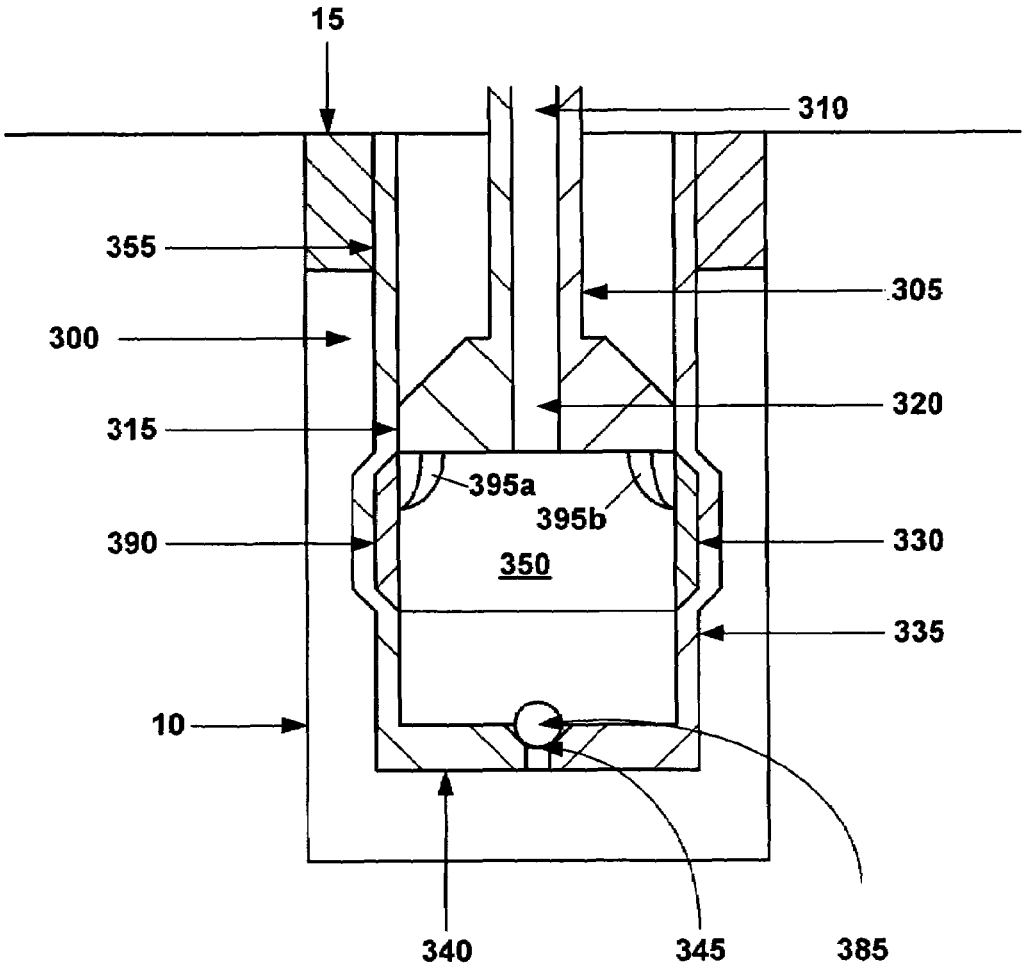
FIG. 4 is a cross-sectional illustration of an alternative embodiment of the apparatus of FIG. 2*b* including a resilient hook for retrieving the over-expansion insert.

In several alternative embodiments, the over-expansion insert 330 is removed from the recess 390 by falling out and/or removal using a conventional retrieval tool. In an alternative embodiment, the resilient force provided by the resilient members 331*a*, 331*b*, 331*c*, and 331*d* cause the insert 330 to collapse in the radial direction and thereby fall out of the recess 390. In an alternative embodiment, as illustrated in FIG. 4, one or more resilient hooks 395*a* and 395*b* are coupled to the bottom of the expansion cone 315 for retrieving the over-expansion insert 330 during or after the completion of the radial expansion process.

After completing the plastic deformation and radial expansion of the tubular member 355, the hardenable fluidic sealing material is allowed to cure to thereby form an annular body 400 that provides a barrier to fluid flow into or out of the wellbore 10.

Figure 2H:
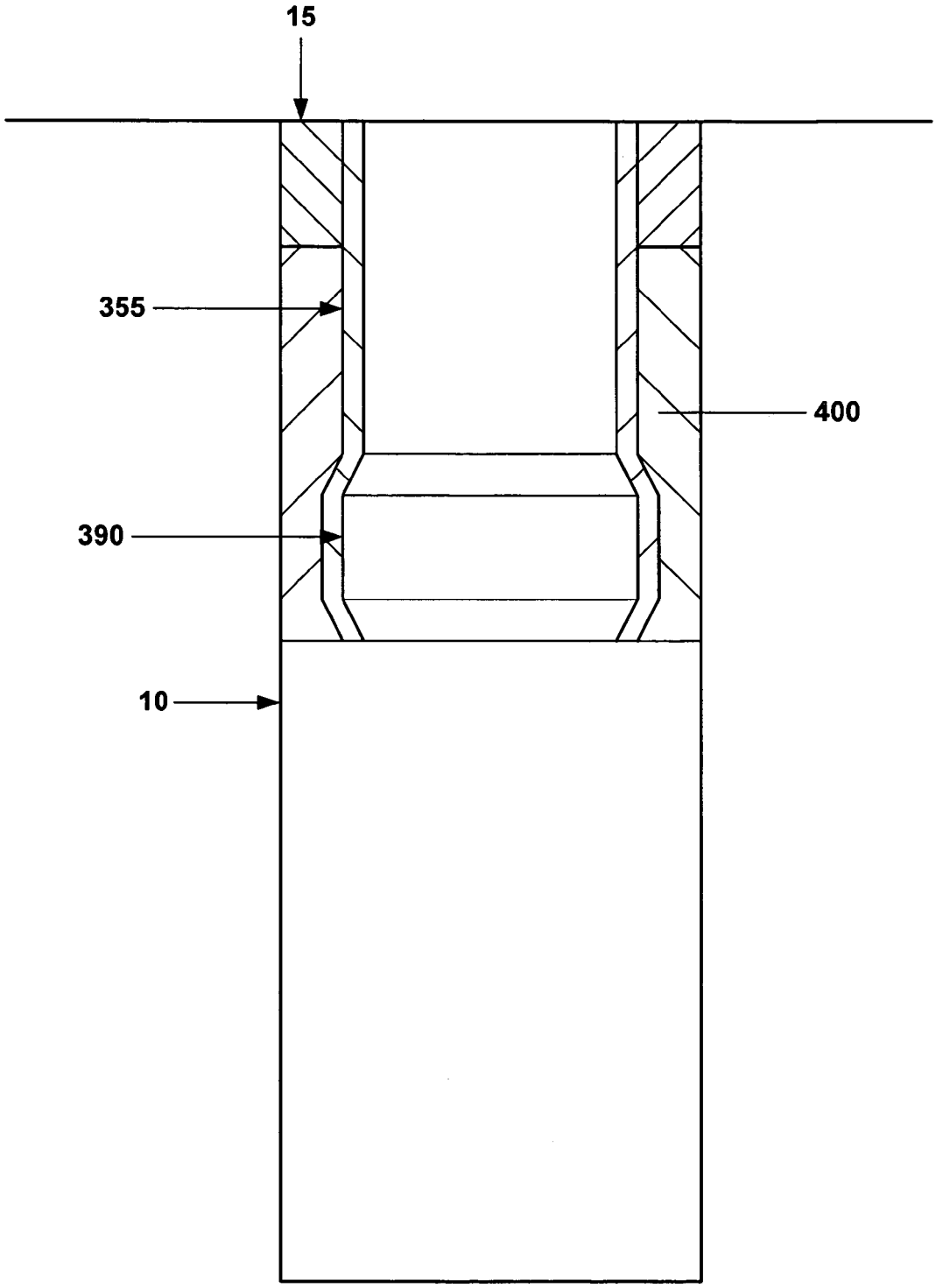
FIG. 2*h* is a cross-sectional illustration of the drilling out of a new section of the wellbore below the apparatus of FIG. 2*g*.

Referring to FIG. 2*h*, the shoe 340 may then removed by drilling out the shoe using a conventional drilling device. A new section of the wellbore 10 may also be drilled out in order to permit additional expandable tubular members to be coupled to the bottom portion of the plastically deformed and radially expanded tubular member 355.

Figure 2I:
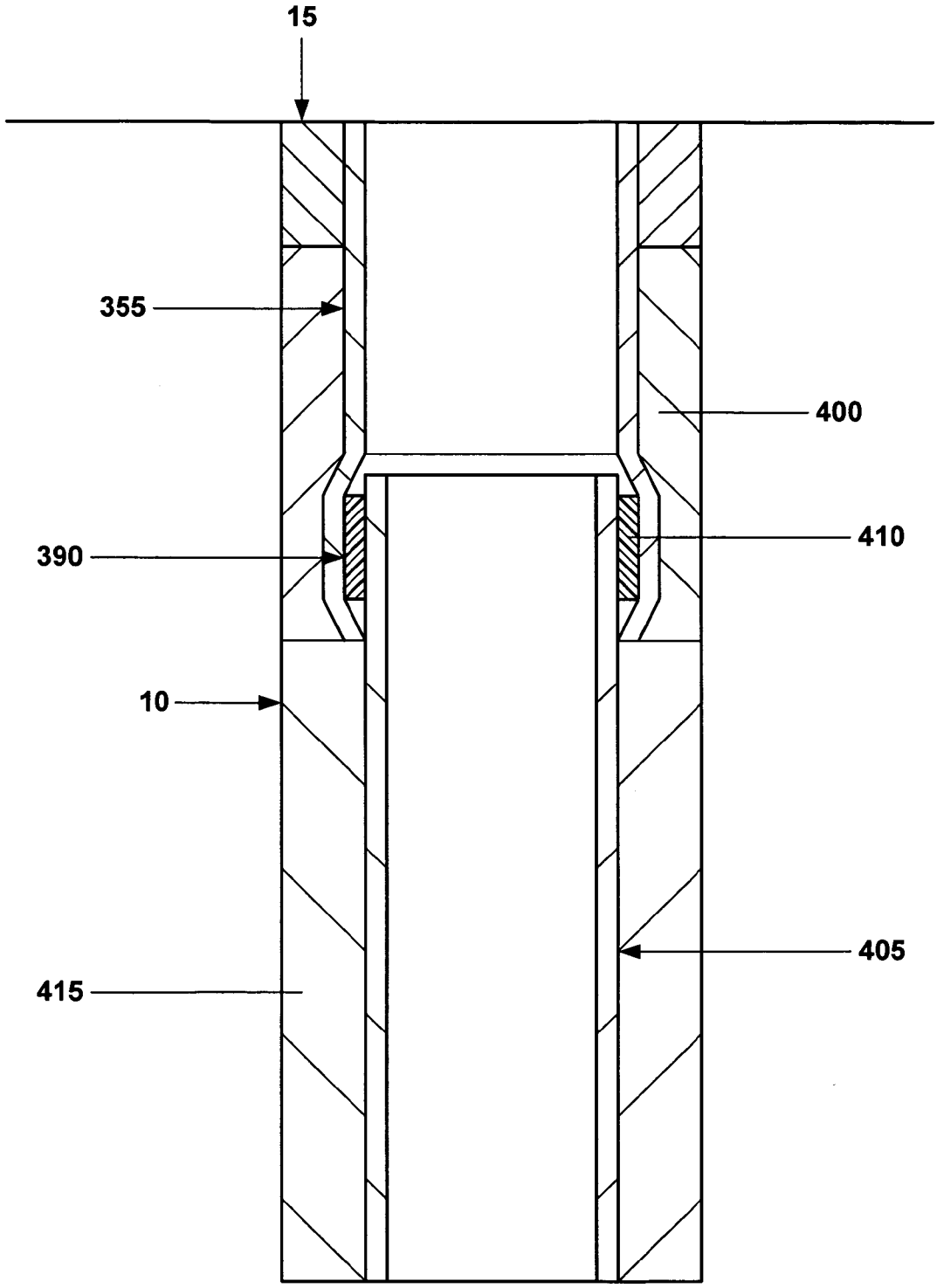
FIG. 2*i* is a cross-sectional illustration of the radial expansion of another expandable tubular member that overlaps with the apparatus of FIG. 2*h*.

Referring to FIG. 2*i*, a tubular member 405 may then be plastically deformed and radially expanded using any number of conventional methods of radially expanding a tubular member. In a preferred embodiment, the upper portion of the radially expanded tubular member 405 overlaps with and mates with the recessed portion 390 of the tubular member 355. In a preferred embodiment, one or more sealing members 410 are coupled to the exterior surface of the upper portion of the tubular member 405. In a preferred embodiment, the sealing members 410 seal the interface between the upper portion of the tubular member 405 and the recessed portion 390 of the tubular member 355. In several alternative embodiments, the sealing members 410 may include elastomeric elements and/or metallic elements and/or composite elements. In several alternative embodiments, one or more anchoring elements may substituted for, or used in addition to, the sealing members 410. In a preferred embodiment, an annular body 415 of a hardenable fluidic sealing material is also formed around the tubular member 405 using one or more conventional methods.

In a preferred embodiment, the tubular member 405 is plastically deformed and radially expanded, and the annular body 415 is formed using one or more of the apparatus and methods disclosed in the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference.

In an alternative embodiment, the annular body 415 may be omitted. In several alternative embodiments, the annular body 415 may be radially compressed before, during and/or after curing.

Figure 2J:
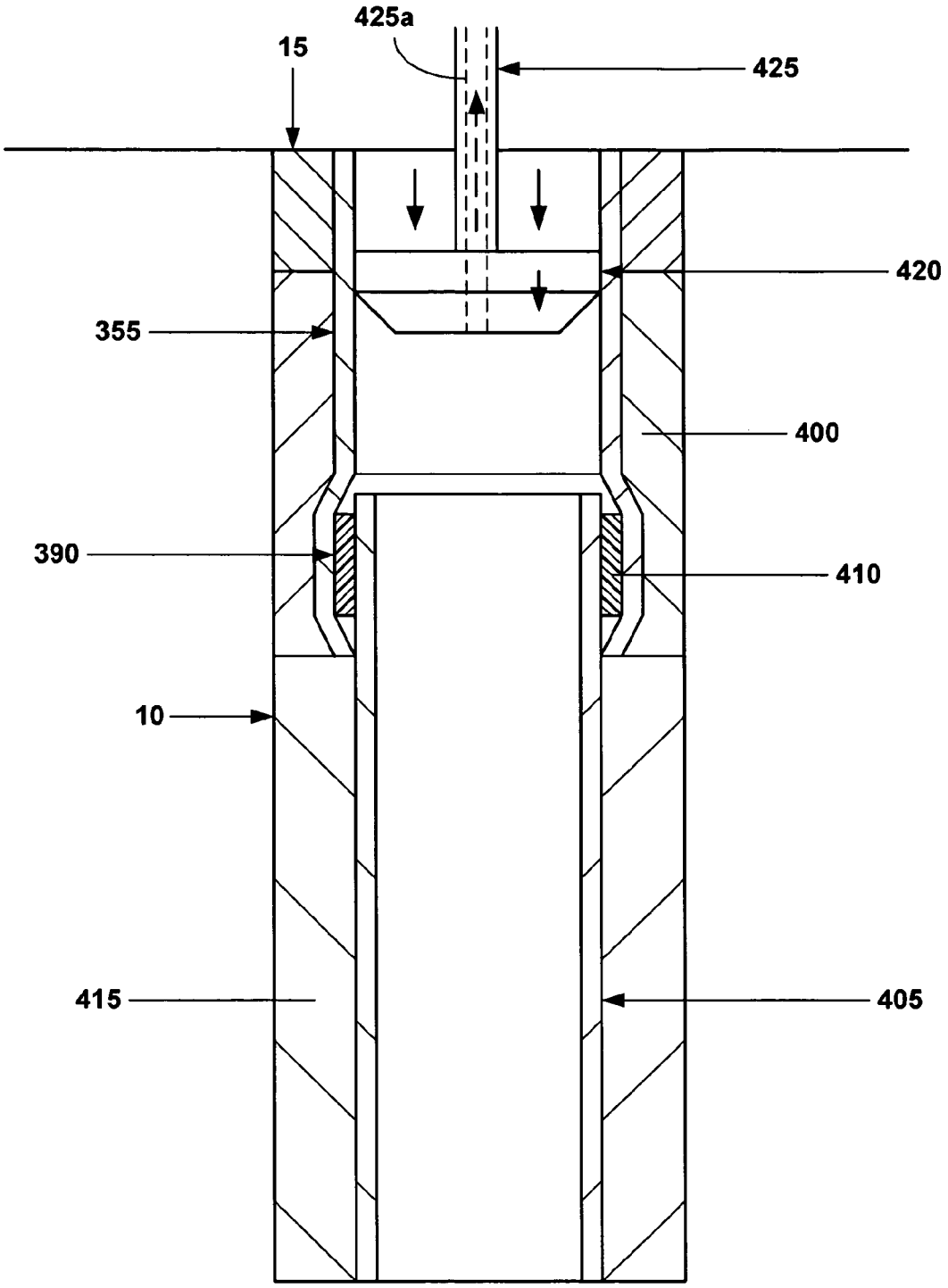
FIG. 2*j* is a cross-sectional illustration of the secondary radial expansion of the other expandable tubular member of the apparatus of FIG. 2*i*.
Figure 2K:
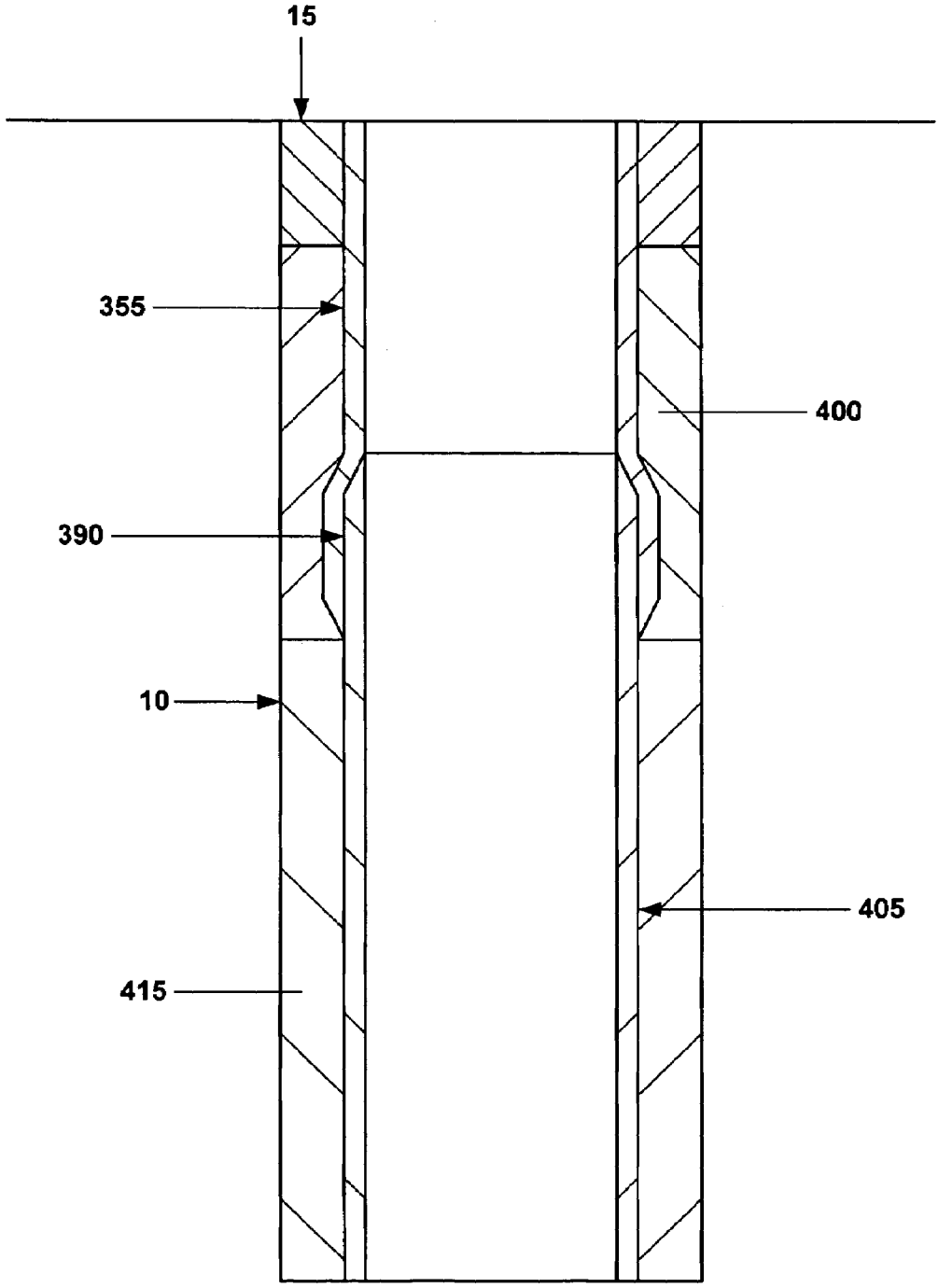
FIG. 2*k* is a cross-sectional illustration of the completion of the secondary radial expansion of the other expandable tubular member of FIG. 2*j* to form a mono-diameter wellbore casing.

Referring to FIG. 2*j*, an expansion cone 420 may then be driven in a downward direction by fluid pressure and/or by a support member 425 to plastically deform and radially expand the tubular member 405 such that the interior diameter of the tubular members 355 and 405 are substantially equal. In this manner, as illustrated in FIG. 2*k*, a mono-diameter wellbore casing may be formed. In a preferred embodiment, during the displacement of the expansion cone 420 in the downward direction, fluidic materials displaced by the expansion cone are conveyed out of the wellbore by an internal passage 425*a* defined within the support member 425.

Figure 5A:
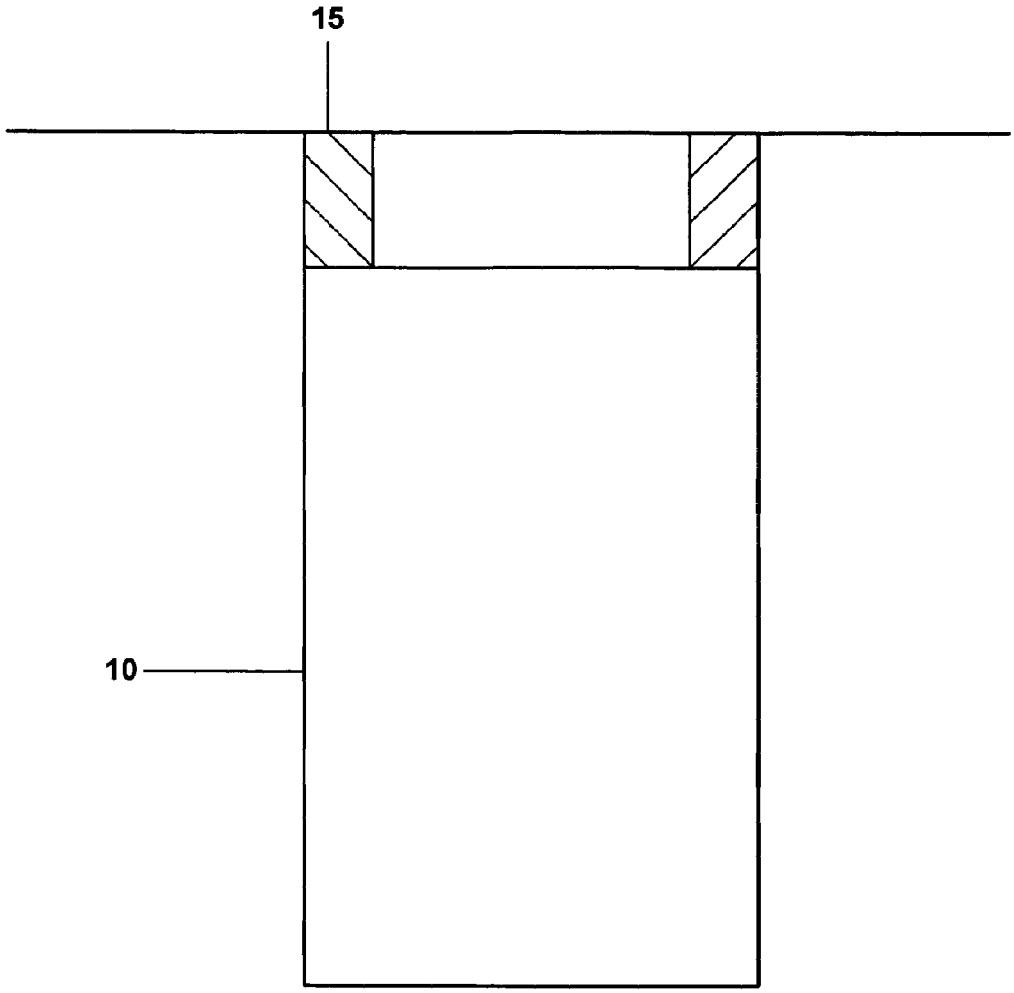
FIG. 5*a* is a cross-sectional illustration of a wellbore including a preexisting wellbore casing.
Figure 5B:
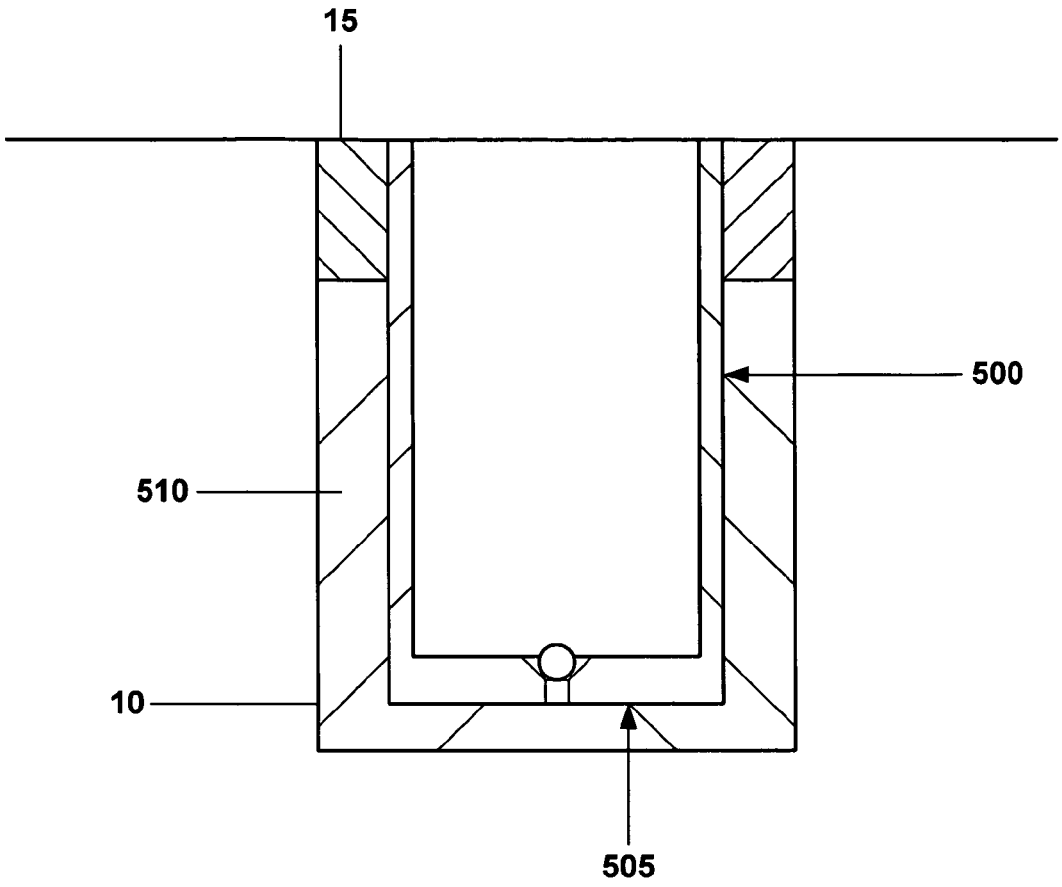
FIG. 5*b* is a cross-sectional illustration of the formation of a new section of wellbore casing in the wellbore of FIG. 5*a*.

Referring to FIGS. 5*a*–5*b*, in an alternative embodiment, a tubular member 500 having a shoe 505 may be plastically deformed and radially expanded and thereby coupled to the preexisting section of wellbore casing 15 using any number of conventional methods. An annular body of a fluidic sealing material 510 may also be formed around the tubular member 500 using any number of conventional methods. In a preferred embodiment, the tubular member 500 is plastically deformed and radially expanded and the annular body 510 is formed using one or more of the methods and apparatus disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference.

In several alternative embodiments, the annular body 510 may be omitted or may be compressible before, during, or after curing.

Figure 5C:
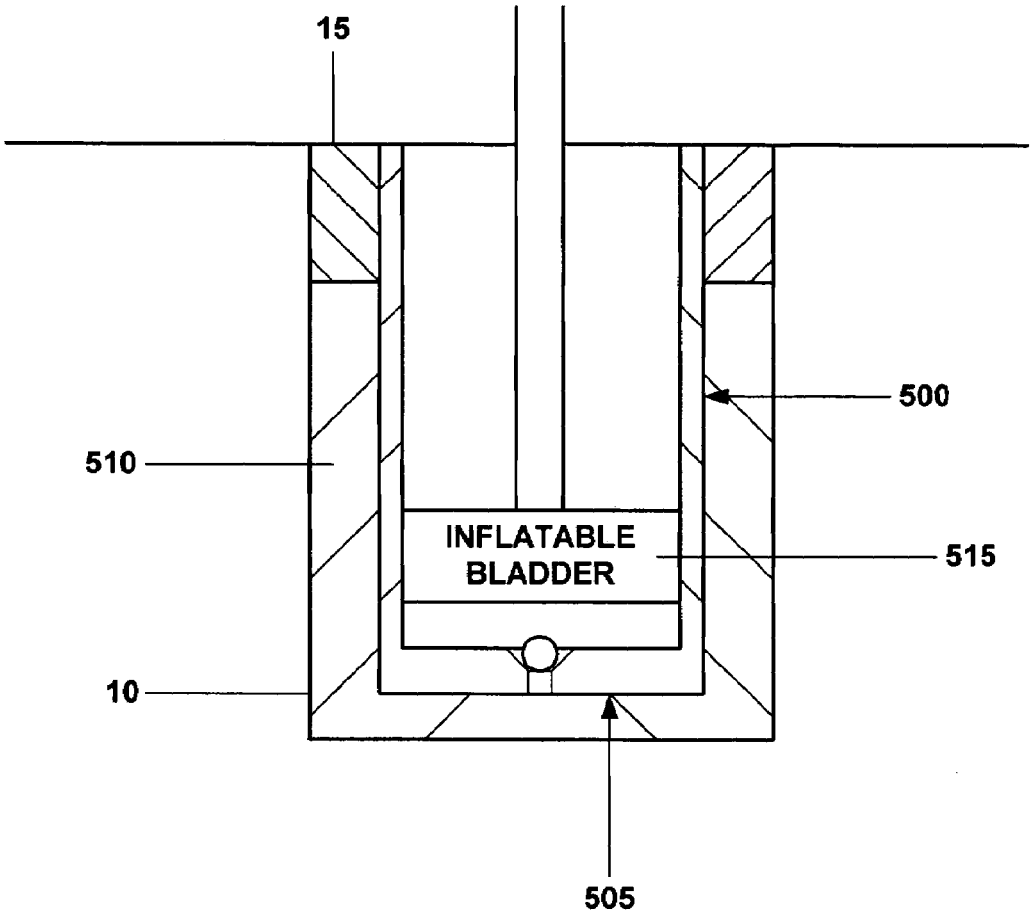
FIG. 5*c* is a fragmentary cross-sectional illustration of the placement of an inflatable bladder into the new section of the wellbore casing of FIG. 5*b*.
Figure 5D:
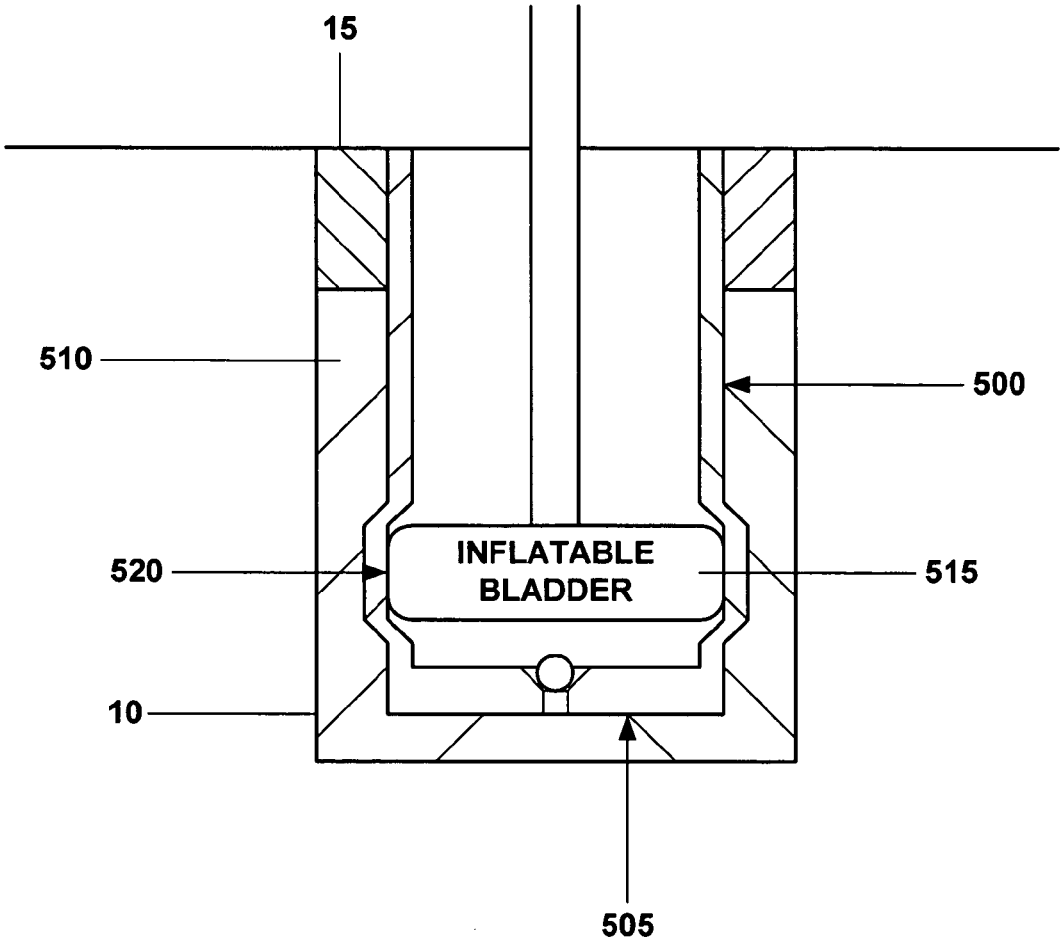
FIG. 5*d* is a fragmentary cross-sectional illustration of the inflation of the inflatable bladder of FIG. 5*c*.

Referring to FIGS. 5*c* and 5*d*, a conventional inflatable bladder 515 may then be positioned within the tubular member 500 and inflated to a sufficient operating pressure to plastically deform and radially expand a portion of the tubular member to thereby form a recess 520 in the tubular member.

Figure 5E:
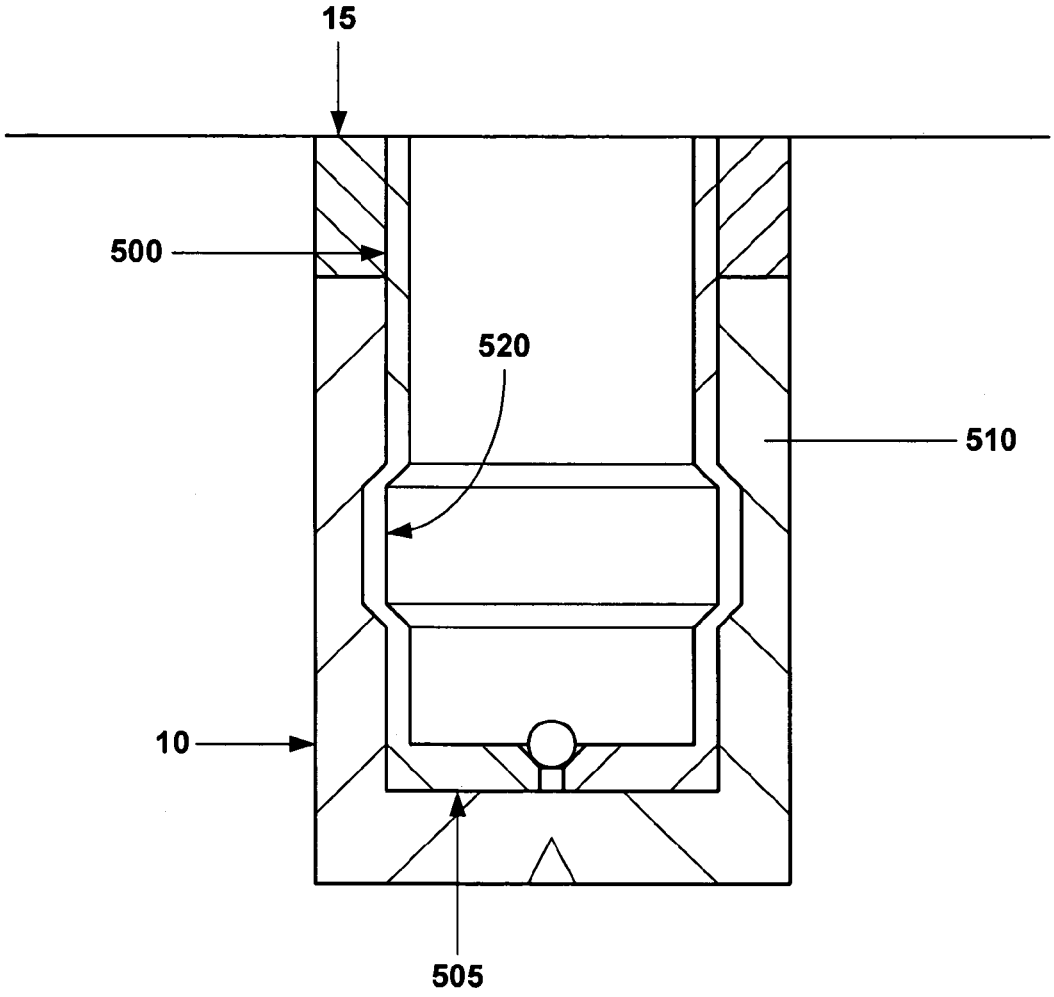
FIG. 5*e* is a cross-sectional illustration of the new section of wellbore casing of FIG. 5*d* after over-expansion.
Figure 5F:
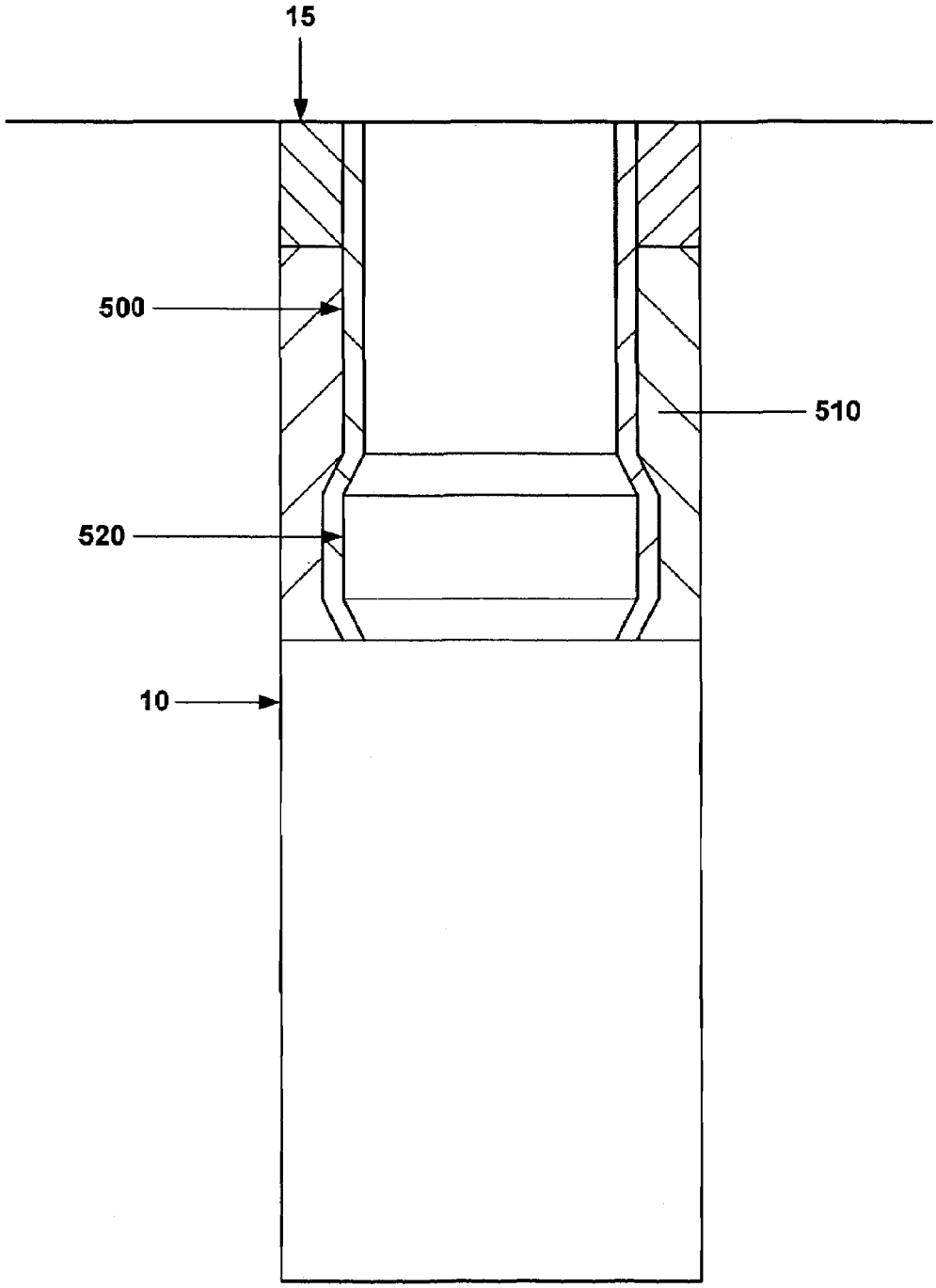
FIG. 5*f* is a cross-sectional illustration of the new section of wellbore casing of FIG. 5*e* after drilling out a new section of the wellbore.

Referring to FIGS. 5*e* and 5*f*, the inflatable bladder 515 may then be removed and the shoe 505 drilled out using a conventional drilling device.

Figure 5G:
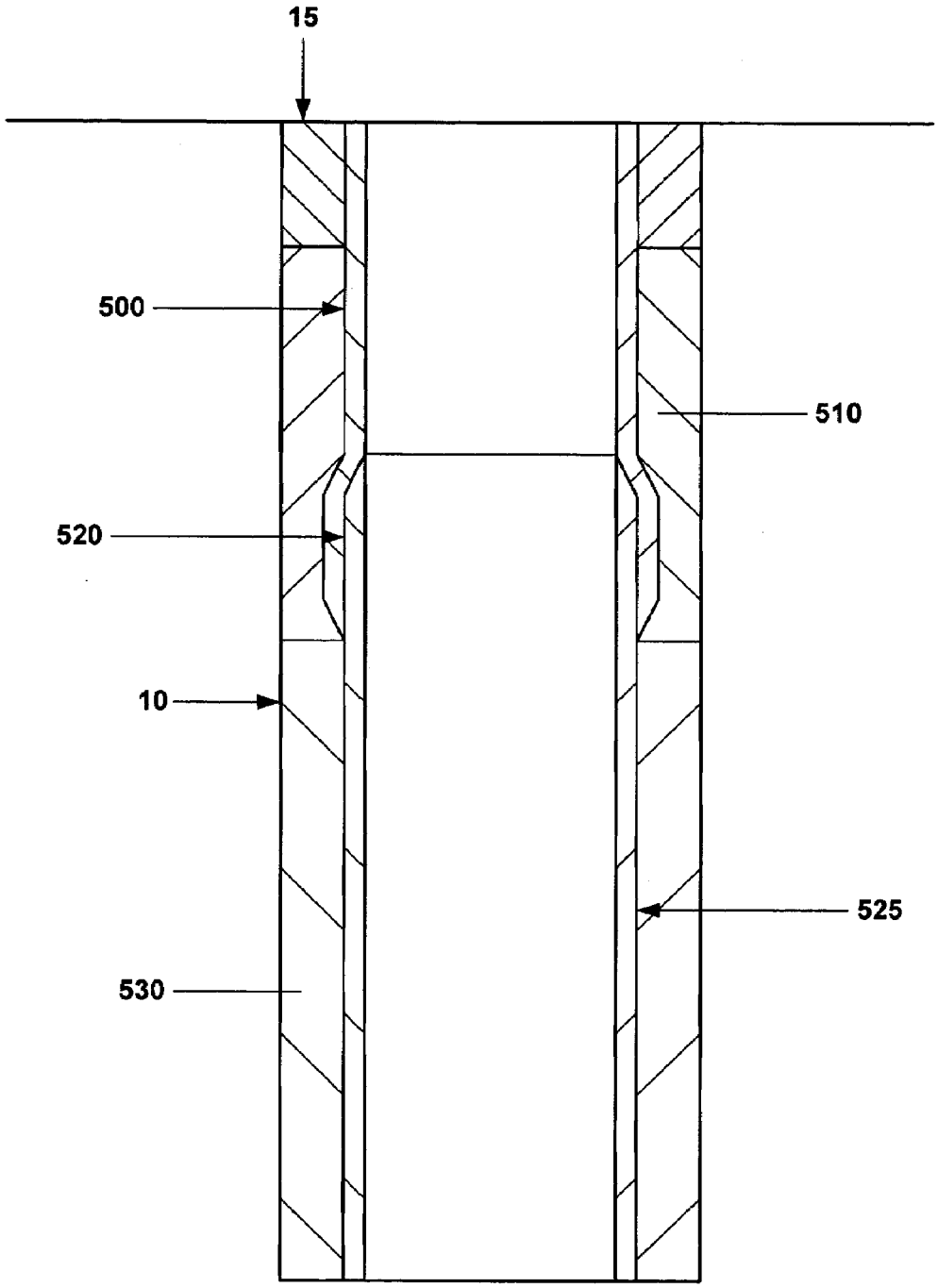
FIG. 5*g* is a cross-sectional illustration of the formation of a mono-diameter wellbore casing that includes the new section of the wellbore casing and an additional section of wellbore casing.

Referring to FIG. 5*g*, an additional tubular member 525 may then be plastically deformed and radially expanded in a conventional manner and/or by using one or more of the methods and apparatus described above in order to form a mono-diameter wellbore casing. Before, during or after the radial expansion of the tubular member 525, an annular body 530 of a fluidic sealing material may be formed around the tubular member in a conventional manner and/or by using one or more of the methods and apparatus described above.

In several alternative embodiments, the inflatable bladder 515 may be coupled to the bottom of an expansion cone in order to permit the over-expansion process to be performed during the radial expansion process implemented using the expansion cone.

Figure 6A:
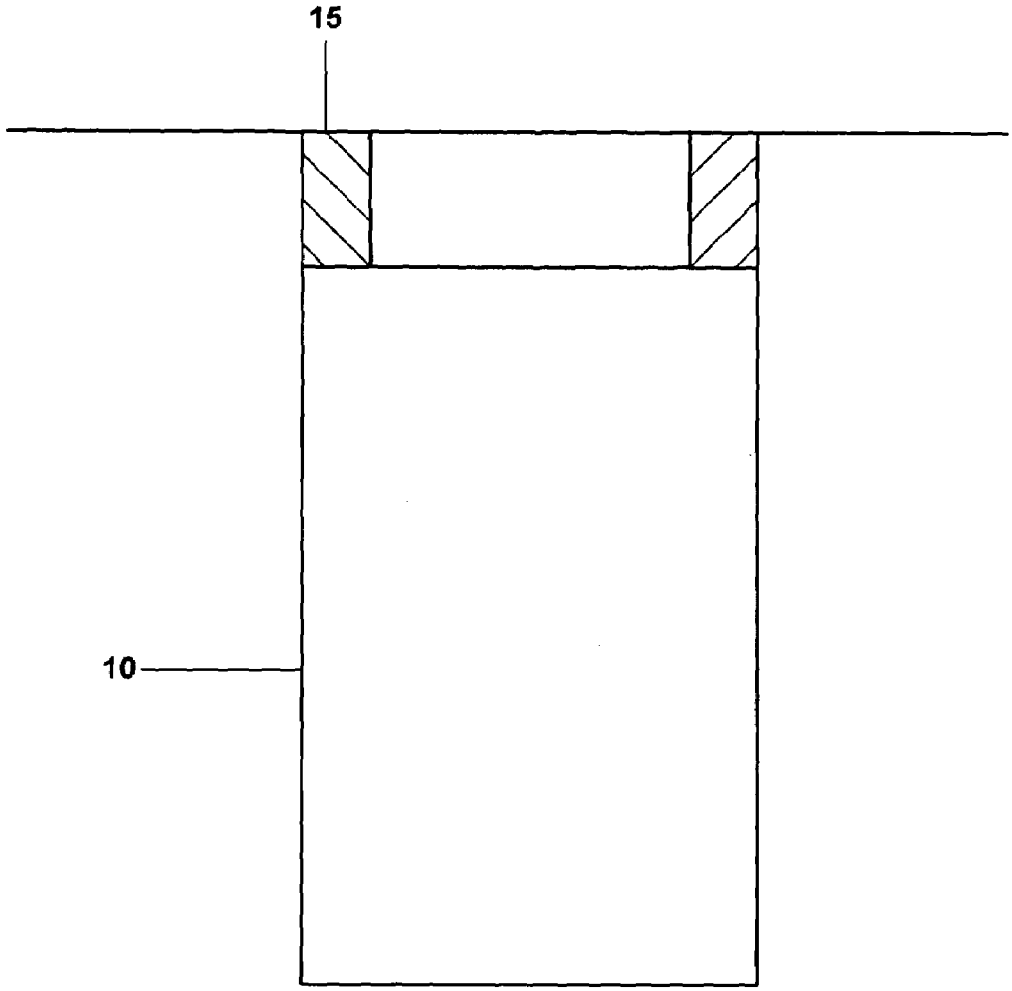
FIG. 6*a* is a cross-sectional illustration of a wellbore including a preexisting wellbore casing.
Figure 6B:
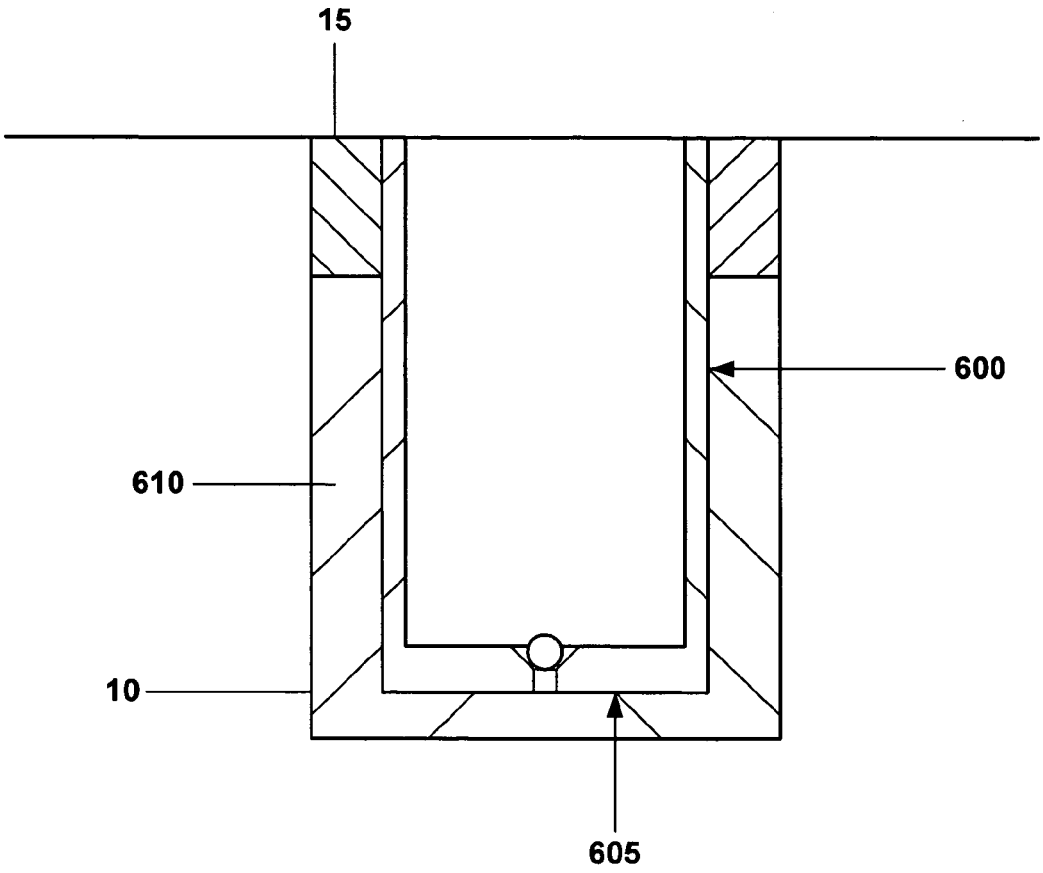
FIG. 6*b* is a cross-sectional illustration of the formation of a new section of wellbore casing in the wellbore of FIG. 6*a*.

Referring to FIGS. 6*a*–6*b*, in an alternative embodiment, a tubular member 600 having a shoe 605 may be plastically deformed and radially expanded and thereby coupled to the preexisting section of wellbore casing 15 using any number of conventional methods. An annular body of a fluidic sealing material 610 may also be formed around the tubular member 600 using any number of conventional methods. In a preferred embodiment, the tubular member 600 is plastically deformed and radially expanded and the annular body 610 is formed using one or more of the methods and apparatus disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference.

In several alternative embodiments, the annular body 610 may be omitted or may be compressible before, during, or after curing.

Figure 6C:
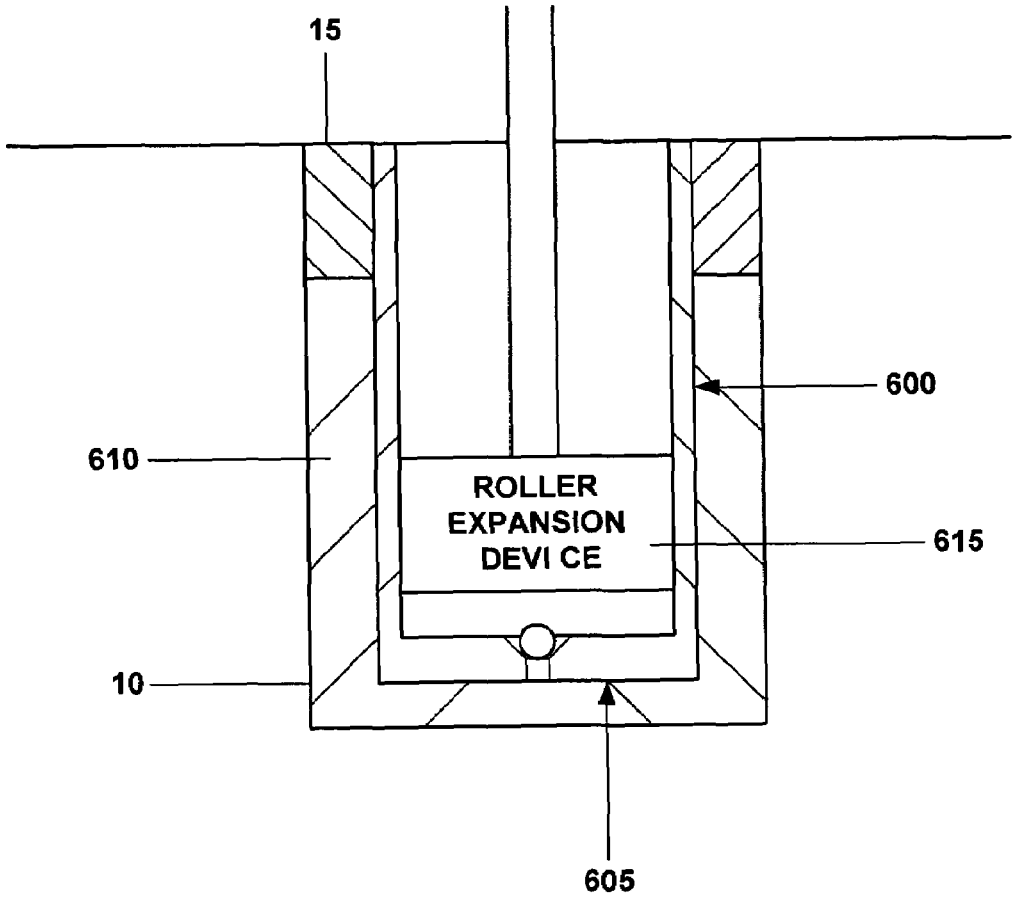
FIG. 6*c* is a fragmentary cross-sectional illustration of the placement of a roller radial expansion device into the new section of the wellbore casing of FIG. 6*b*.
Figure 6D:
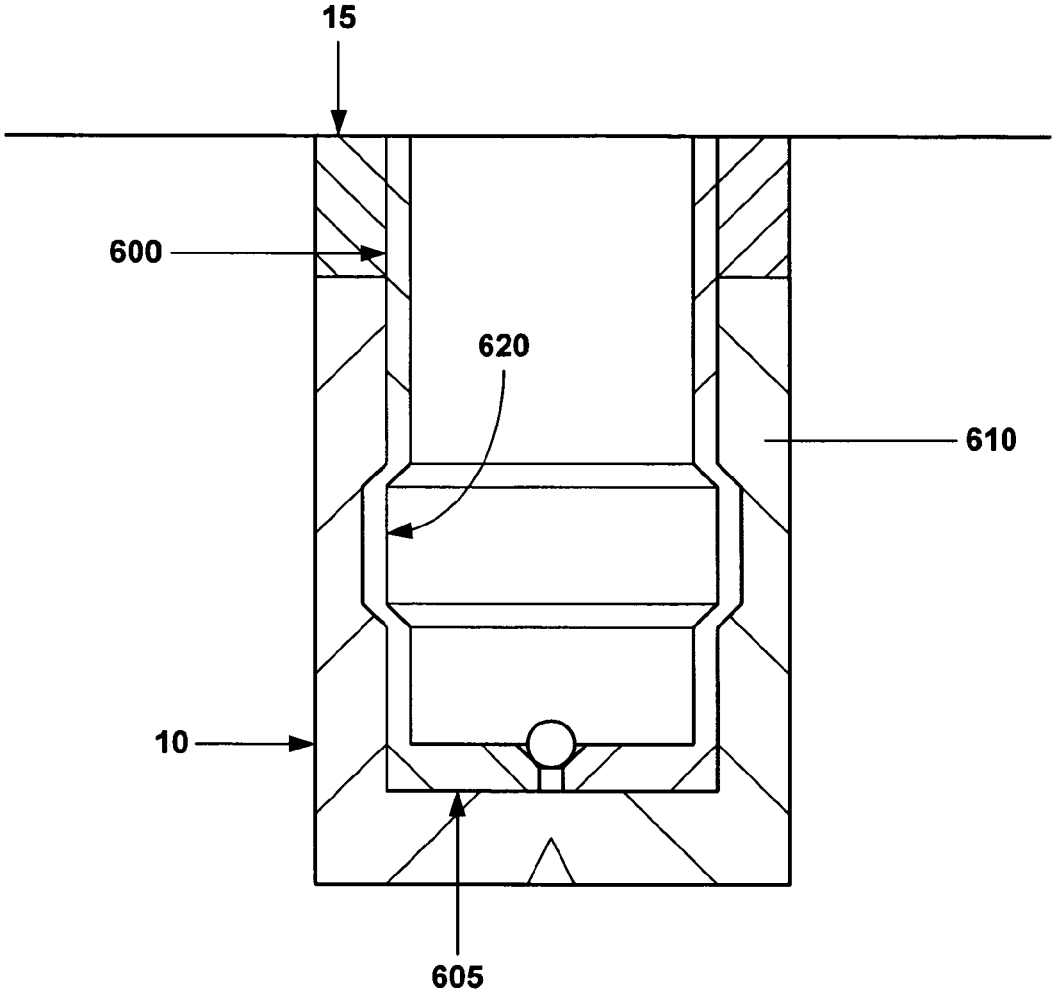
FIG. 6*d* is a cross-sectional illustration of the new section of wellbore casing of FIG. 6*c* after over-expansion.

Referring to FIGS. 6*c* and 6*d*, a conventional roller expansion device 615 may then be positioned within the tubular member 600 and operated in a conventional manner apply a radial force to the interior surface of the tubular member 600 to plastically deform and radially expand a portion of the tubular member to thereby form a recess 620 in the tubular member. As will be recognized by persons having ordinary skill in the art, a roller expansion device typically utilizes one or more rollers that, through rotation of the device, apply a radial force to the interior surfaces of a tubular member. In several alternative embodiments, the roller expansion device 615 may include eccentric rollers such as, for example, as disclosed in U.S. Pat. Nos. 5,014,779 and 5,083,608, the disclosures of which are incorporated herein by reference.

Figure 6E:
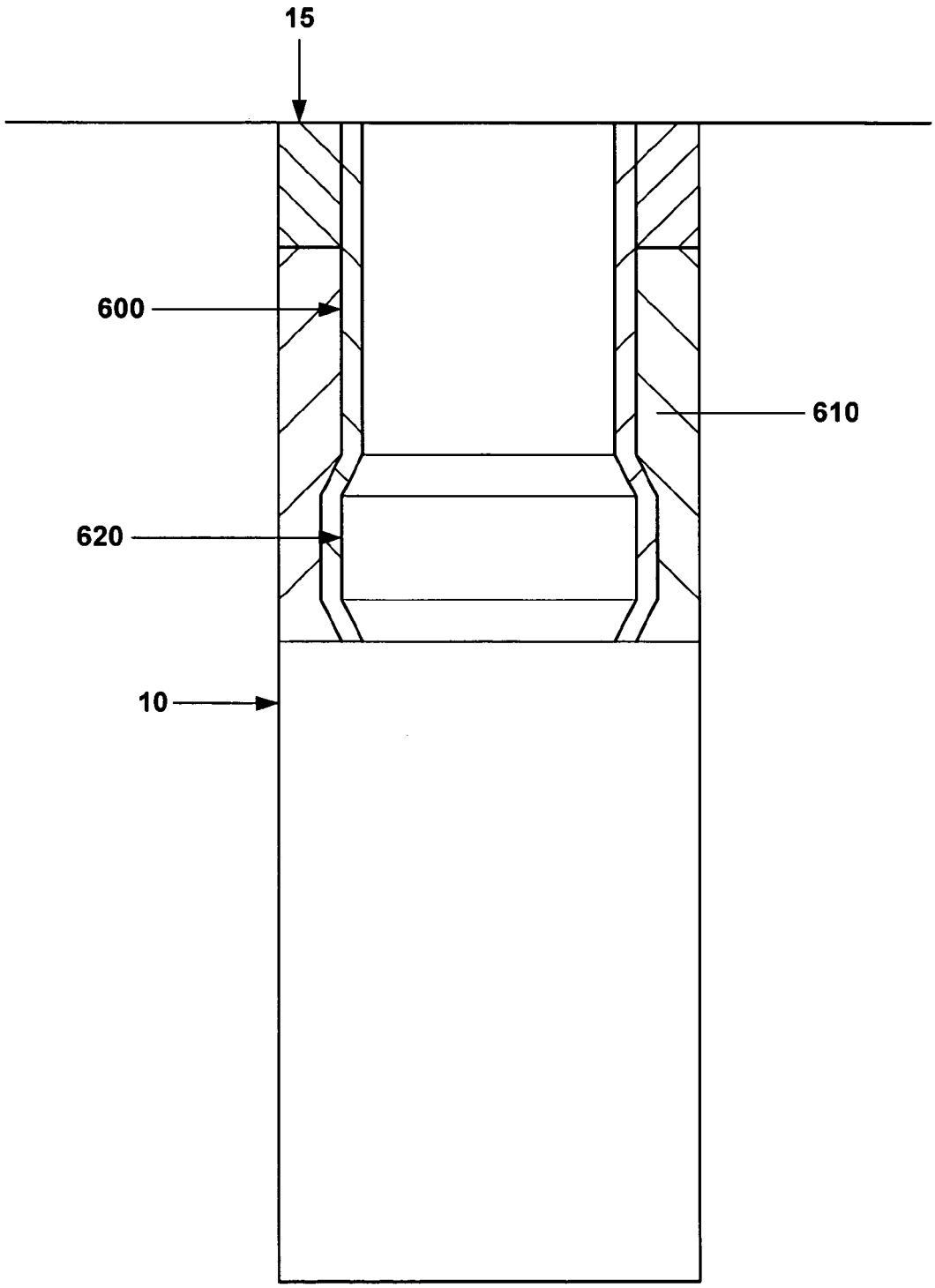
FIG. 6*e* is a cross-sectional illustration of the new section of wellbore casing of FIG. 6*d* after drilling out a new section of the wellbore.

Referring to FIGS. 6*d* and 6*e*, the roller expansion device 615 may then be removed and the shoe 605 drilled out using a conventional drilling device.

Figure 6F:
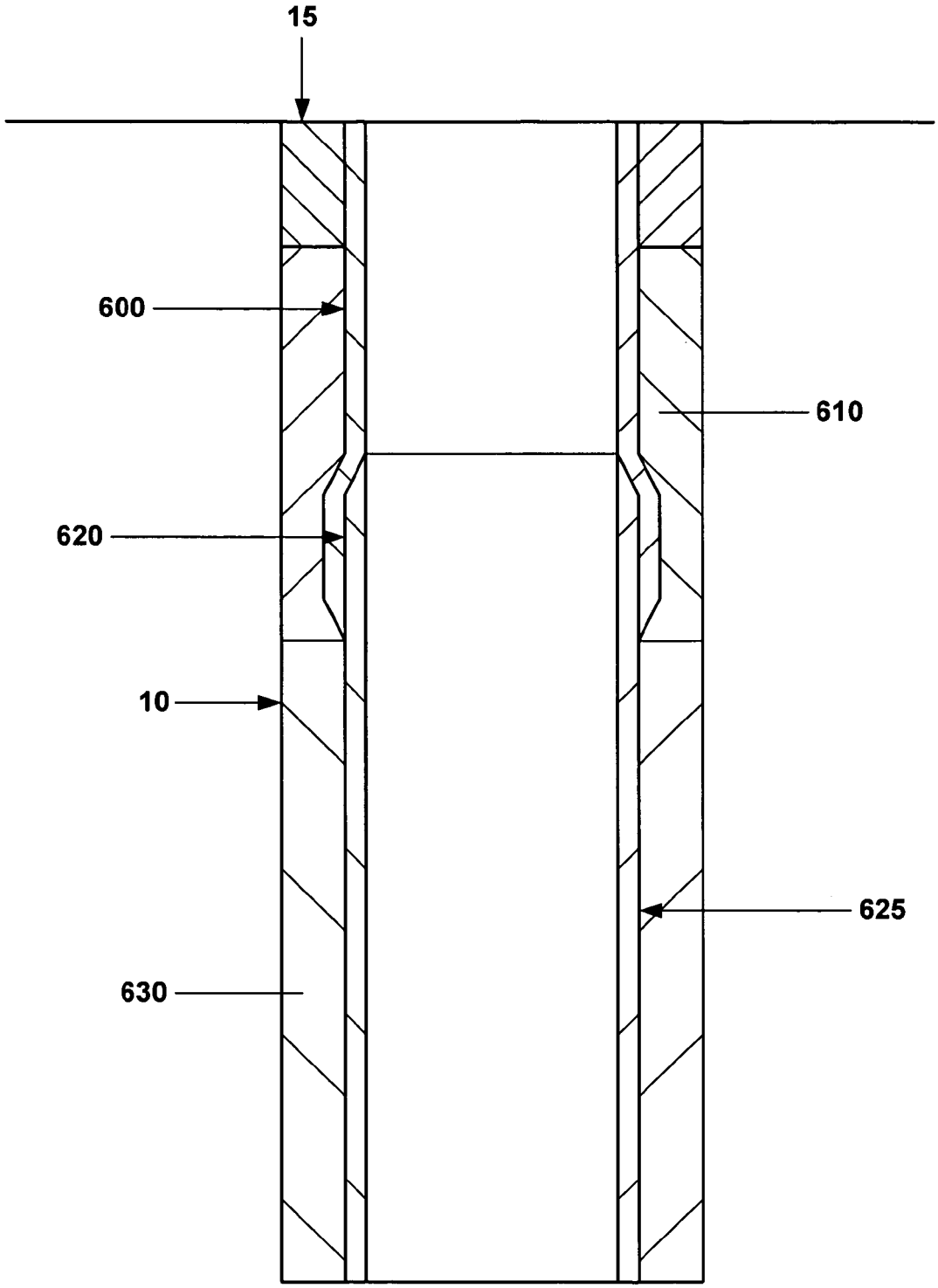
FIG. 6*f* is a cross-sectional illustration of the formation of a mono-diameter wellbore casing that includes the new section of the wellbore casing and an additional section of wellbore casing.

Referring to FIG. 6*f*, an additional tubular member 625 may then be plastically deformed and radially expanded in a conventional manner and/or by using one or more of the methods and apparatus described above in order to form a mono-diameter wellbore casing. Before, during or after the radial expansion of the tubular member 625, an annular body 630 of a fluidic sealing material may be formed around the tubular member in a conventional manner and/or by using one or more of the methods and apparatus described above.

In several alternative embodiments, the roller expansion device 615 may be coupled to the bottom of an expansion cone in order to permit the over-expansion process to be performed during the radial expansion process implemented using the expansion cone.

Figure 7A:
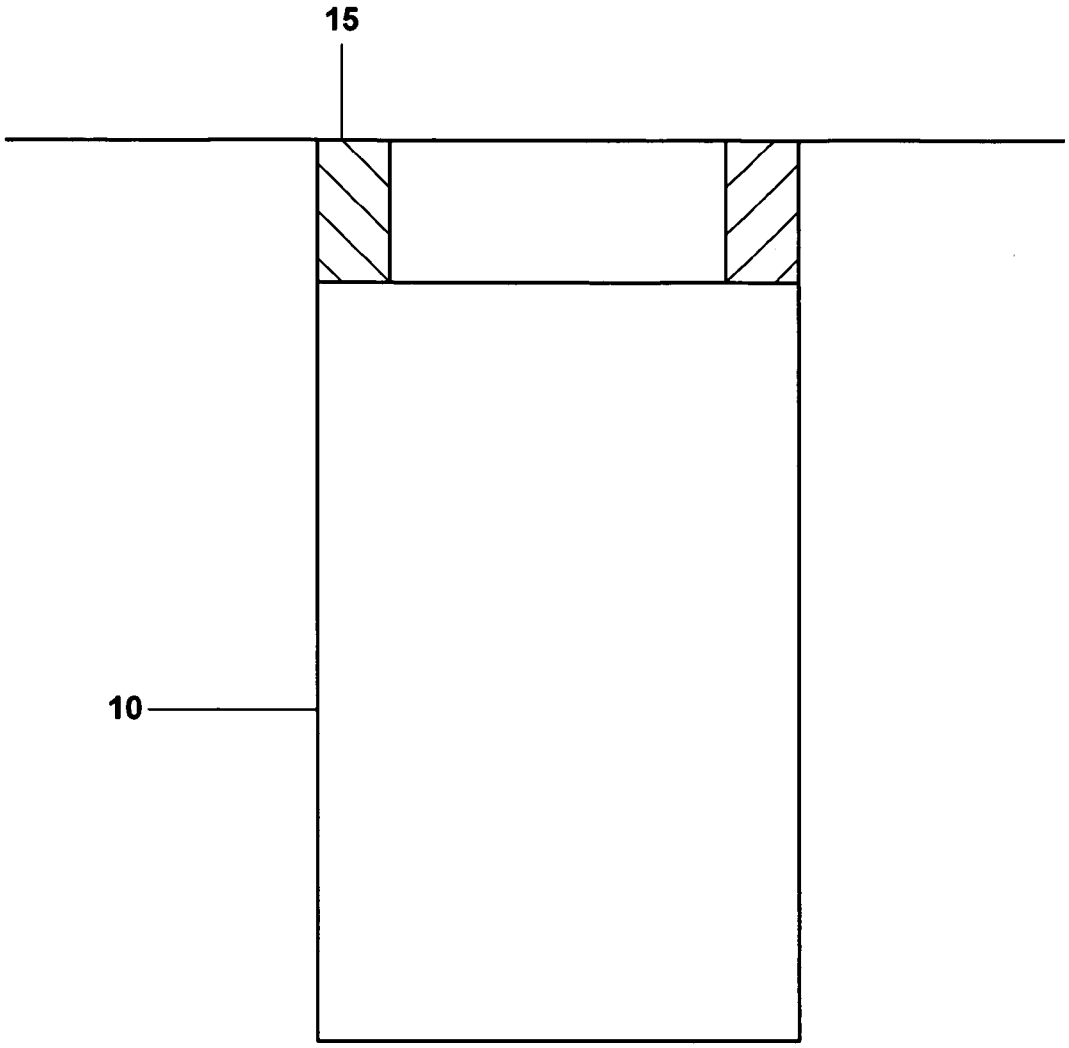
FIG. 7*a* is a cross sectional illustration of a wellbore including a preexisting wellbore casing.

Referring initially to FIG. 7*a*, a wellbore 10 includes a preexisting wellbore casing 15. The wellbore 10 may be oriented in any orientation from the vertical to the horizontal. The preexisting wellbore casing 15 may be coupled to the upper portion of the wellbore 10 using any number of conventional methods. In a preferred embodiment, the wellbore casing 15 is coupled to the upper portion of the wellbore 10 using one or more of the methods and apparatus disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference. More generally, the preexisting wellbore casing 15 may be coupled to another preexisting wellbore casing and/or may include one or more concentrically positioned tubular members.

Figure 7B:
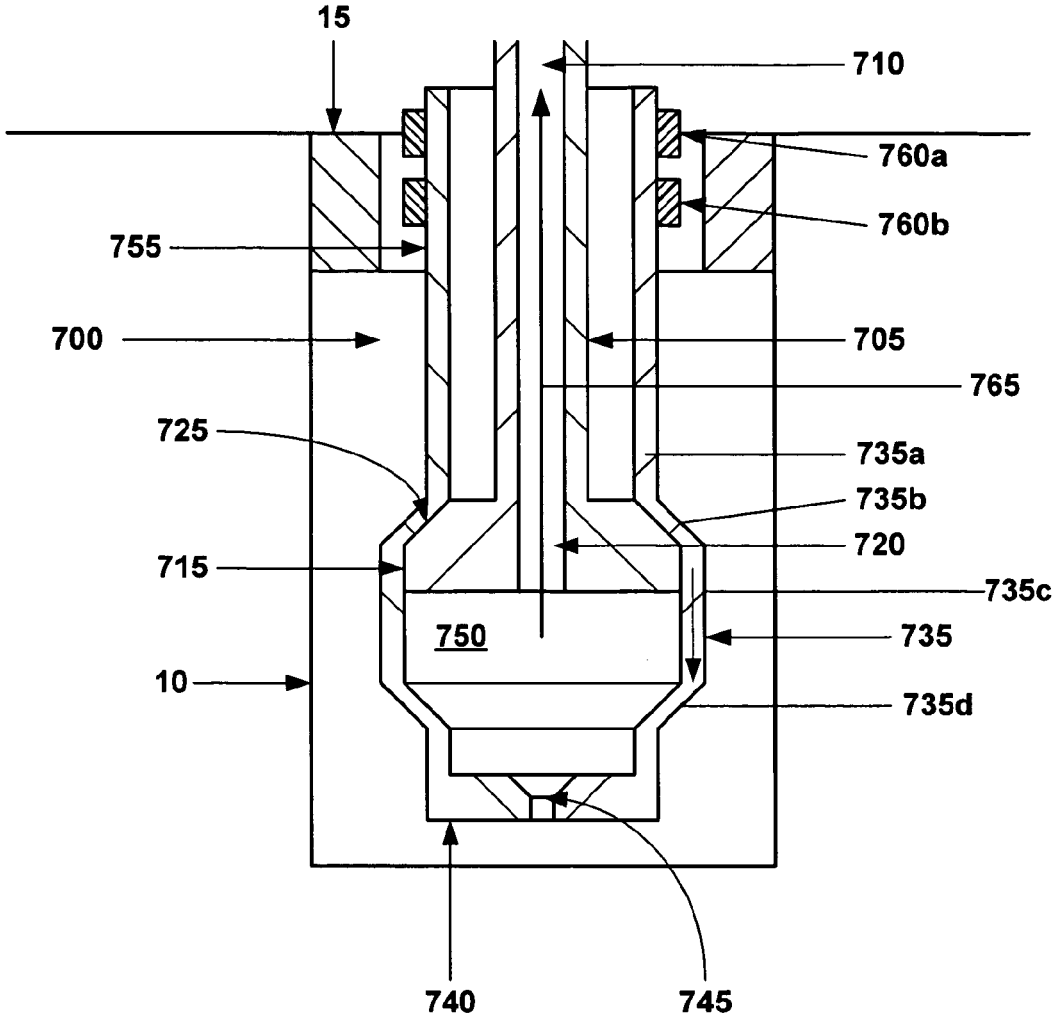
FIG. 7*b* is a cross-sectional illustration of the placement of an embodiment of an apparatus for radially expanding a tubular member into the wellbore of FIG. 7*a*.

Referring to FIG. 7*b*, an apparatus 700 for radially expanding a tubular member may then be positioned within the wellbore 10. The apparatus 700 includes a tubular support member 705 defining a passage 710 for conveying fluidic materials. An expansion cone 715 defining a passage 720 and having an outer conical surface 725 for radially expanding tubular members is coupled to an end of the tubular support member 705.

An expansion cone launcher 735 is movably coupled to and supported by the expansion cone 715. The expansion cone launcher 735 includes an upper portion 735*a* having an upper outer diameter, an intermediate portion 735*b* that mates with the expansion cone 715, and a lower portion 735*c* having a lower outer diameter. The lower outer diameter is greater than the upper outer diameter. The expansion cone launcher 735 further includes a recessed portion 735*d* having an outer diameter that is less than the lower outer diameter.

A shoe 740 defining a valveable passage 745 is coupled to the lower portion of the expansion cone launcher 735. In a preferred embodiment, the valveable passage 745 may be controllably closed in order to fluidicly isolate a region 750 below the expansion cone 715 and bounded by the lower portion 735*c* of the expansion cone launcher 735 and the shoe 740 from the region outside of the apparatus 700.

An expandable tubular member 755 is coupled to the upper portion 735*a* of the expansion cone launcher 735. One or more sealing members 760*a* and 760*b* may be coupled to the exterior of the upper portion of the expandable tubular member 755. In several alternative embodiments, the sealing members 760*a* and 760*b* may include elastomeric elements and/or metallic elements and/or composite elements. In several alternative embodiments, one or more anchoring elements may substituted for, or used in addition to, the sealing members 760*a* and 760*b*.

In a preferred embodiment, the support member 705, the expansion cone 715, the expansion cone launcher 735, the shoe 740, and the expandable tubular member 755 are provided substantially as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, docket no. 25791.34, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference.

As illustrated in FIG. 7*b*, in a preferred embodiment, during placement of the apparatus 700 within the wellbore 10, fluidic materials 765 within the wellbore 10 are conveyed through the apparatus 700 through the passages 710, 720 and 745 to a location above the apparatus 700. In this manner, surge pressures during placement of the apparatus 700 within the wellbore 10 are reduced. In a preferred embodiment, the apparatus 700 is initially positioned within the wellbore 10 such that the top portion of the tubular member 755 overlaps with the preexisting casing 15. In this manner, the upper portion of the expandable tubular member 755 may be radially expanded into contact with and coupled to the preexisting casing 15. As will be recognized by persons having ordinary skill in the art, the precise initial position of the expandable tubular member 755 will vary as a function of the amount of radial expansion, the amount of axial shrinkage during radial expansion, and the material properties of the expandable tubular member.

Figure 7C:
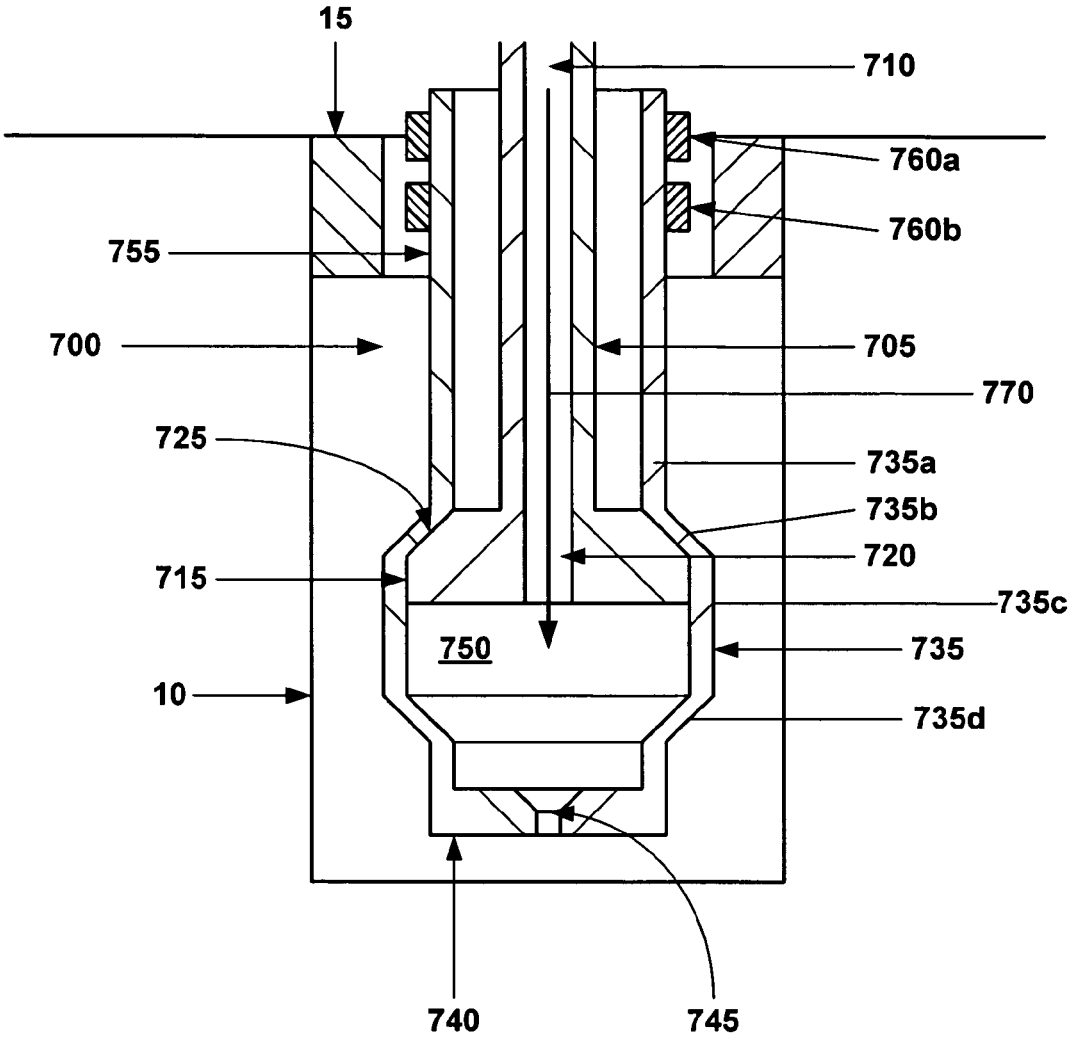
FIG. 7*c* is a cross-sectional illustration of the injection of fluidic materials through the apparatus of FIG. 7*b*.

As illustrated in FIG. 7*c*, a fluidic material 770 may then be injected through the apparatus 700 through the passages 710, 720, and 745 in order to test the proper operation of these passages.

Figure 7D:
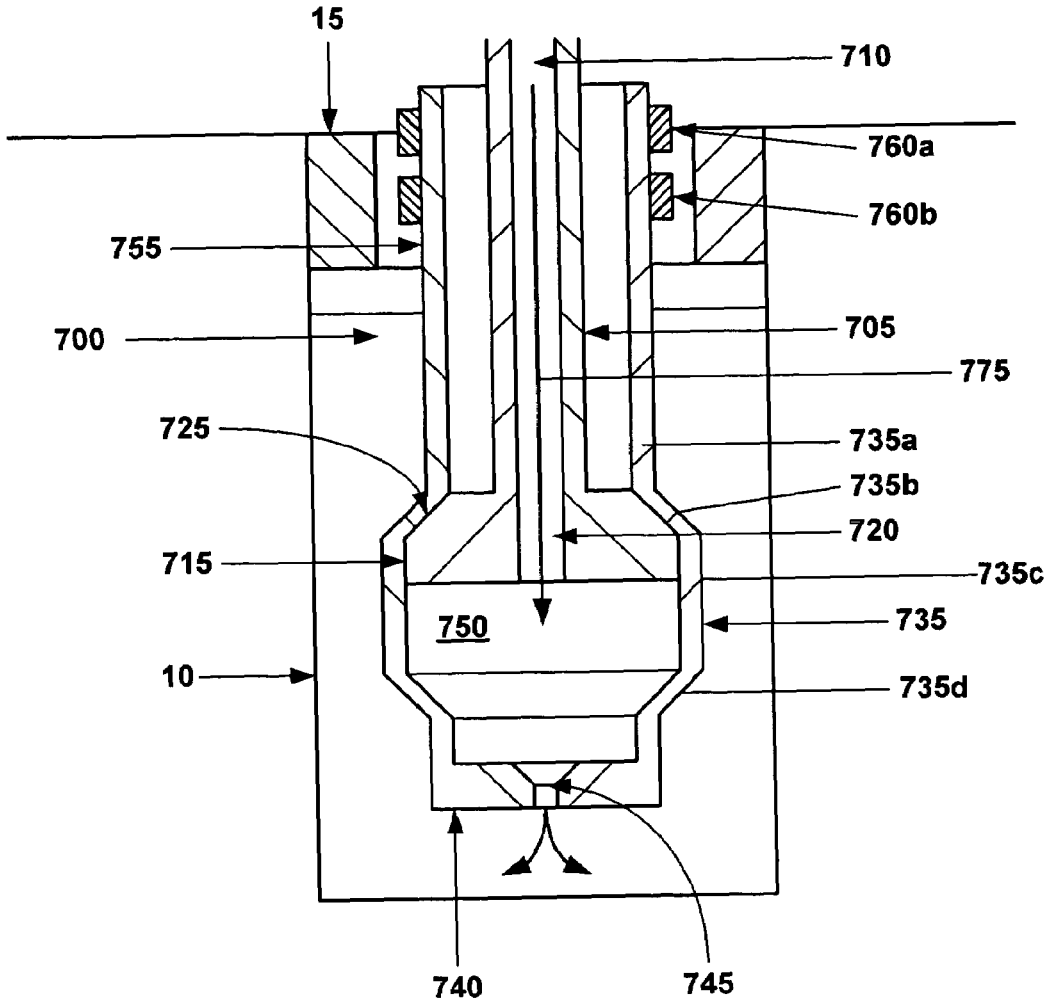
FIG. 7*d* is a cross-sectional illustration of the injection of hardenable fluidic sealing materials through the apparatus of FIG. 7*c*.

As illustrated in FIG. 7*d*, a hardenable fluidic sealing material 775 may then be injected through the apparatus 700 through the passages 710, 720 and 745 into the annulus between the apparatus and the wellbore 10. In this manner, an annular barrier to fluid migration into and out of the wellbore 10 may be formed around the radially expanded expansion cone launcher 735 and expandable tubular member 755. The hardenable fluidic sealing material may include, for example, a cement mixture. In several alternative embodiments, the injection of the hardenable fluidic sealing material 775 may be omitted. In several alternative embodiments, the hardenable fluidic sealing material 775 is compressible, before, during and/or after, the curing process.

Figure 7E:
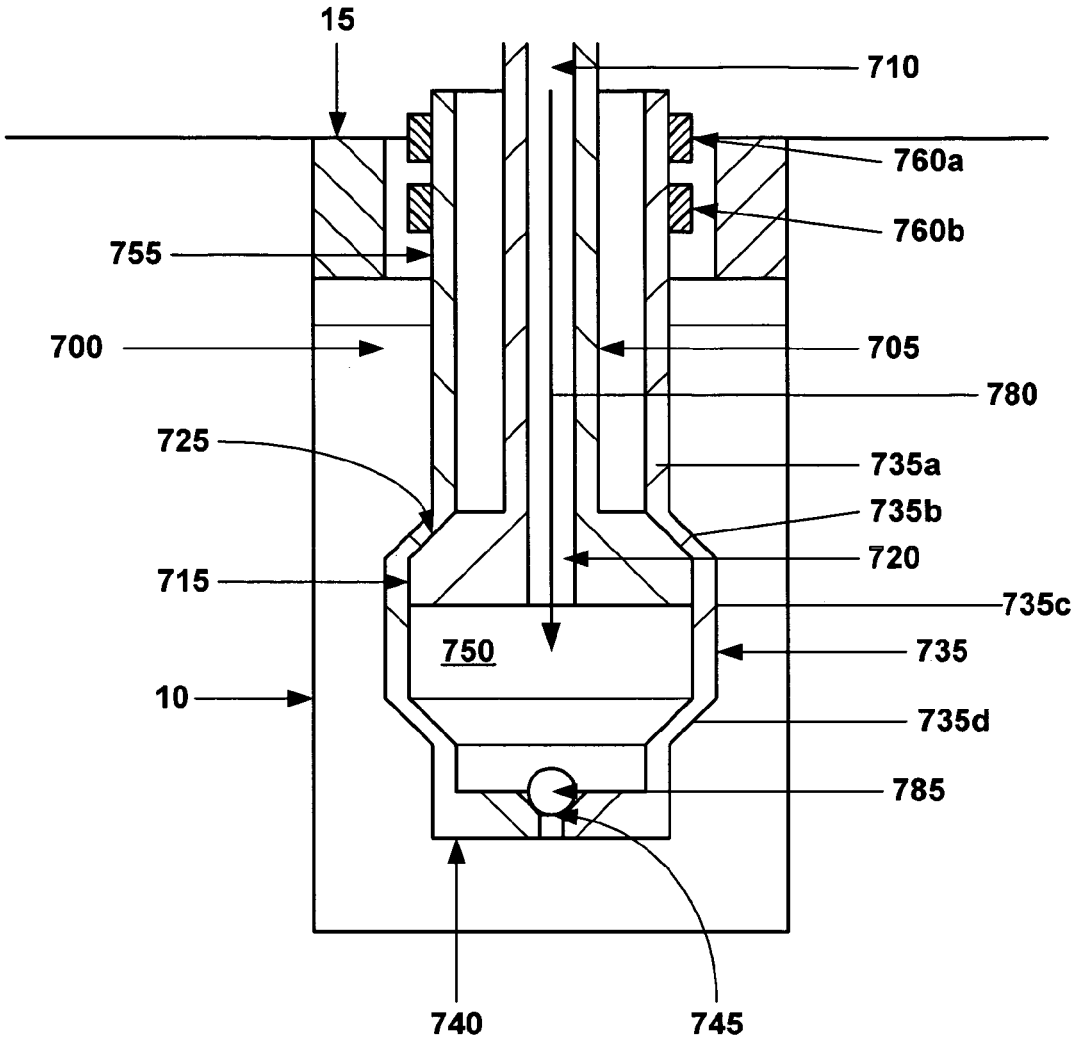
FIG. 7*e* is a cross-sectional illustration of the pressurization of the region below the expansion cone of the apparatus of FIG. 7*d*.

As illustrated in FIG. 7*e*, a non-hardenable fluidic material 780 may then be injected into the apparatus through the passages 710 and 720. A ball plug 785, or other similar device, may then be injected with the fluidic material 780 to thereby seal off the passage 745. In this manner, the region 750 may be pressurized by the continued injection of the fluidic material 780 into the apparatus 700.

Figure 7F:
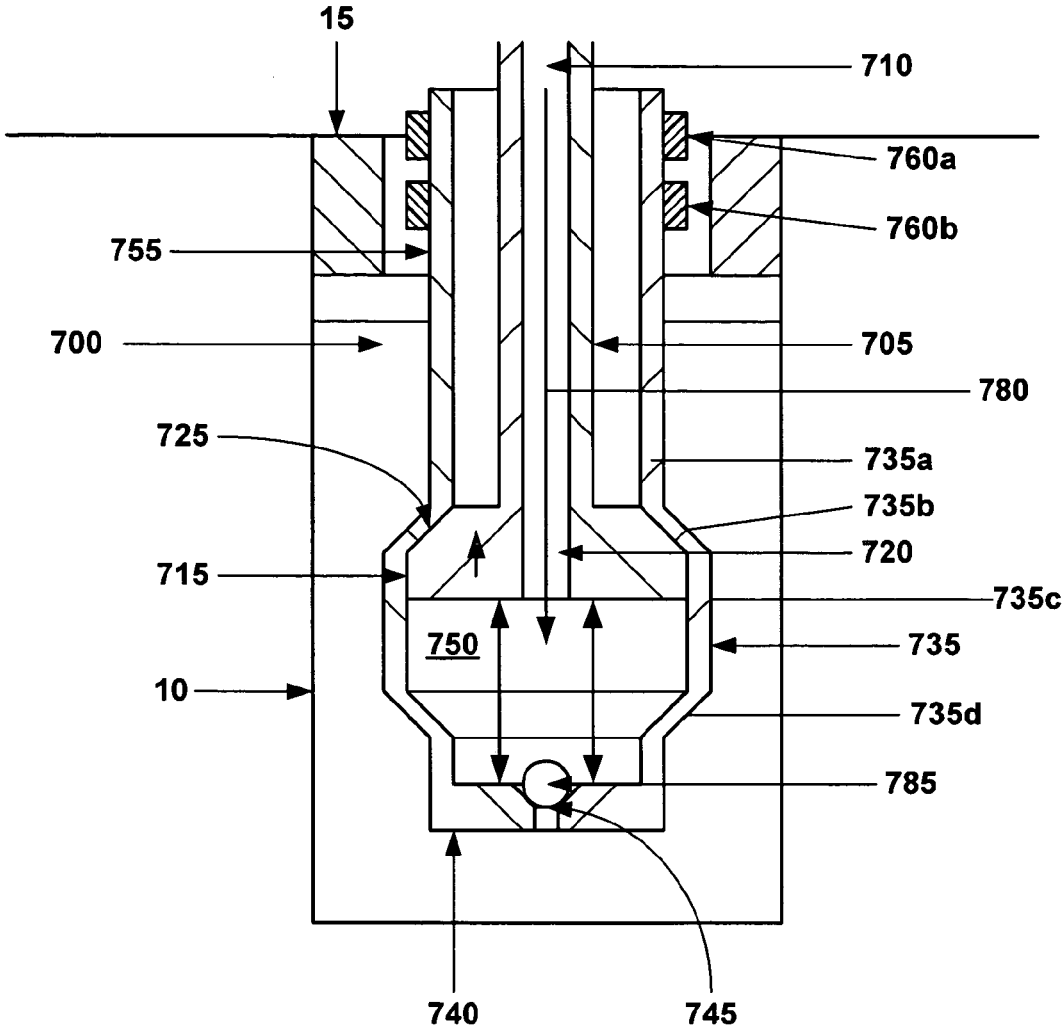
FIG. 7*f* is a cross-sectional illustration of the continued pressurization of the region below the expansion cone of the apparatus of FIG. 7*e*.
Figure 7G:
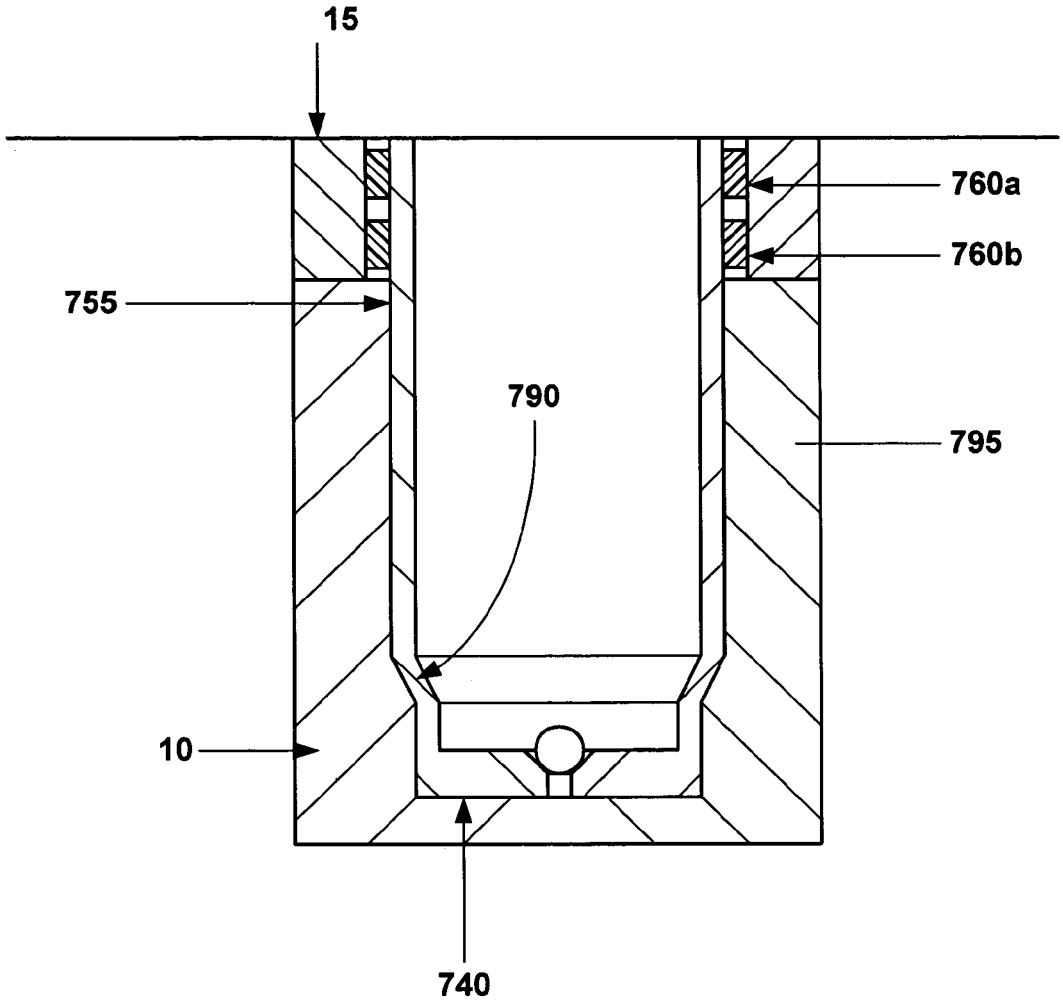
FIG. 7*g* is a cross-sectional illustration of the completion of the radial expansion of the expandable tubular member of the apparatus of FIG. 7*f*.

As illustrated in FIGS. 7*f* and 7*g*, the continued injection of the fluidic material 780 into the apparatus 700 causes the expansion cone launcher 735 and expandable tubular member 755 to be plastically deformed and radially expanded off of the expansion cone 715. The resulting structure includes a lip 790.

After completing the plastic deformation and radial expansion of the tubular member 755, the hardenable fluidic sealing material is allowed to cure to thereby form an annular body 795 that provides a barrier to fluid flow into or out of the wellbore 10.

Figure 7H:
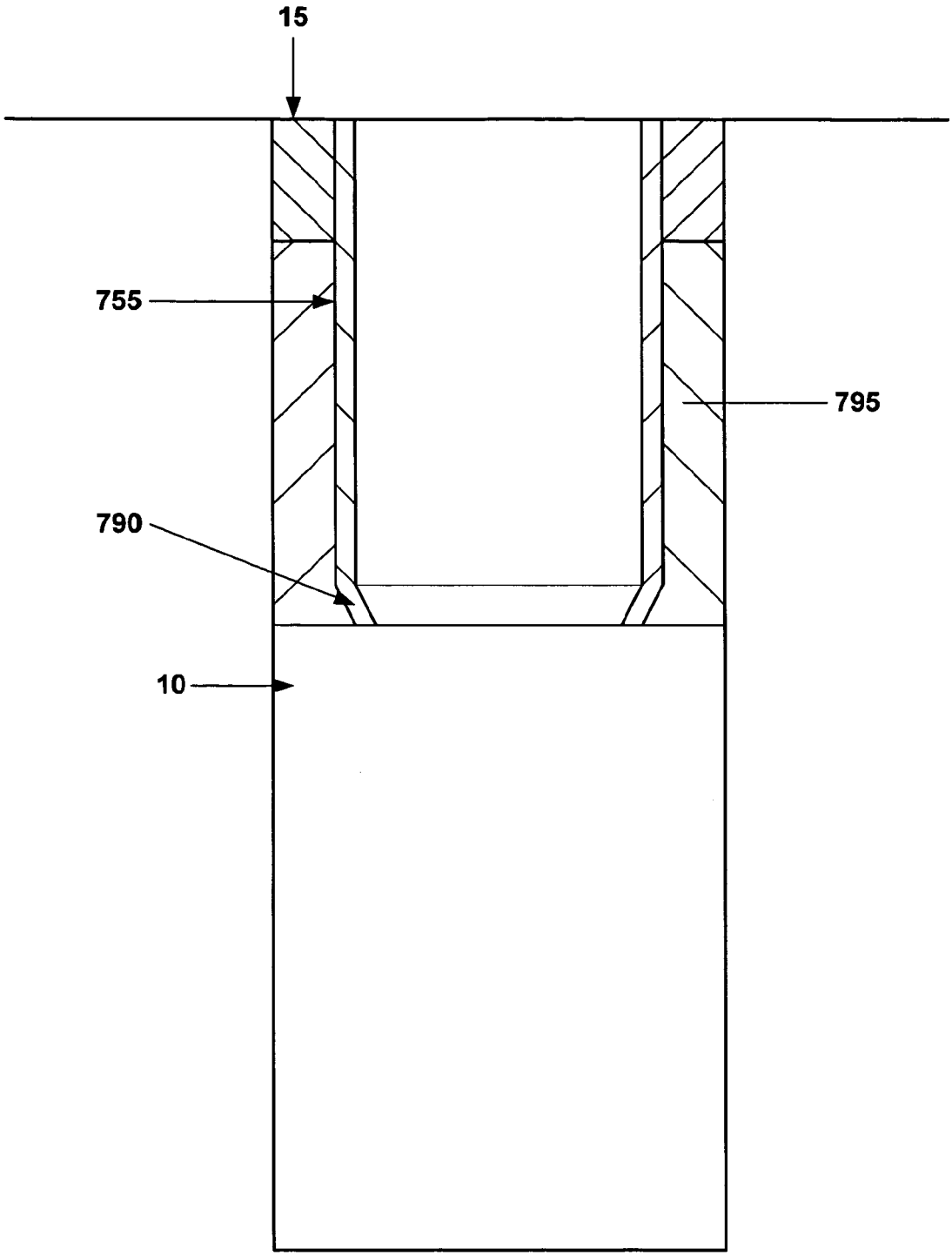
FIG. 7*h* is a cross-sectional illustration of the drilling out of a new section of the wellbore below the apparatus of FIG. 7*g*.

Referring to FIG. 7*h*, the shoe 740 may then removed by drilling out the shoe using a conventional drilling device. A new section of the wellbore 10 may also be drilled out in order to permit additional expandable tubular members to be coupled to the bottom portion of the plastically deformed and radially expanded tubular member 755.

Figure 7I:
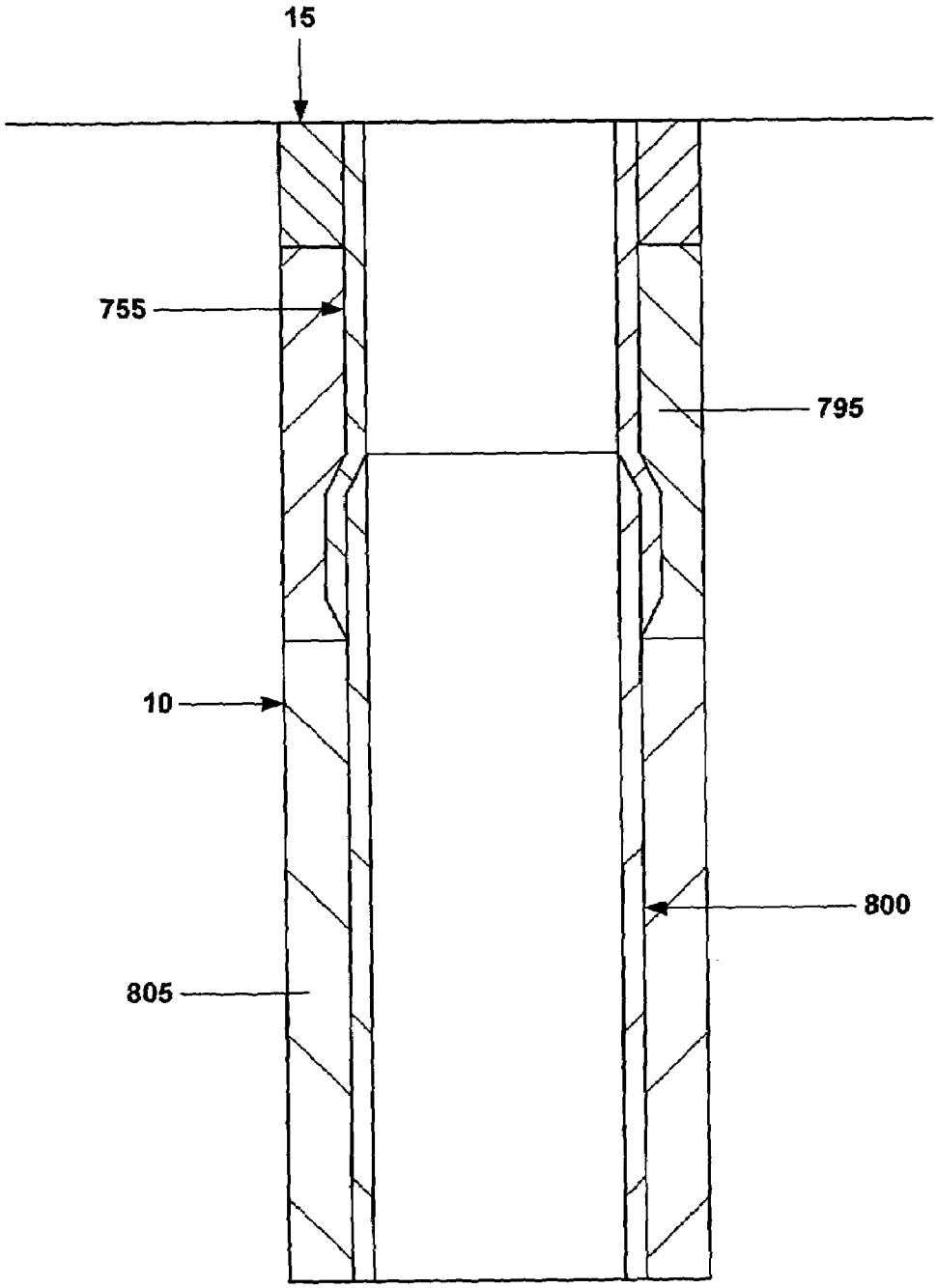
FIG. 7*i* is a cross-sectional illustration of the completion of the radial expansion of another expandable tubular member to form a mono-diameter wellbore casing.

Referring to FIG. 7*i*, an additional tubular member 800 may then be plastically deformed and radially expanded in a conventional manner and/or by using one or more of the methods and apparatus described above in order to form a mono-diameter wellbore casing. Before, during or after the radial expansion of the tubular member 800, an annular body 805 of a fluidic sealing material may be formed around the tubular member in a conventional manner and/or by using one or more of the methods and apparatus described above. In a preferred embodiment, the lip 790 facilitates the coupling of the tubular member 800 to the tubular member 755 by providing a region on which the tubular member 800 may be easily coupled onto.

Figure 8A:
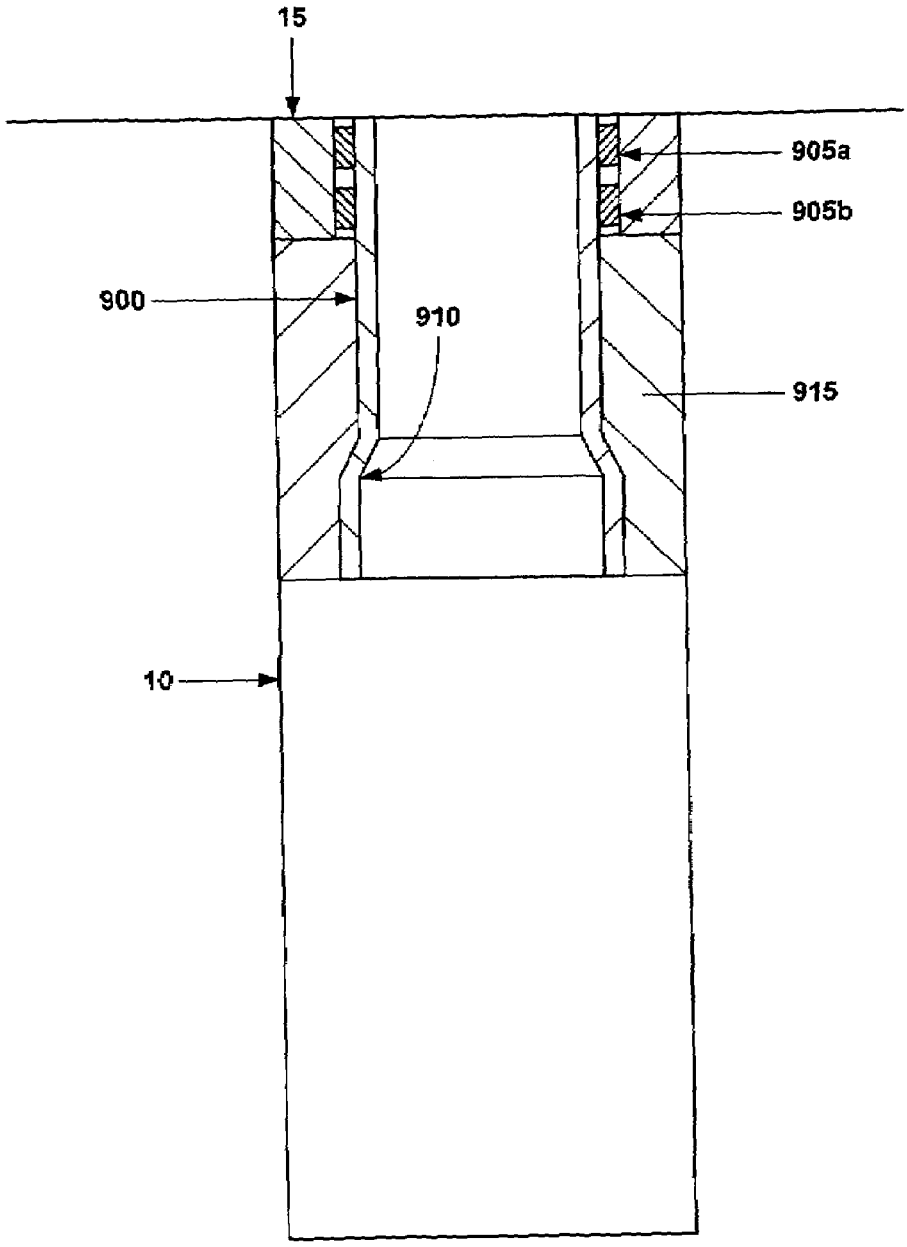
FIG. 8*a* is cross-sectional illustration of an wellbore including a preexisting section of wellbore casing having a recessed portion.

Referring to FIG. 8*a*, in an alternative embodiment, a wellbore 10 includes a preexisting section of wellbore casing 15 and 900. The wellbore casing 900 includes sealing members 905*a* and 905*b* and a recess 910. An annular body 915 of a fluidic sealing material may also be provided around the casing 900. The casing 900 and annular body 915 may be provided using any number of conventional methods, the methods described above, and/or using one or more of the methods disclosed in the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference.

Figure 8B:
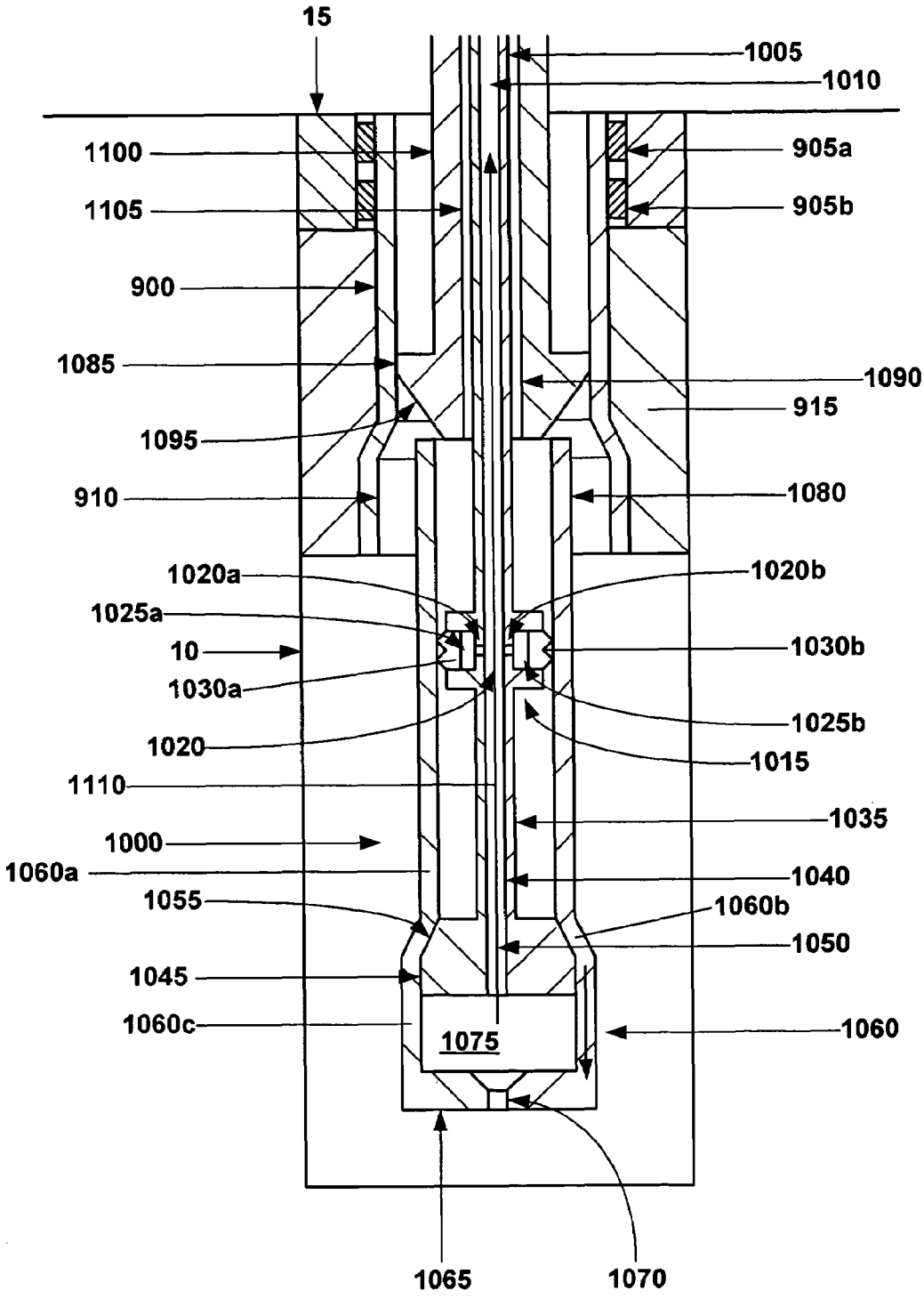
FIG. 8*b* is a cross-sectional illustration of the placement of an apparatus for radially expanding a tubular member within the wellbore of FIG. 8*a*.

Referring to FIG. 8*b*, an apparatus 1000 for radially expanding a tubular member is then positioned within the wellbore 10 that includes a tubular support member 1005 that defines a passage 1010 for conveying fluidic materials. A hydraulic locking device 1015 that defines a passage 1020 for conveying fluidic materials that is fluidicly coupled to the passage 1010. The locking device 1015 further includes inlet passages, 1020*a* and 1020*b*, actuating chambers, 1025*a* and 1025*b*, and locking members, 1030*a* and 1030*b*. During operation, the injection of fluidic materials into the actuating chambers, 1025*a* and 1025*b*, causes the locking members, 1030*a* and 1030*b*, to be displaced outwardly in the radial direction. In this manner, the locking device 1015 may be controllably coupled to a tubular member to thereby maintain the tubular member in a substantially stationary position. As will be recognized by persons having ordinary skill in the art, the operating pressures and physical shape of the inlet passages 1020, actuating chambers 1025, and locking members 1030 will determine the maximum amount of holding force provided by the locking device 1015. In several alternative embodiments, fluidic materials may be injected into the locking device 1015 using a dedicated fluid passage in order to provide precise control of the locking device. In several alternative embodiments, the locking device 1015 may be omitted and the tubular support member 1005 coupled directly to the tubular support member 1035.

One end of a tubular support member 1035 that defines a passage 1040 is coupled to the locking device 1015. The passage 1040 is fluidicly coupled to the passage 1020. An expansion cone 1045 that defines a passage 1050 and includes an outer conical surface 1055 is coupled to another end of the tubular support member 1035. An expansion cone launcher 1060 is movably coupled to and supported by the expansion cone 1045. The expansion cone launcher 1060 includes an upper portion 1060*a* having an upper outside diameter, an intermediate portion 1060*b* that mates with the expansion cone 1045, and a lower portion 1060*c* having a lower outside diameter. The lower outside diameter is greater than the upper outside diameter.

A shoe 1065 that defines a valveable passage 1070 is coupled to the lower portion 1060*c* of the expansion cone launcher 1060. In this manner, a region 1075 below the expansion cone 1045 and bounded by the expansion cone launcher 1060 and the shoe 1065 may be pressurized and fluidicly isolated from the annular region between the apparatus 1000 and the wellbore 10.

An expandable tubular member 1080 is coupled to the upper portion of the expansion cone launcher 1060. In several alternative embodiments, one or more sealing members are coupled to the exterior of the upper portion of the expandable tubular member 1080. In several alternative embodiments, the sealing members may include elastomeric elements and/or metallic elements and/or composite elements. In several alternative embodiments, one or more anchoring elements may substituted for, or used in addition to, the sealing members.

An expansion cone 1085 defining a passage 1090 for receiving the tubular support member 1005 includes an outer conical surface 1095. A tubular support member 1100 defining a passage 1105 for receiving the tubular support member 1005 is coupled to the bottom of the expansion cone 1085 for supporting and actuating the expansion cone.

In a preferred embodiment, the support members 1005 and 1035, the expansion cone 1045, the expansion cone launcher 1060, the shoe 1065, and the expandable tubular member 1080 are provided substantially as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial no. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, and (20) U.S. provisional patent application Ser. No. 60/233,638, filed on Sep. 18, 2000, the disclosures of which are incorporated herein by reference.

As illustrated in FIG. 8*b*, in a preferred embodiment, during placement of the apparatus 1000 within the wellbore 10, fluidic materials 1110 within the wellbore 10 are conveyed through the apparatus 1000 through the passages 1010, 1020, 1040 and 1070 to a location above the apparatus 1000. In this manner, surge pressures during placement of the apparatus 1000 within the wellbore 10 are reduced. In a preferred embodiment, the apparatus 1000 is initially positioned within the wellbore 10 such that the top portion of the tubular member 1080 overlaps with the recess 910 of the preexisting casing 900. In this manner, the upper portion of the expandable tubular member 1080 may be radially expanded into contact with and coupled to the recess 910 of the preexisting casing 900.

Figure 8C:
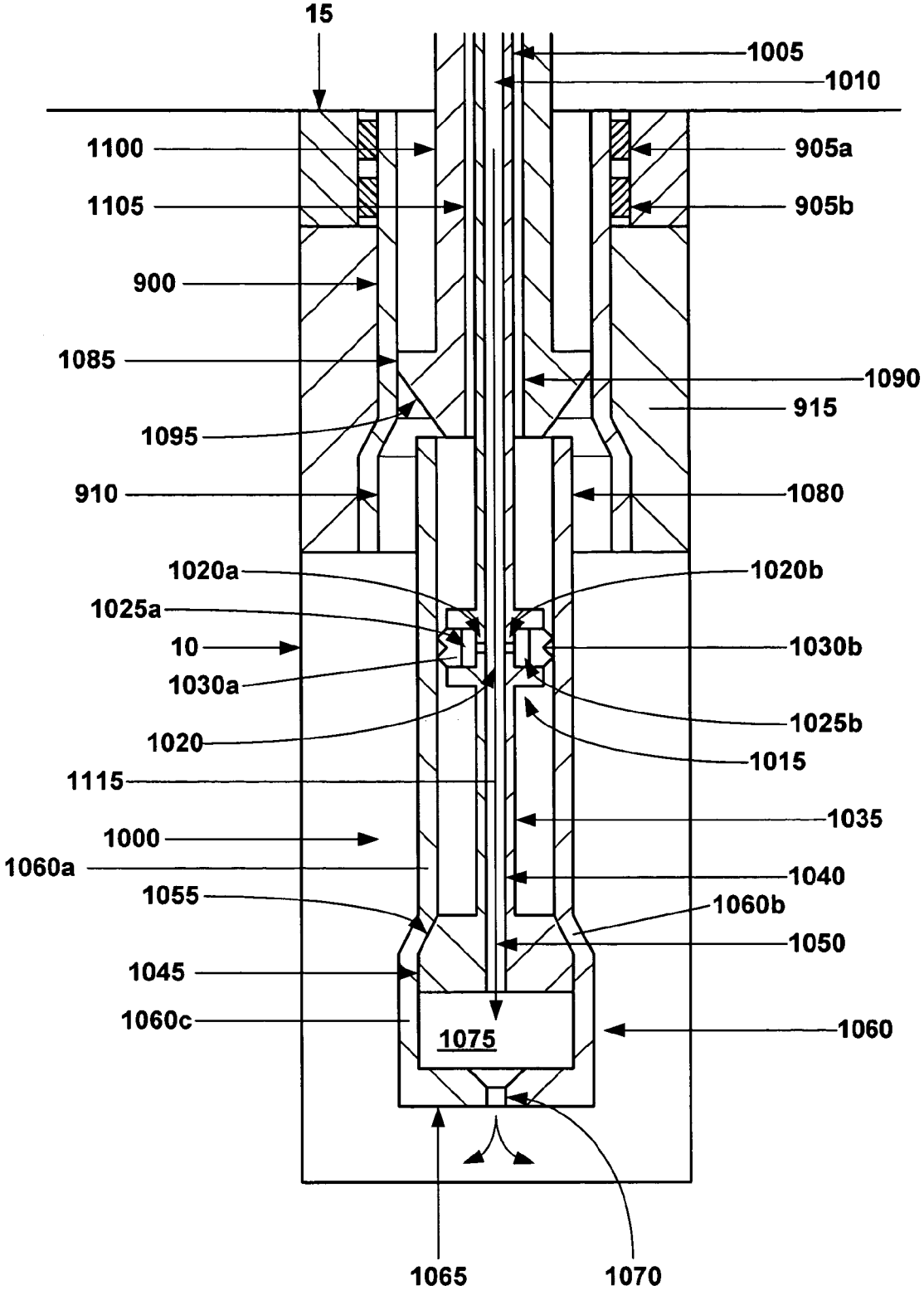
FIG. 8*c* is a cross-sectional illustration of the injection of fluidic materials through the apparatus of FIG. 8*b*.

As illustrated in FIG. 8*c*, a fluidic material 1115 may then be injected through the apparatus 1000 through the passages 1010, 1020, 1040, and 1070 in order to test the proper operation of these passages.

Figure 8D:
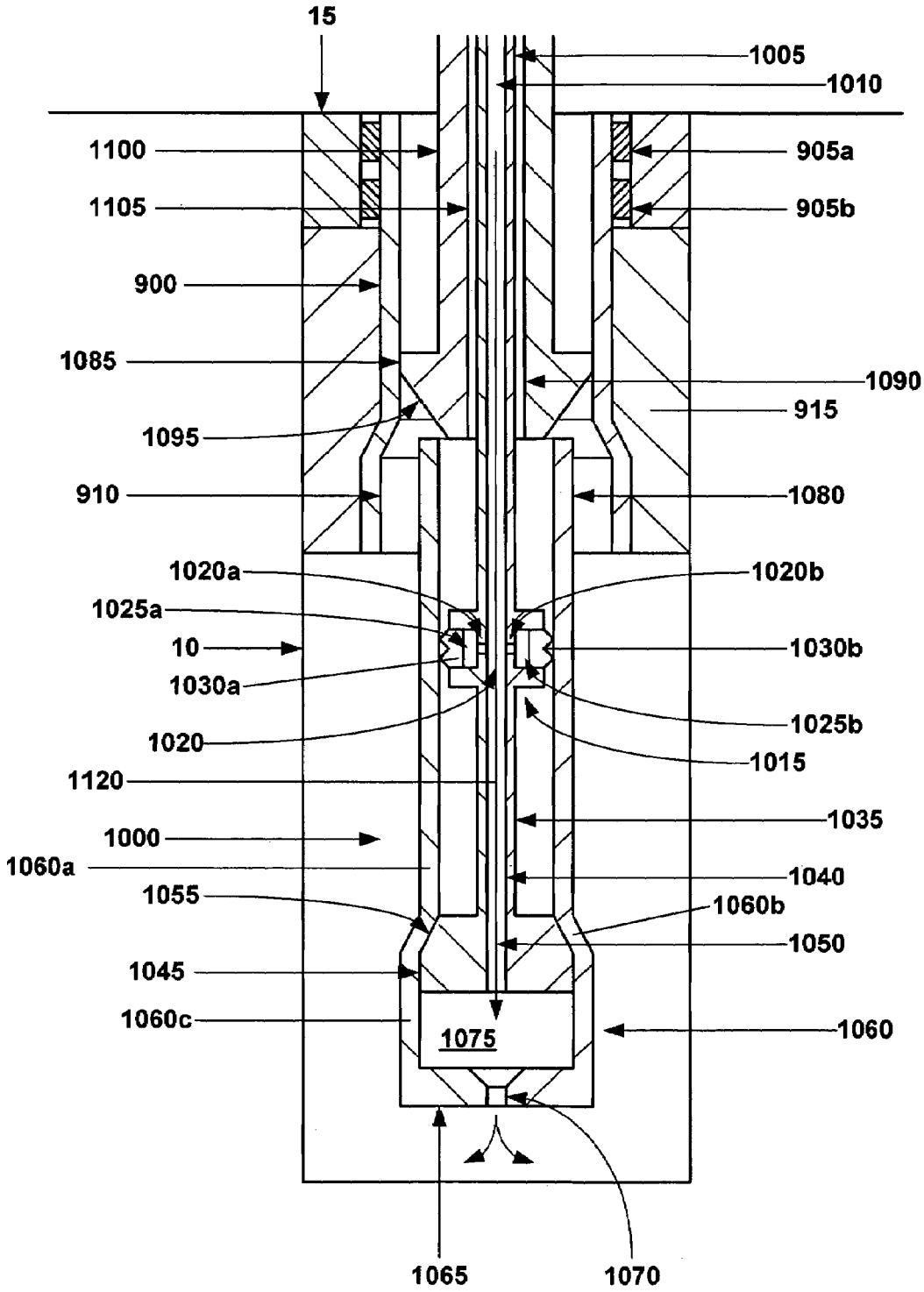
FIG. 8*d* is a cross-sectional illustration of the injection of a hardenable fluidic sealing material through the apparatus of FIG. 8*c*.

As illustrated in FIG. 8*d*, a hardenable fluidic sealing material 1120 may then be injected through the apparatus 1000 through the passages 1010, 1020, 1040, and 1070 into the annulus between the apparatus and the wellbore 10. In this manner, an annular barrier to fluid migration into and out of the wellbore 10 may be formed around the radially expanded expansion cone launcher 1060 and expandable tubular member 1080. The hardenable fluidic sealing material may include, for example, a cement mixture. In several alternative embodiments, the injection of the hardenable fluidic sealing material 1120 may be omitted. In several alternative embodiments, the hardenable fluidic sealing material 1120 is compressible, before, during and/or after, the curing process.

Figure 8E:
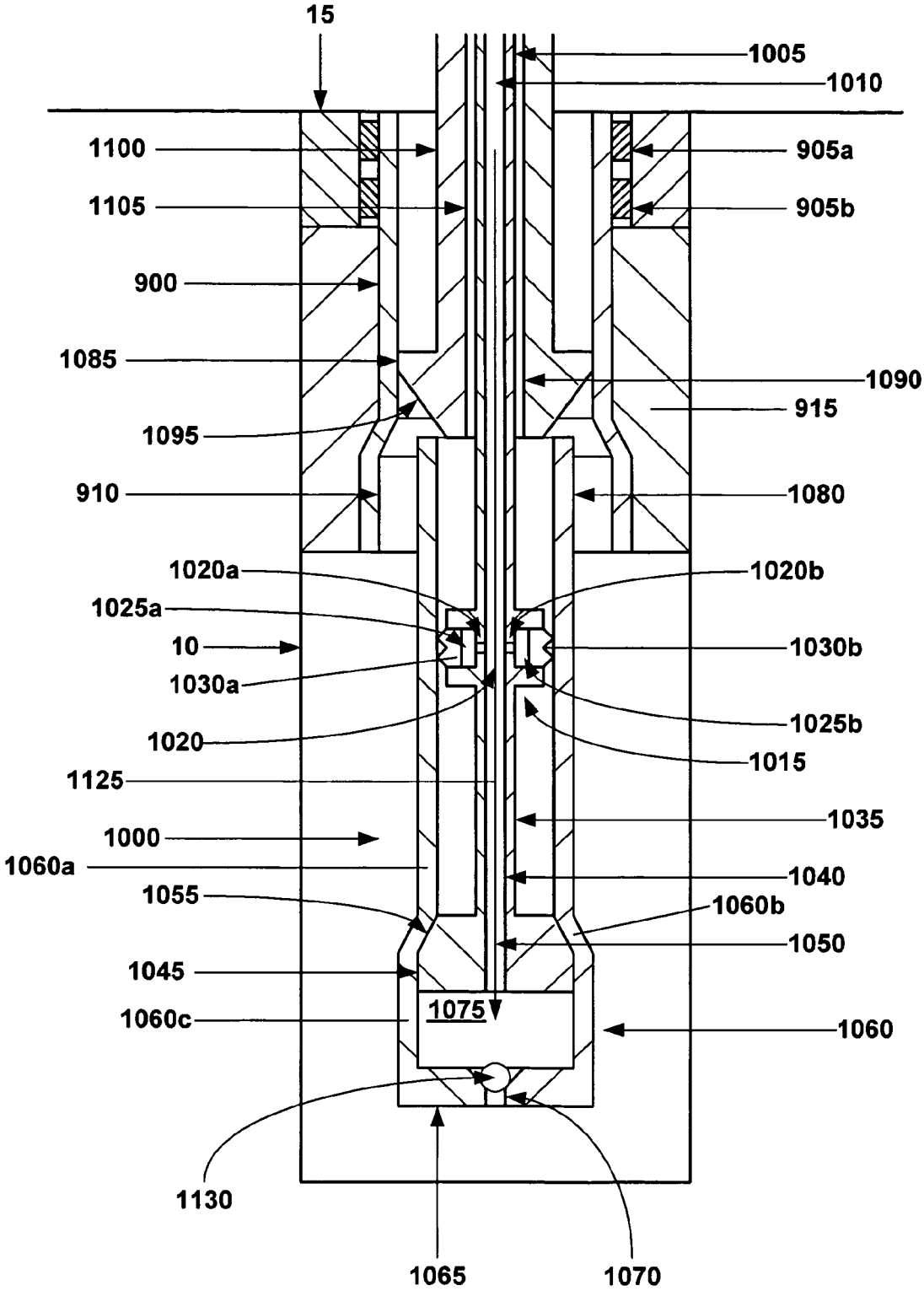
FIG. 8*e* is cross-sectional illustration of the isolation of the region below the expansion cone and within the expansion cone launcher of the apparatus of FIG. 8*d*.

As illustrated in FIG. 8*e*, a non-hardenable fluidic material 1125 may then be injected into the apparatus 1000 through the passages 1010, 1020 and 1040. A ball plug 1130, or other similar device, may then be injected with the fluidic material 1125 to thereby seal off the passage 1070. In this manner, the region 1075 may be pressurized by the continued injection of the fluidic material 1125 into the apparatus 1000. Furthermore, in this manner, the actuating chambers, 1025*a* and 1025*b*, of the locking device 1015 may be pressurized. In this manner, the tubular member 1080 may be held in a substantially stationary position by the locking device 1015.

Figure 8F:
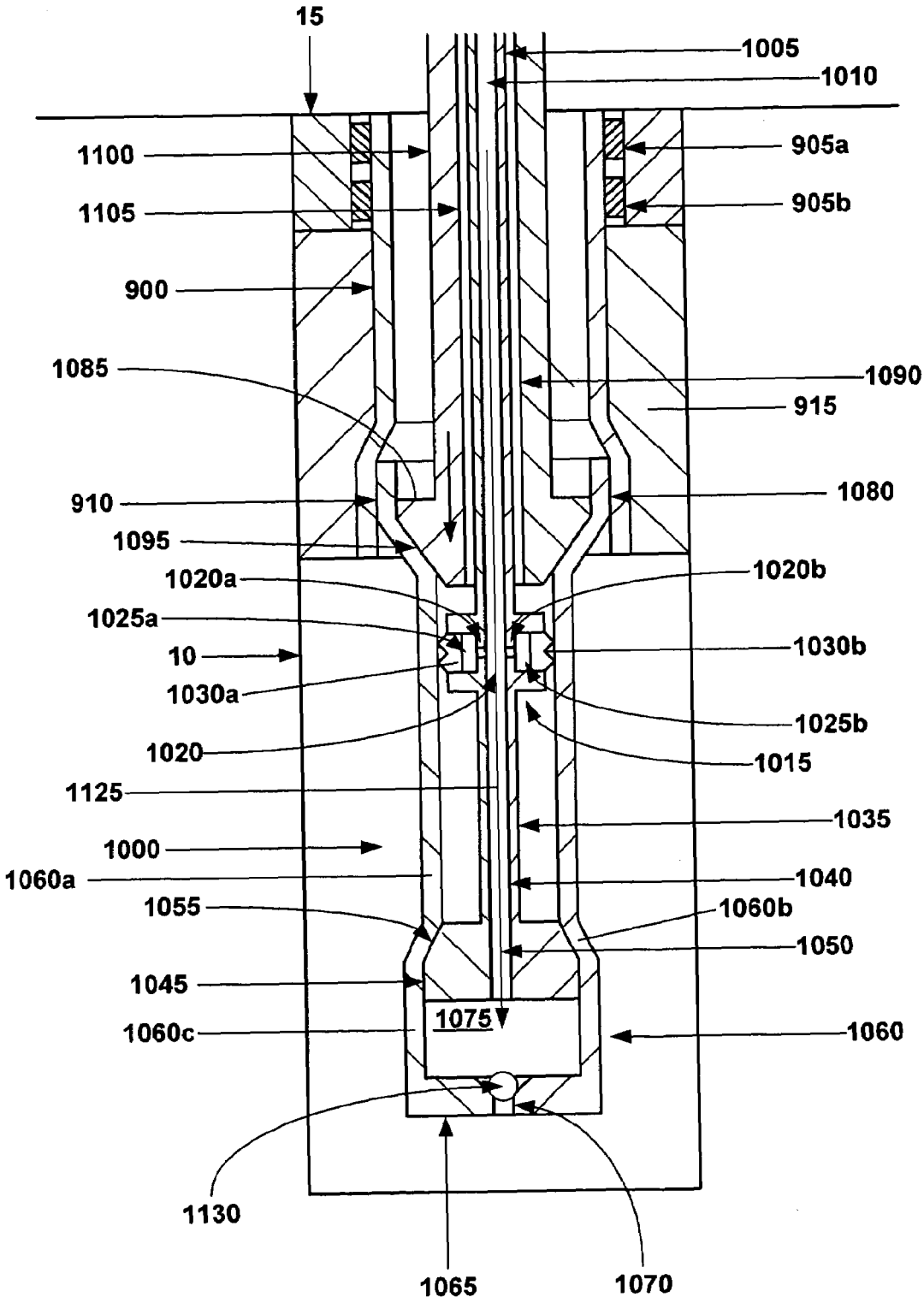
FIG. 8*f* is a cross-sectional illustration of the plastic deformation and radial expansion of the upper portion of the expandable tubular member of the apparatus of FIG. 8*e*.

As illustrated in FIG. 8*f*, the expansion cone 1085 may then be actuated in the downward direction by a direct application of axial force using the support member 1100 and/or through the application of fluid force. The axial displacement of the expansion cone 1085 may plastically deform and radially expand the upper portion of the expandable tubular member 1080. In this manner, the upper portion of the expandable tubular member 1080 may be precisely coupled to the recess 910 of the preexisting casing 900.

During the downward actuation of the expansion cone 1085, the locking member 1015 preferably prevents axial displacement of the tubular member 1080. In a preferred embodiment, the locking member 1015 is positioned proximate the upper portion of the tubular member 1080 in order to prevent buckling of the tubular member 1080 during the radial expansion of the upper portion of the tubular member. In an alternative embodiment, the locking member 1015 is omitted and the interference between the intermediate portion 1060*b* of the expansion cone launcher 1060 and the expansion cone 1045 prevents the axial displacement of the tubular member 1080 during the radial expansion of the upper portion of the tubular member.

Figure 8G:
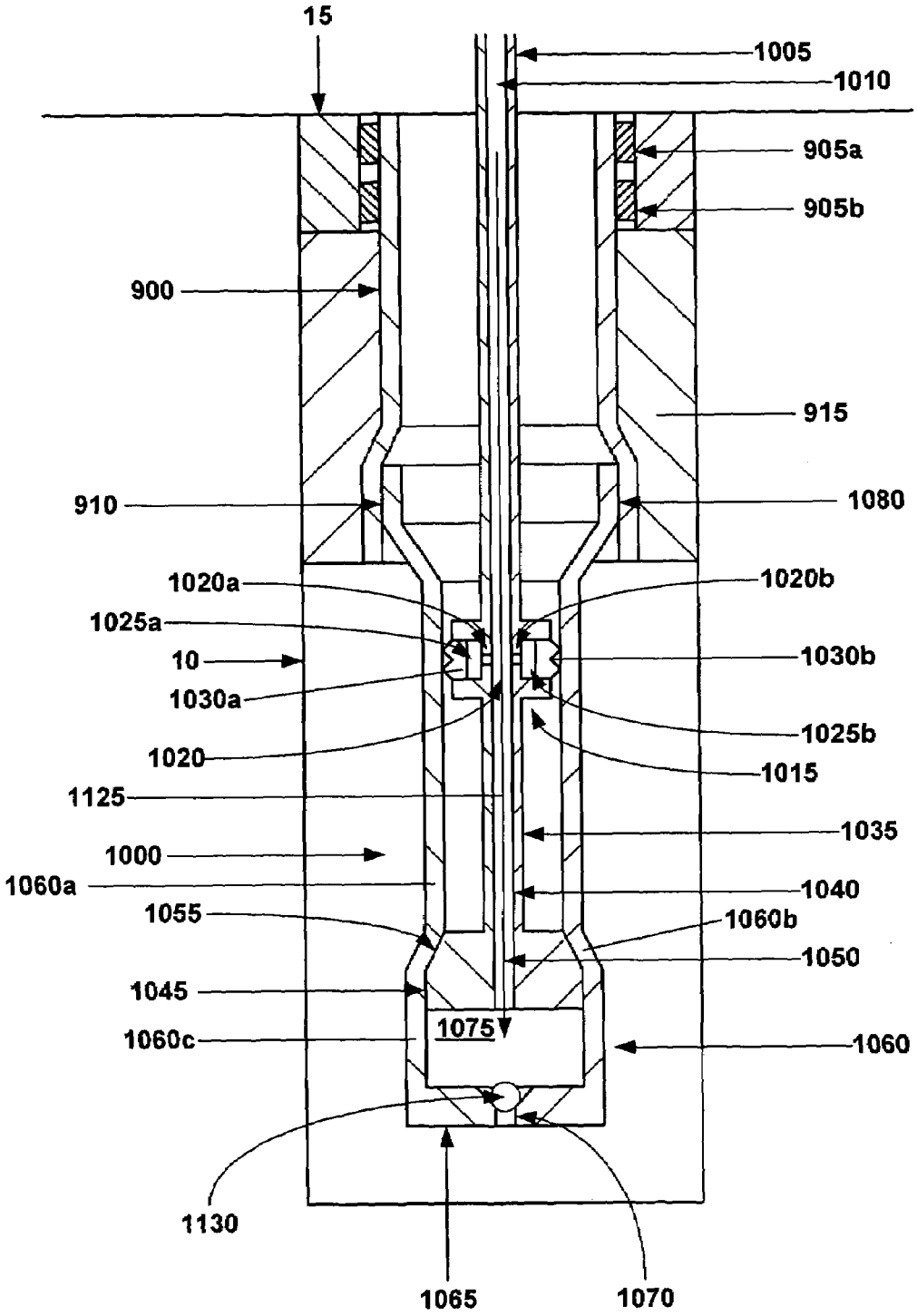
FIG. 8*g* is a cross-sectional illustration of the removal of the upper expansion cone from the wellbore of FIG. 8*f*.

As illustrated in FIG. 8*g*, the expansion cone 1085 and 1100 may then be raised out of the wellbore 10.

Figure 8H:
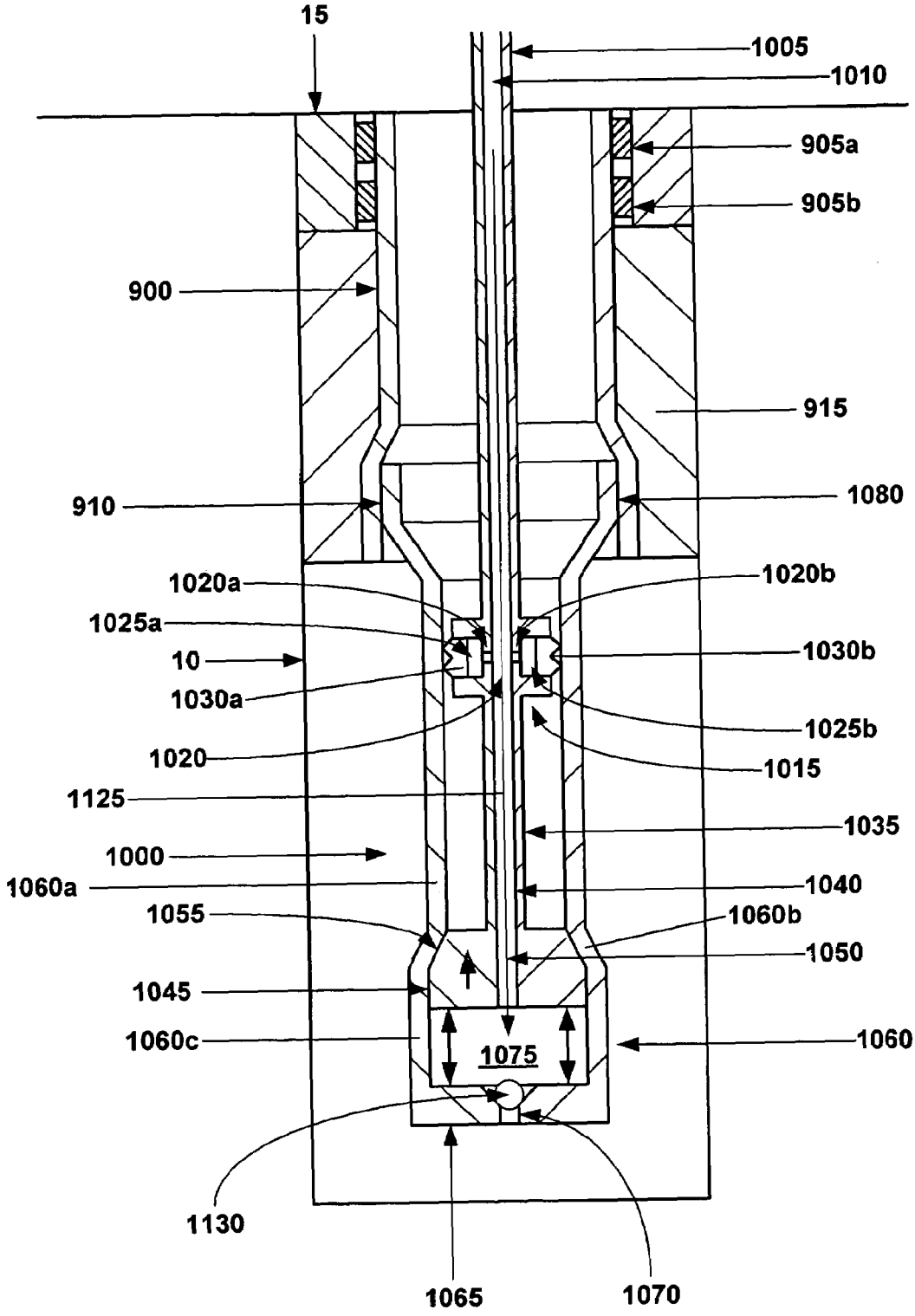
FIG. 8*h* is a cross-sectional illustration of the continued pressurization of the region below the expansion cone of the apparatus of FIG. 8*g* to thereby plastically deform and radially expand the expansion cone launcher and expandable tubular member.

As illustrated in FIG. 8*h*, the continued injection of the fluidic material 1125 into the apparatus 1000 may then cause the expansion cone launcher 1060 and the expandable tubular member 1080 to be plastically deformed and radially expanded off of the expansion cone 1045. In this manner, the expansion cone 1045 is displaced relative to the expansion cone launcher 1060 and expandable tubular member 1080 in the axial direction. In a preferred embodiment, the axial forces created during the radial expansion process are greater than the axial forces generated by the locking device 1015. As will be recognized by persons having ordinary skill in the art, the precise relationship between these axial forces will vary as a function of the operating characteristics of the locking device 1015 and the metallurgical properties of the expansion cone launcher 1060 and expandable tubular 1080. In an alternative embodiment, the operating pressures of the actuating chambers, 1025*a* and 1025*b*, and the region 1075 are separately controllable by providing separate and dedicated fluid passages for pressurizing each.

Figure 8I:
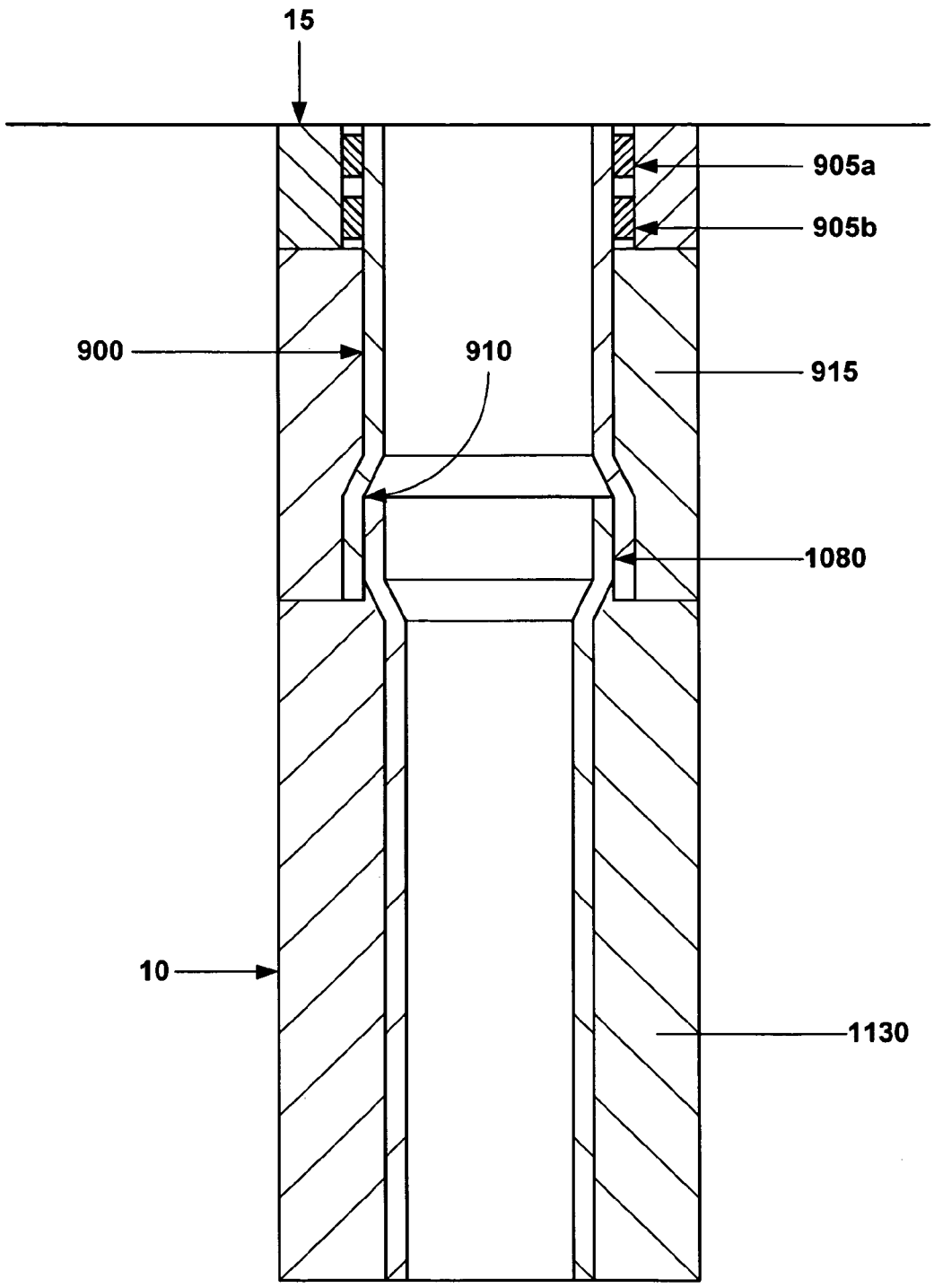
FIG. 8*i* is a cross-sectional illustration of the completion of the initial radial expansion process of the apparatus of FIG. 8*h*.

As illustrated in FIG. 8*i*, after completing the plastic deformation and radial expansion of the tubular member 1080, the hardenable fluidic sealing material is allowed to cure to thereby form an annular body 1130 that provides a barrier to fluid flow into or out of the wellbore 10. The shoe 1065 may then removed by drilling out the shoe using a conventional drilling device. A new section of the wellbore 10 may also be drilled out in order to permit additional expandable tubular members to be coupled to the bottom portion of the plastically deformed and radially expanded tubular member 1080.

In an alternative embodiment, the annular body 1130 may be omitted. In several alternative embodiments, the annular body 1130 may be radially compressed before, during and/or after curing.

Figure 8J:
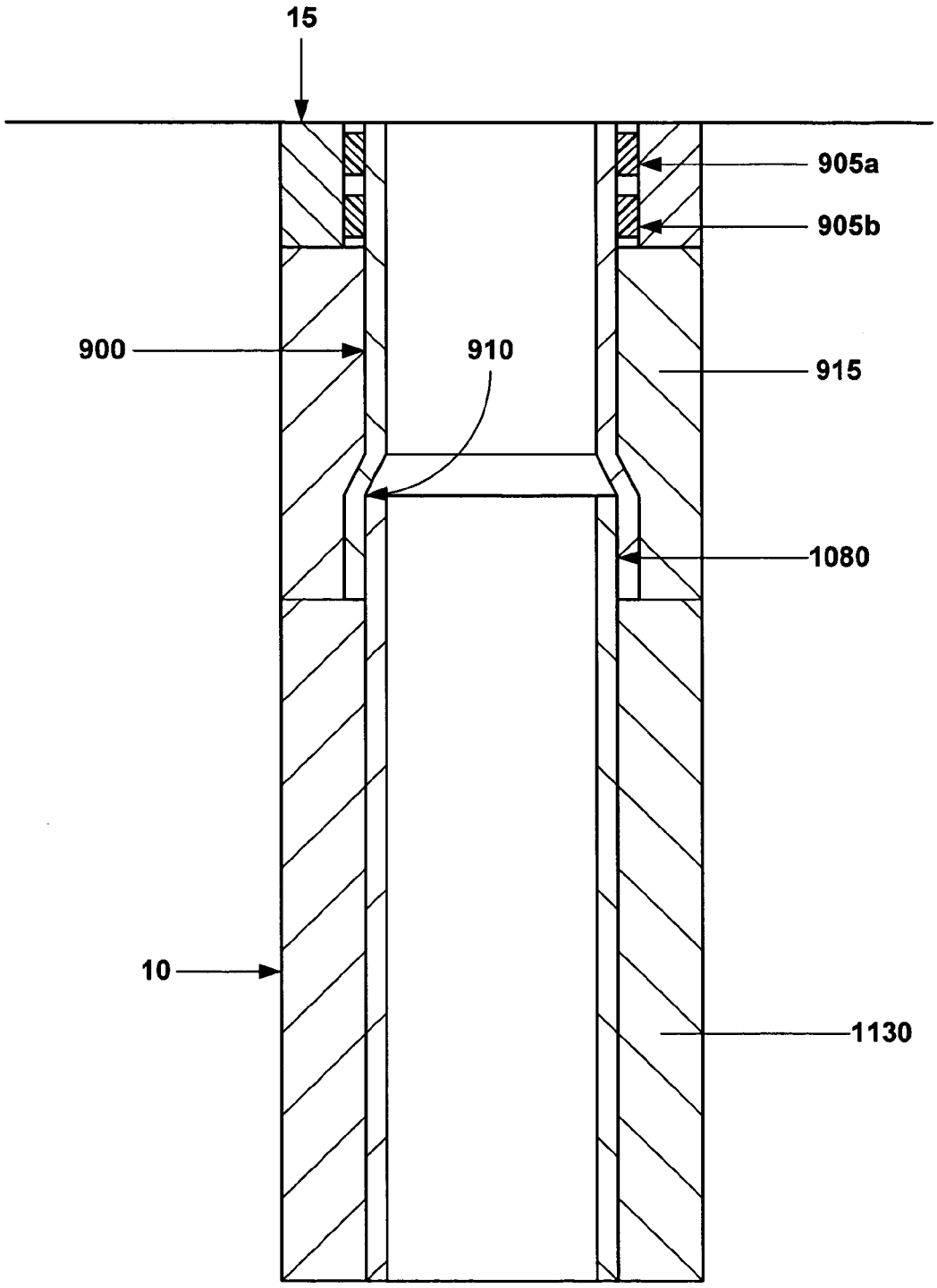
FIG. 8*j* is a cross-sectional illustration of the further radial expansion of the apparatus of FIG. 8*i* in order to form a mono-diameter wellbore casing.

Referring to FIG. 8*j*, the tubular member 1080 may be radially expanded again using one or more of the methods described above to provide an mono-diameter wellbore casing.

Figure 9A:
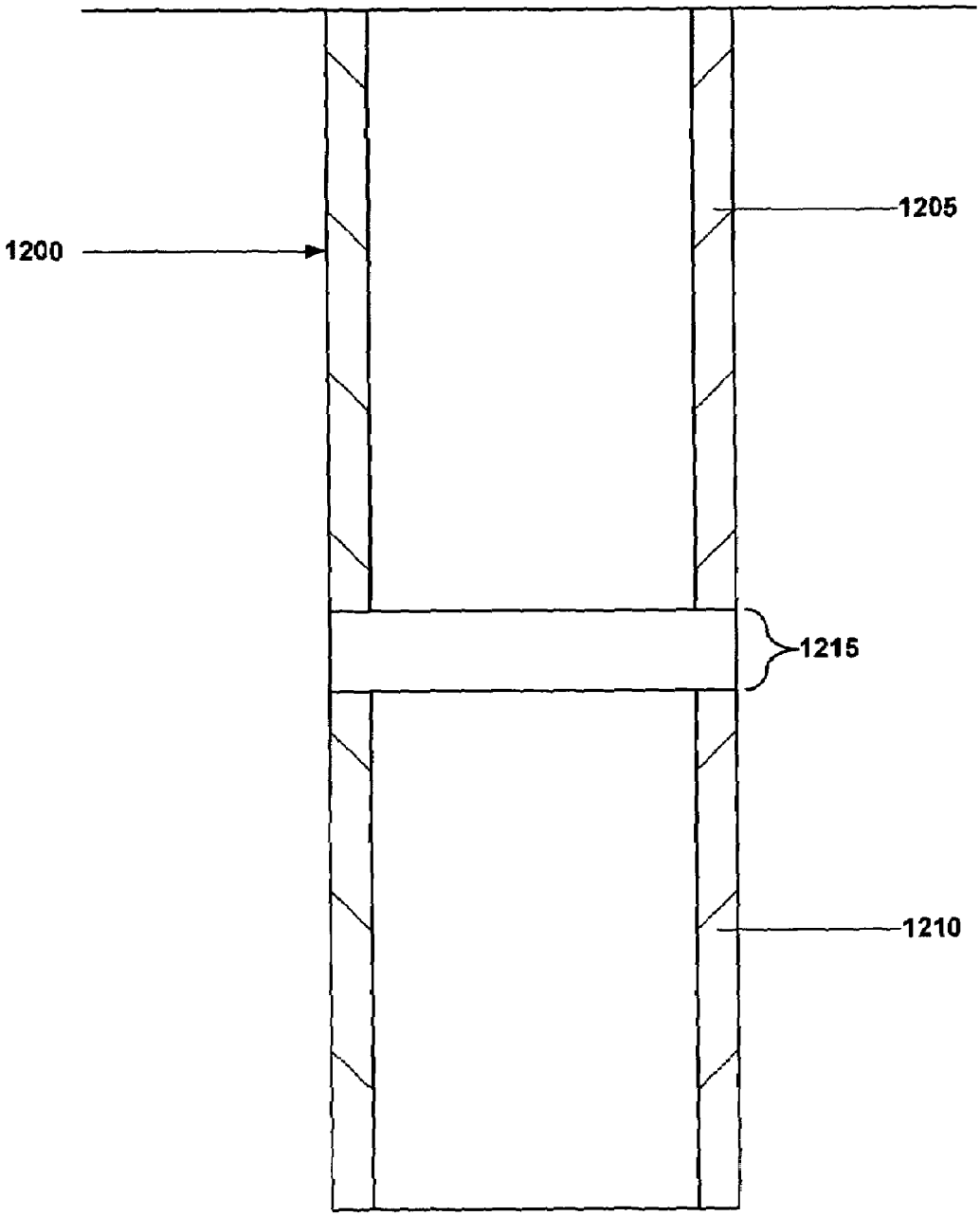
FIG. 9*a* is a cross-sectional illustration of a wellbore including upper and lower preexisting wellbore casings that are separated by an axial gap.

Referring to FIG. 9*a*, a wellbore 1200 includes an upper preexisting casing 1205 and a lower preexisting casing 1210. The casings, 1205 and 1210, may further include outer annular layers of fluidic sealing materials such as, for example, cement. The ends of the casings, 1205 and 1210, are separated by a gap 1215.

Figure 9B:
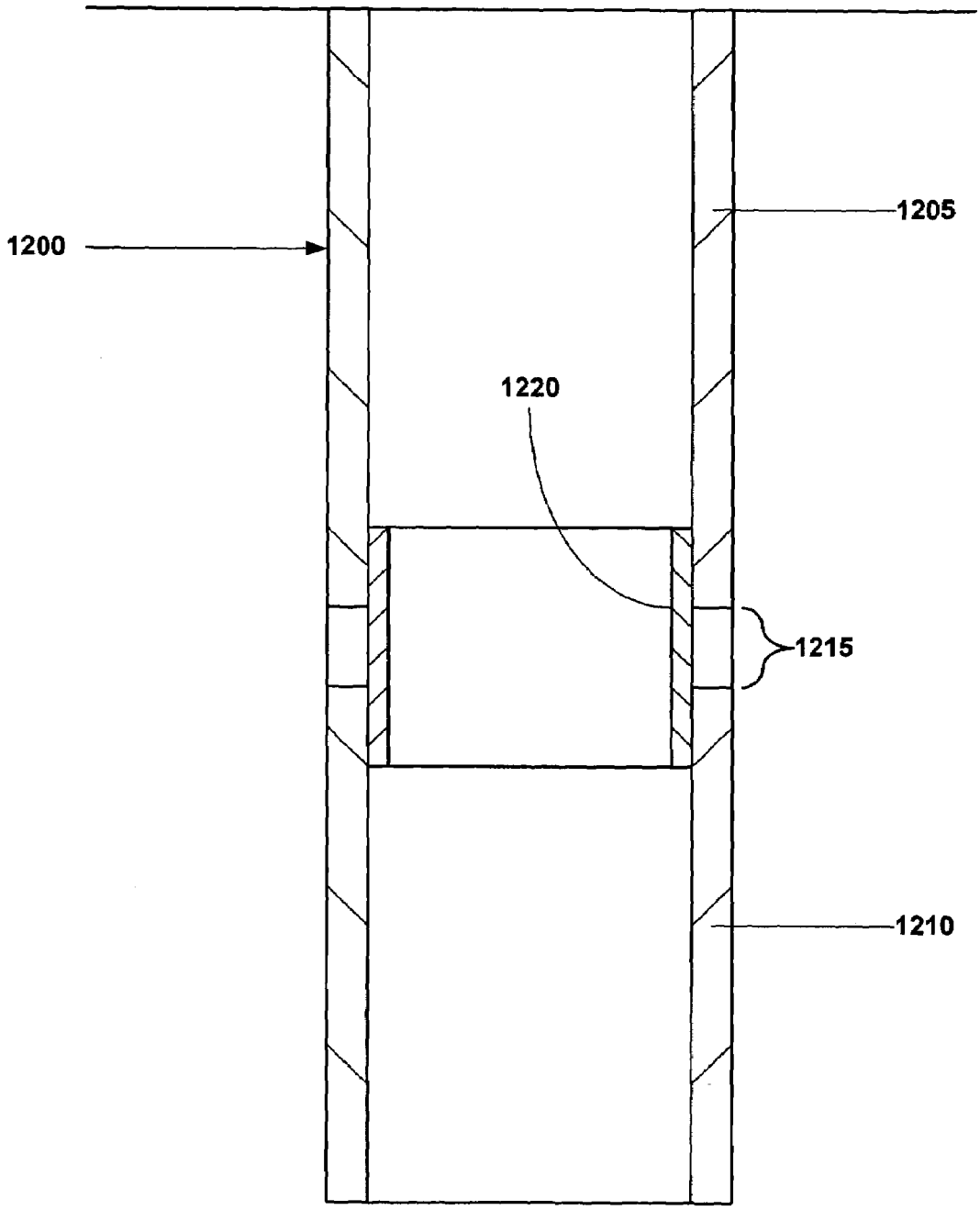
FIG. 9*b* is a cross-sectional illustration of the coupling of a tubular member to the opposing ends of the wellbore casings of FIG. 9*a*.

Referring to FIG. 9*b*, a tubular member 1220 may then be coupled to the opposing ends of the casings, 1205 and 1210, to thereby bridge the gap 1215. In a preferred embodiment, the tubular member 1220 is coupled to the opposing ends of the casings, 1205 and 1210, by plastically deforming and radially expanding the tubular member 1220 using one or more of the methods and apparatus described and referenced above.

Figure 9C:
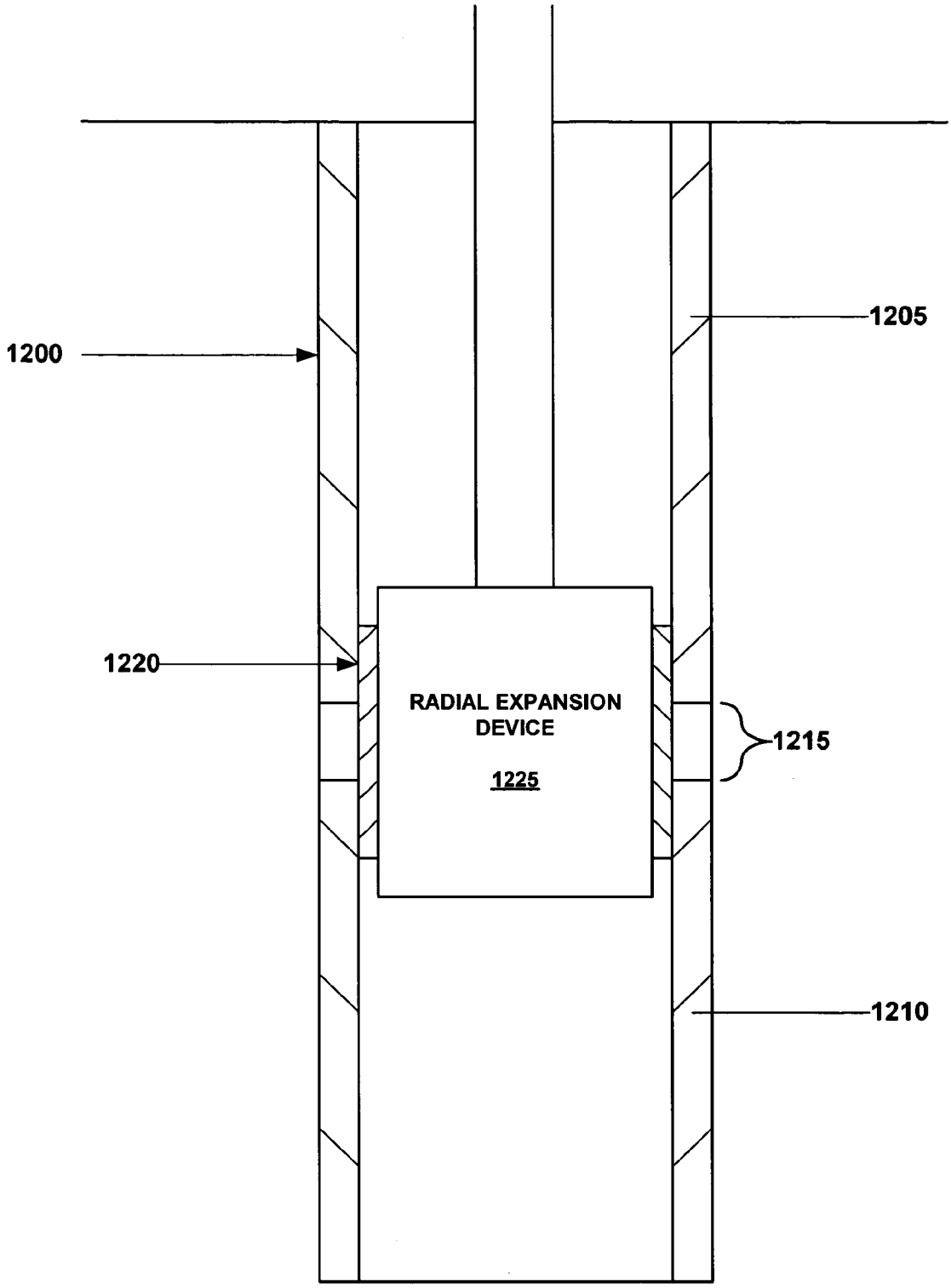
FIG. 9*c* is a fragmentary cross-sectional illustration of the placement of a radial expansion device into the tubular member of FIG. 9*b*.

Referring to FIG. 9*c*, a radial expansion device 1225 may then be positioned within the tubular member 1220. In a preferred embodiment, the length of the radial expansion device 1225 is greater than or equal to the axial length of the tubular member 1220. In several alternative embodiments, the radial expansion device 1225 may be any number of conventional radial expansion devices such as, for example, expansion cones actuated by hydraulic and/or direct axial force, roller expansion devices, and/or expandable hydraulic bladders.

Figure 9D:
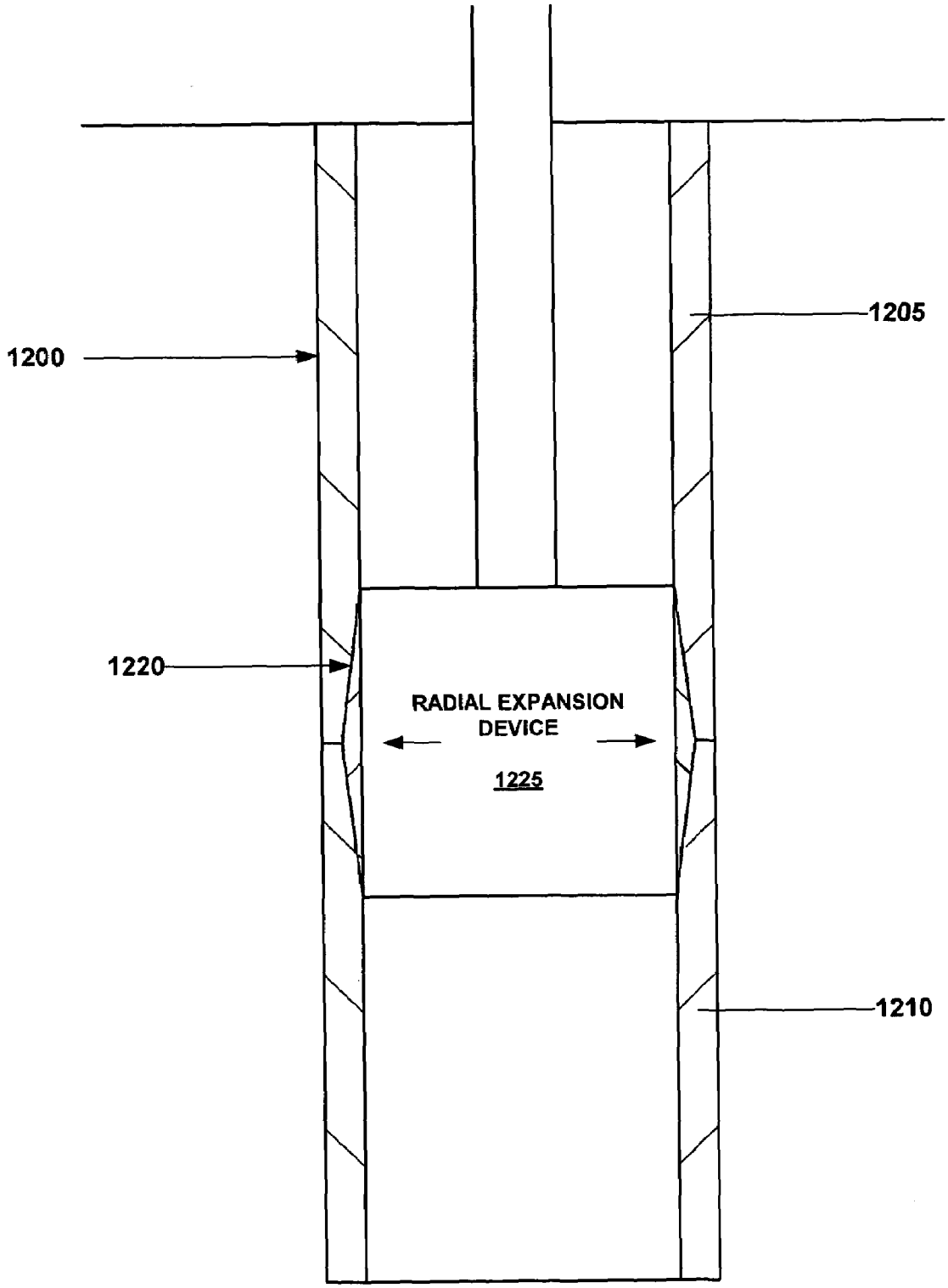
FIG. 9*d* is a fragmentary cross-sectional illustration of the actuation of the radial expansion device of FIG. 9*c*.
Figure 9E:
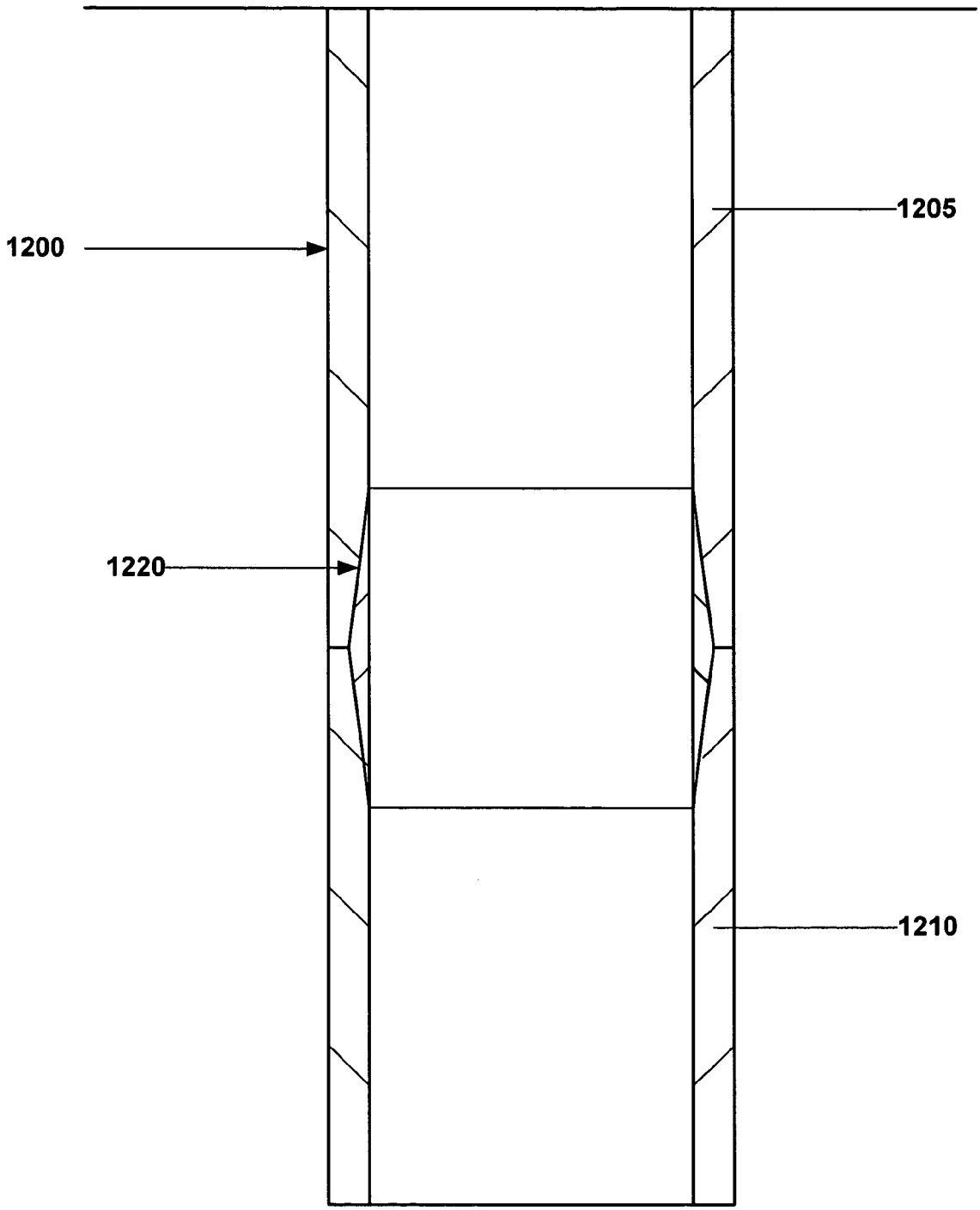
FIG. 9*e* is a cross-sectional of a mono-diameter wellbore casing generated by the actuation of the radial expansion device of FIG. 9*d*.

Referring to FIGS. 9*d* and 9*e*, after actuation and subsequent de-actuation and removal of the radial expansion device 1225, the inside diameters of the casings, 1205 and 1210, are substantially equal to the inside diameter of the tubular member 1220. In this manner, a mono-diameter wellbore casing may be formed.

Figure 10:
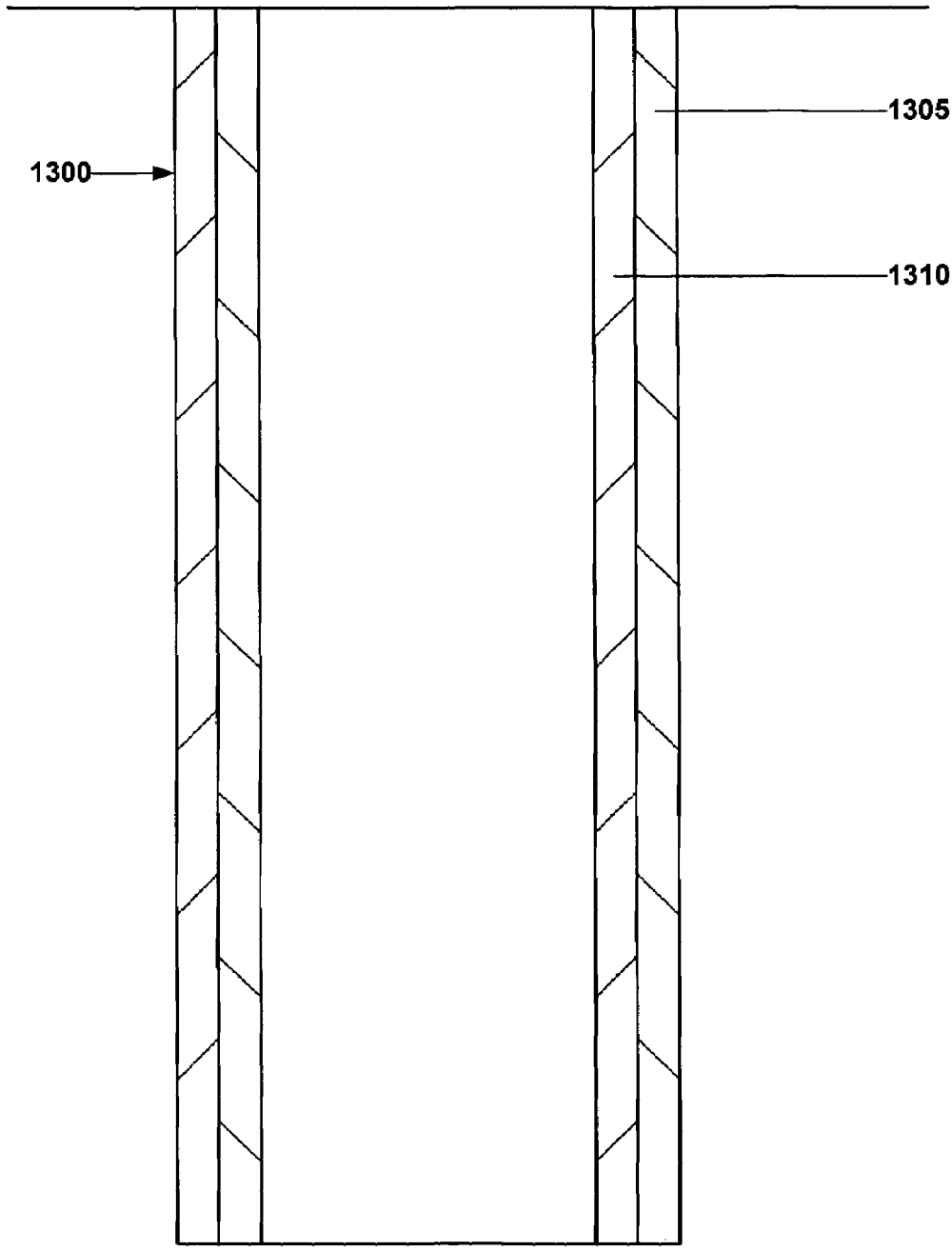
FIG. 10 is a cross-sectional illustration of a mono-diameter wellbore casing that includes a plurality of layers of radially expanded tubular members along at least a portion of the its length.

Referring to FIG. 10, a wellbore 1300 includes an outer tubular member 1305 and an inner tubular member 1310. In a preferred embodiment, the tubular members, 1305 and 1310, are plastically deformed and radially expanded using one or more of the methods and apparatus described and referenced above. In this manner, a wellbore casing may be provided whose burst and collapse strength may be precisely controlled by varying the number, thickness, and/or material properties of the tubular members, 1305 and 1310.

Figure 11A:
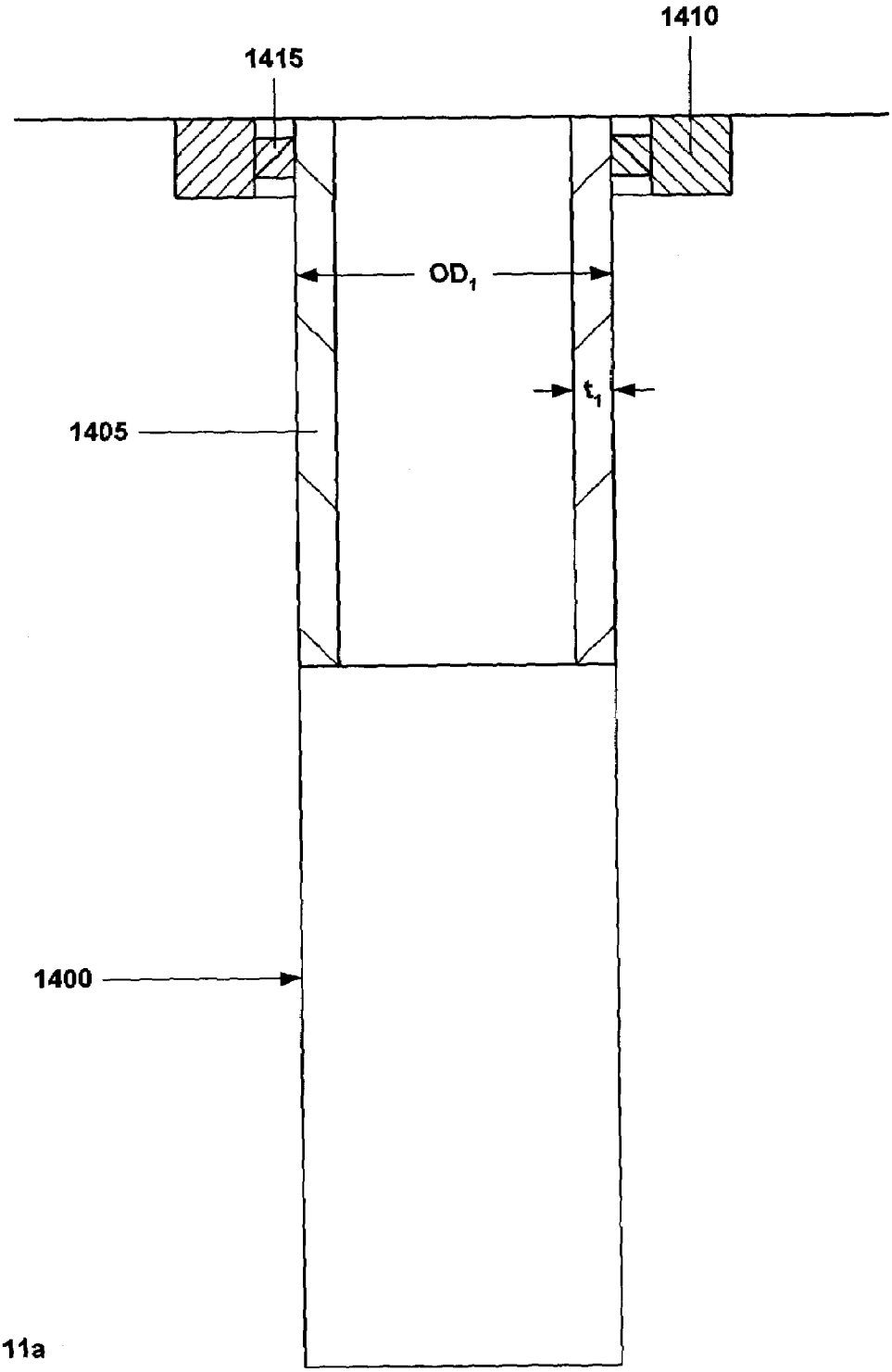
FIG. 11*a* is a cross-sectional illustration of a wellbore including a casing formed by plastically deforming and radially expanding a first tubular member.

Referring to FIG. 11*a*, a wellbore 1400 includes a casing 1405 that is coupled to a preexisting casing 1410. In a preferred embodiment, one or more sealing members 1415 are coupled to the exterior of the upper portion of the tubular member 1405 in order to optimally seal the interface between the tubular member 1405 and the preexisting casing 1410. In a preferred embodiment, the tubular member 1405 is plastically deformed and radially expanded using conventional methods and/or one or more of the methods and apparatus described and referenced above. In an exemplary embodiment, the outside diameter of the tubular member 1405 prior to the radial expansion process is $OD_0$, the wall thickness of the tubular member 1405 prior to the radial expansion process is $t_0$, the outside diameter of the tubular member following the radial expansion process is $OD_1$, and the wall thickness of the tubular member following the radial expansion process is $t_1$.

Figure 11B:
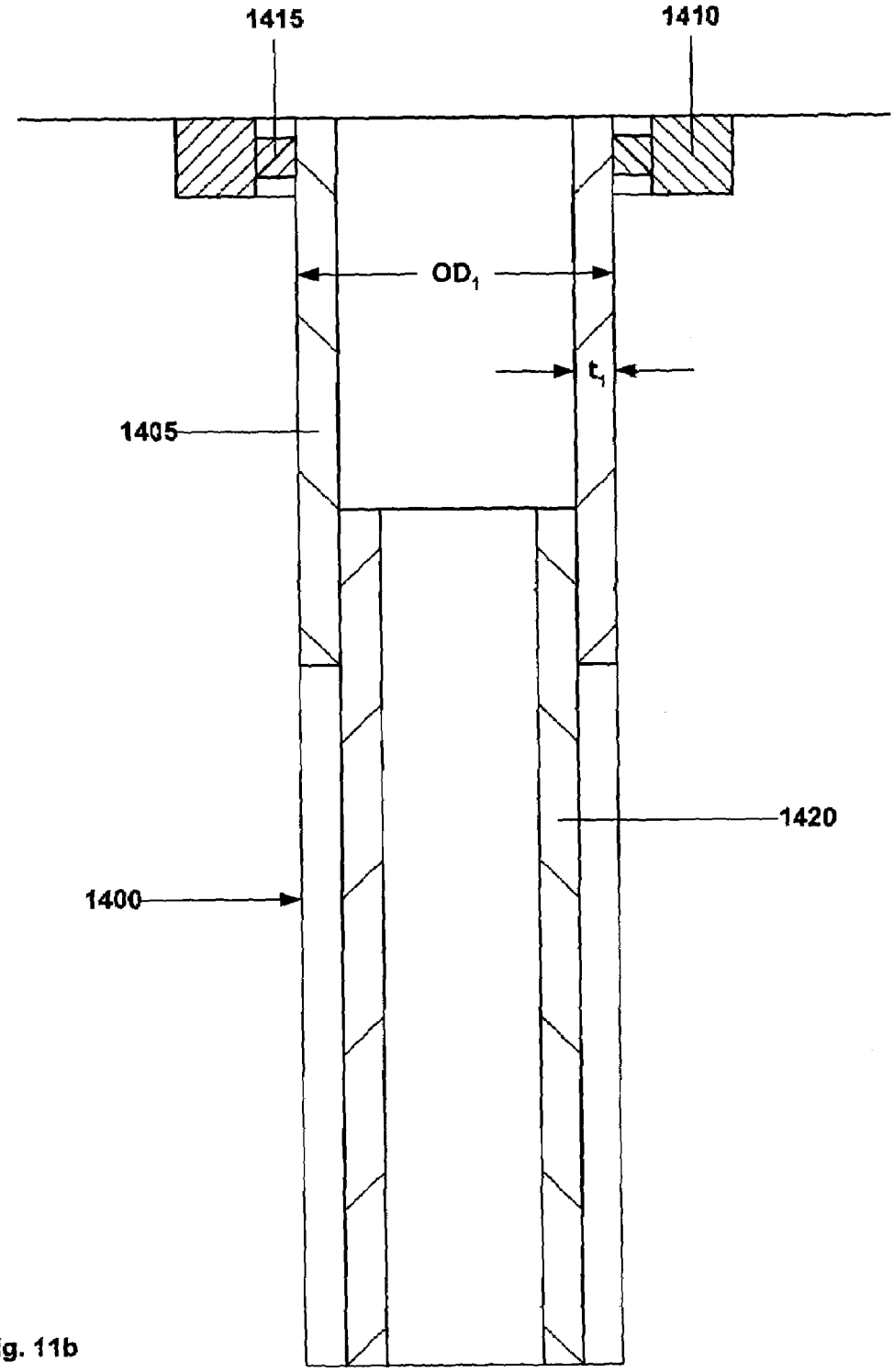
FIG. 11*b* is a cross-sectional illustration of a wellbore including another casing coupled to the preexisting casing by plastically deforming and radially expanding a second tubular member.

Referring to FIG. 11*b*, a tubular member 1420 may then be coupled to the lower portion of the tubular member 1405 by plastically deforming and radially expanding the tubular member 1420 using conventional methods and/or one or more of the methods and apparatus described and referenced above. In a preferred embodiment, the exterior surface of the upper portion of the tubular member 1420 includes one or more sealing members for sealing the interface between the tubular member 1420 and the tubular member 1405.

Figure 11C:
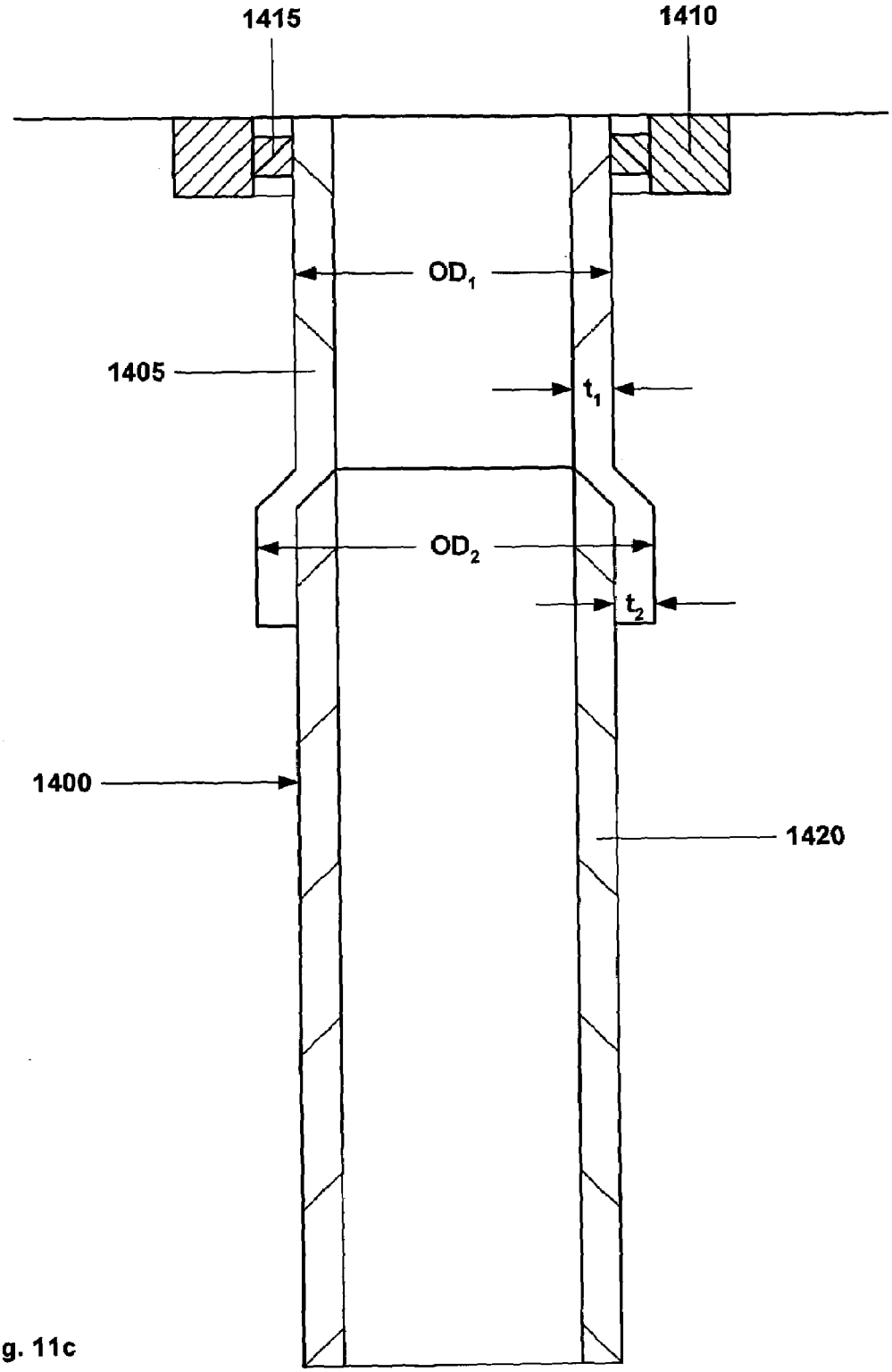
FIG. 11*c* is a cross-sectional illustration of a mono-diameter wellbore casing formed by radially expanding the second tubular member a second time.

Referring to FIG. 11*c*, lower portion of the tubular member 1405 and the tubular member 1420 may be radially expanded again to provide a mono-diameter wellbore casing. The additional radial expansion may be provided using conventional methods and/or one or more of the methods and apparatus described and referenced above. In an exemplary embodiment, the outside diameter and wall thickness of the lower portion of the tubular member 1405 after the additional radial expansion process are $OD_2$ and $t_2$.

The radial expansion process of FIGS. 11*b*–11*c* can then be repeated to provide a mono-diameter wellbore casing of virtually unlimited length.

In several alternative embodiments, the ordering of the radial expansions of the tubular members, 1405 and 1420, may be changed. For example, the first tubular member 1405 may be plastically deformed and radially expanded to provide a lower portion having the outside diameter $OD_2$ and the remaining portion having the outside diameter $OD_1$. The tubular member 1420 may then be plastically deformed and radially expanded one or more times until the inside diameters of the tubular members, 1405 and 1420, are substantially equal. The plastic deformations and radial expansions of the tubular members, 1405 and 1420, may be provided using conventional methods and/or one or more of the methods and apparatus described and referenced above.

In an exemplary embodiment, the total expansion strain E of the tubular member 1405 may be expressed by the following equation:

$$E=(OD_2-OD_0)/OD_0 \quad (1)$$

where $OD_0$=original outside diameter;

$OD_1$=outside diameter after $1^{st}$ radial expansion; and $OD_2$=outside diameter after $2^{nd}$ radial expansion.

Furthermore, in an exemplary embodiment, where: (1) the exterior surface of the upper portion of the tubular member 1420 includes sealing members, and (2) the radial spacing between the tubular member 1405 and the wellbore 1400 prior to the first radial expansion is equal to d, the outside diameters, $OD_1$ and $OD_2$, of the tubular member 1405 following the first and second radial expansions may be expressed as:

$$OD_1=OD_0+2d+2t_1 \quad (2)$$

$$OD_2=OD_1+2R+2t_2 \quad (2)$$

where $OD_0$=the original outside diameter of the tubular member 1405;

$OD_1$=the outside diameter of the tubular member 1405 following the first radial expansion;

$OD_2$=the outside diameter of the tubular member 1405 following the second radial expansion;

d=the radial spacing between the tubular member 1405 and the wellbore prior to the first radial expansion;

$t_1$=the wall thickness of the tubular member 1405 after the first radial expansion;

$t_2$=the wall thickness of the tubular member 1405 after the second radial expansion; and R=the thickness of sealing member provided on the exterior surface of the tubular member 1420.

Furthermore, in an exemplary embodiment, for d approximately equal to 0.25 inches and R approximately equal to 0.1 inches, equation (1) can be approximated as:

$$E=(0.7''+3.7t_0)/OD_0 \quad (4)$$

where $t_0$=the original wall thickness of the tubular member 1405.

In an exemplary embodiment, the total expansion strain of the tubular member 1405 should be less than or equal to 0.3 in order to maximize the burst and collapse strength of the expandable tubular member. Therefore, from equation (4) the ratio of the original outside diameter to the original wall thickness ($OD_0/t_0$) may be expressed as:

$$OD_0/t_0 \geq 3.8/(0.3-0.7/OD_0) \quad (5)$$

Thus, in a preferred embodiment, for $OD_0$ less than 10 inches, the optimal ratio of the original outside diameter to the original wall thickness ($OD_0/t_0$) may be expressed as:

$$OD_0/t_0 \geq 16 \quad (6)$$

In this manner, for typical tubular members, the burst and collapse strength of the tubular members following one or more radial expansions are maximized when the relationship in equation (6) is satisfied. Furthermore, the relationships expressed in equations (1) through (6) are valid regardless of the order or type of the radial expansions of the tubular member 1405. More generally, the relationships expressed in equations (1) through (6) may be applied to the radial expansion of structures having a wide range of profiles such as, for example, triangular, rectangular, and oval.

An apparatus for plastically deforming and radially expanding a tubular member has been described that includes means for plastically deforming and radially expanding a first portion of the tubular member to a first outside diameter, and means for plastically deforming and radially expanding a second portion of the tubular member to a second outside diameter. In a preferred embodiment, the first outside diameter is greater than the second outside diameter. In a preferred embodiment, the means for plastically deforming and radially expanding the first portion of the tubular member to the first outside diameter is removable. In a preferred embodiment, the means for plastically deforming and radially expanding the first portion of the tubular member to the first outside diameter is frangible. In a preferred embodiment, the means for plastically deforming and radially expanding the first portion of the tubular member to the first outside diameter is elastic. In a preferred embodiment, the means for plastically deforming and radially expanding the first portion of the tubular member to the first outside diameter includes means for applying a radial force to the first portion of the tubular member. In a preferred embodiment, the means for plastically deforming and radially expanding the first portion of the tubular member to the first outside diameter is inflatable. In a preferred embodiment, the means for plastically deforming and radially expanding the first portion of the tubular member to the first outside diameter includes rolling means for applying radial pressure to the first portion of the tubular member.

An apparatus for plastically deforming and radially expanding a tubular member has also been described that includes a tubular support member including a first fluid passage, an expansion cone coupled to the tubular support member having a second fluid passage fluidicly coupled to the first fluid passage and an outer conical surface, a removable annular conical sleeve coupled to the outer conical surface of the expansion cone, an annular expansion cone launcher coupled to the conical sleeve and a lower portion of the tubular member, and a shoe having a valveable passage coupled to an end of the expansion cone launcher. In a preferred embodiment, the conical sleeve is frangible. In a preferred embodiment, the conical sleeve is elastic. In a preferred embodiment, the conical sleeve includes a plurality of arcuate elements.

A method of plastically deforming and radially expanding a tubular member has also been described that includes plastically deforming and radially expanding a portion of the tubular member to a first outside diameter, and plastically deforming and radially expanding another portion of the tubular member to a second outside diameter. In a preferred embodiment, the first diameter is greater than the second diameter. In a preferred embodiment, plastically deforming and radially expanding the portion of the tubular member includes applying a radial force to the portion of the tubular member using a conical sleeve. In a preferred embodiment, conical sleeve is frangible. In a preferred embodiment, the conical sleeve is elastic. In a preferred embodiment, the conical sleeve includes a plurality of arcuate elements. In a preferred embodiment, plastically deforming and radially expanding the portion of the tubular member includes applying a radial force to the portion of the tubular member using an inflatable bladder. In a preferred embodiment, plastically deforming and radially expanding the portion of the tubular member includes applying a radial force to the portion of the tubular member using a roller expansion device.

A method of coupling a first tubular member to a second tubular member has also been described that includes plastically deforming and radially expanding a first portion of the first tubular member to a first outside diameter, plastically deforming and radially expanding another portion of the first tubular member to a second outside diameter, positioning the second tubular member inside the first tubular member in overlapping relation to the first portion of the first tubular member, plastically deforming and radially expanding the second tubular member to a third outside diameter, and plastically deforming and radially expanding the second tubular member to a fourth outside diameter. The inside diameters of the first and second tubular members after the plastic deformations and radial expansions are substantially equal. In a preferred embodiment, the first outside diameter is greater than the second outside diameter. In a preferred embodiment, plastically deforming and radially expanding the first portion of the first tubular member includes applying a radial force to the portion of the tubular member using a conical sleeve. In a preferred embodiment, the conical sleeve is frangible. In a preferred embodiment, the conical sleeve is elastic. In a preferred embodiment, the conical sleeve includes a plurality of arcuate elements. In a preferred embodiment, plastically deforming and radially expanding the first portion of the first tubular member includes applying a radial force to the first portion of the first tubular member using an inflatable bladder. In a preferred embodiment, plastically deforming and radially expanding the first portion of the first tubular member includes applying a radial force to the first portion of the first tubular member using a roller expansion device.

An apparatus for coupling a first tubular member to a second tubular member has also been described that includes means for plastically deforming and radially expanding a first portion of the first tubular member to a first outside diameter, means for plastically deforming and radially expanding another portion of the first tubular member to a second outside diameter, means for positioning the second tubular member inside the first tubular member in overlapping relation to the first portion of the first tubular member, means for plastically deforming and radially expanding the second tubular member to a third outside diameter, and means for plastically deforming and radially expanding the second tubular member to a fourth outside diameter. The inside diameters of the first and second tubular members after the plastic deformations and radial expansions are substantially equal. In a preferred embodiment, the first outside diameter is greater than the second outside diameter. In a preferred embodiment, the means for plastically deforming and radially expanding the first portion of the first tubular member includes means for applying a radial force to the portion of the tubular member using a conical sleeve. In a preferred embodiment, the conical sleeve is frangible. In a preferred embodiment, the conical sleeve is elastic. In a preferred embodiment, the conical sleeve includes a plurality of arcuate elements. In a preferred embodiment, the means for plastically deforming and radially expanding the first portion of the first tubular member includes means for applying a radial force to the first portion of the first tubular member using an inflatable bladder. In a preferred embodiment, the means for plastically deforming and radially expanding the first portion of the first tubular member includes means for applying a radial force to the first portion of the first tubular member using a roller expansion device.

An apparatus for forming a wellbore casing within a wellbore has also been described that includes means for supporting a tubular member within the wellbore, means for plastically deforming and radially expanding a first portion of the tubular member to a first outside diameter, and means for plastically deforming and radially expanding a second portion of the tubular member to a second outside diameter. In a preferred embodiment, the first outside diameter is greater than the second outside diameter. In a preferred embodiment, the means for plastically deforming and radially expanding the first portion of the tubular member to the first outside diameter is removable. In a preferred embodiment, the means for plastically deforming and radially expanding the first portion of the tubular member to the first outside diameter is frangible. In a preferred embodiment, the means for plastically deforming and radially expanding the first portion of the tubular member to the first outside diameter is elastic. In a preferred embodiment, the means for plastically deforming and radially expanding the first portion of the tubular member to the first outside diameter includes means for applying a radial force to the first portion of the tubular member. In a preferred embodiment, the means for plastically deforming and radially expanding the first portion of the tubular member to the first outside diameter is inflatable. In a preferred embodiment, the means for plastically deforming and radially expanding the first portion of the tubular member to the first outside diameter includes rolling means for applying radial pressure to the first portion of the tubular member. In a preferred embodiment, the apparatus further includes means for forming an annular body of a fluidic sealing material within an annulus between the tubular member and the wellbore.

An apparatus for forming a wellbore casing within a wellbore has also been described that includes a tubular support member including a first fluid passage, an expansion cone coupled to the tubular support member having a second fluid passage fluidicly coupled to the first fluid passage and an outer conical surface, a removable annular conical sleeve coupled to the outer conical surface of the expansion cone, an annular expansion cone launcher coupled to the conical sleeve and a lower portion of the tubular member, and a shoe having a valveable passage coupled to an end of the expansion cone launcher. In a preferred embodiment, the conical sleeve is frangible. In a preferred embodiment, the conical sleeve is elastic. In a preferred embodiment, the conical sleeve includes a plurality of arcuate elements.

A method of forming a wellbore casing within a wellbore has also been described that includes supporting a tubular member within a wellbore, plastically deforming and radially expanding a portion of the tubular member to a first outside diameter, and plastically deforming and radially expanding another portion of the tubular member to a second outside diameter. In a preferred embodiment, the first diameter is greater than the second diameter. In a preferred embodiment, plastically deforming and radially expanding the portion of the tubular member includes applying a radial force to the portion of the tubular member using a conical sleeve. In a preferred embodiment, the conical sleeve is frangible. In a preferred embodiment, the conical sleeve is elastic. In a preferred embodiment, the conical sleeve includes a plurality of arcuate elements. In a preferred embodiment, plastically deforming and radially expanding the portion of the tubular member includes applying a radial force to the portion of the tubular member using an inflatable bladder. In a preferred embodiment, plastically deforming and radially expanding the portion of the tubular member includes applying a radial force to the portion of the tubular member using a roller expansion device. In a preferred embodiment, the method further includes injecting an annular body of a hardenable fluidic sealing material into an annulus between the tubular member and the wellbore. In a preferred embodiment, the method further includes curing the annular body of hardenable fluidic sealing material.

A method of forming a mono-diameter wellbore casing within a wellbore has also been described that includes supporting a first tubular member within the wellbore, plastically deforming and radially expanding a first portion of the first tubular member to a first outside diameter, plastically deforming and radially expanding another portion of the first tubular member to a second outside diameter, positioning the second tubular member inside the first tubular member in overlapping relation to the first portion of the first tubular member, plastically deforming and radially expanding the second tubular member to a third outside diameter, and plastically deforming and radially expanding the second tubular member to a fourth outside diameter. The inside diameters of the first and second tubular members after the plastic deformations and radial expansions are substantially equal. In a preferred embodiment, the first outside diameter is greater than the second outside diameter. In a preferred embodiment, plastically deforming and radially expanding the first portion of the first tubular member includes applying a radial force to the portion of the tubular member using a conical sleeve. In a preferred embodiment, the conical sleeve is frangible. In a preferred embodiment, the conical sleeve is elastic. In a preferred embodiment, the conical sleeve includes a plurality of arcuate elements. In a preferred embodiment, plastically deforming and radially expanding the first portion of the first tubular member includes applying a radial force to the first portion of the first tubular member using an inflatable bladder. In a preferred embodiment, plastically deforming and radially expanding the first portion of the first tubular member includes applying a radial force to the first portion of the first tubular member using a roller expansion device. In a preferred embodiment, the method further includes injecting an annular body of a hardenable fluidic sealing material into an annulus between the first tubular member and the wellbore. In a preferred embodiment, the method further includes curing the annular body of hardenable fluidic sealing material. In a preferred embodiment, the method further includes injecting an annular body of a hardenable fluidic sealing material into an annulus between the second tubular member and the wellbore. In a preferred embodiment, the method further includes curing the annular body of hardenable fluidic sealing material.

An apparatus for coupling a first tubular member to a second tubular member has also been described that includes means for plastically deforming and radially expanding a first portion of the first tubular member to a first outside diameter, means for plastically deforming and radially expanding another portion of the first tubular member to a second outside diameter, means for positioning the second tubular member inside the first tubular member in overlapping relation to the first portion of the first tubular member, means for plastically deforming and radially expanding the second tubular member to a third outside diameter, and means for plastically deforming and radially expanding the second tubular member to a fourth outside diameter. The inside diameters of the first and second tubular members after the plastic deformations and radial expansions are substantially equal. In a preferred embodiment, the first outside diameter is greater than the second outside diameter. In a preferred embodiment, the means for plastically deforming and radially expanding the first portion of the first tubular member includes means for applying a radial force to the portion of the tubular member using a conical sleeve. In a preferred embodiment, the conical sleeve is frangible. In a preferred embodiment, the conical sleeve is elastic. In a preferred embodiment, the conical sleeve includes a plurality of arcuate elements. In a preferred embodiment, the means for plastically deforming and radially expanding the first portion of the first tubular member includes means for applying a radial force to the first portion of the first tubular member using an inflatable bladder. In a preferred embodiment, the means for plastically deforming and radially expanding the first portion of the first tubular member includes means for applying a radial force to the first portion of the first tubular member using a roller expansion device. In a preferred embodiment, the apparatus further includes means for injecting an annular body of a hardenable fluidic sealing material into an annulus between the first tubular member and the wellbore. In a preferred embodiment, the apparatus further includes means for curing the annular body of hardenable fluidic sealing material. In a preferred embodiment, the apparatus further includes means for injecting an annular body of a hardenable fluidic sealing material into an annulus between the second tubular member and the wellbore. In a preferred embodiment, the apparatus further includes means for curing the annular body of hardenable fluidic sealing material.

An apparatus for plastically deforming and radially expanding a tubular member has also been described that includes means for providing a lipped portion in a portion of the tubular member, and means for plastically deforming and radially expanding another portion of the tubular member.

An apparatus for plastically deforming and radially expanding a tubular member has also been described that includes a tubular support member including a first fluid passage, an expansion cone coupled to the tubular support member having a second fluid passage fluidicly coupled to the first fluid passage and an outer conical surface, an annular expansion cone launcher including: a first annular portion coupled to a lower portion of the tubular member, a second annular portion coupled to the first annular portion that mates with the outer conical surface of the expansion cone, a third annular portion coupled to the second annular portion having a first outside diameter, and a fourth annular portion coupled to the third annular portion having a second outside diameter, wherein the second outside diameter is less than the first outside diameter, and a shoe having a valveable passage coupled to fourth annular portion of the expansion cone launcher.

A method of plastically deforming and radially expanding a tubular member has also been described that includes providing a lipped portion in a portion of the tubular member, and plastically deforming and radially expanding another portion of the tubular member.

A method of coupling a first tubular member to a second tubular member has also been described that includes providing a lipped portion in a portion of the first tubular member, plastically deforming and radially expanding another portion of the first tubular member, positioning the second tubular member inside the first tubular member in overlapping relation to the lipped portion of the first tubular member, and plastically deforming and radially expanding the second tubular member. The inside diameters of the first and second tubular members after the plastic deformations and radial expansions are substantially equal.

An apparatus for coupling a first tubular member to a second tubular member has also been described that includes means for providing a lipped in the first tubular member, means for plastically deforming and radially expanding another portion of the first tubular member, means for positioning the second tubular member inside the first tubular member in overlapping relation to the lipped portion of the first tubular member, and means for plastically deforming and radially expanding the second tubular member. The inside diameters of the first and second tubular members after the plastic deformations and radial expansions are substantially equal.

An apparatus for forming a wellbore casing within a wellbore has also been described that includes means for supporting a tubular member within the wellbore, means for providing a lipped portion in the tubular member, and means for plastically deforming and radially expanding another portion of the tubular member to a second outside diameter.

An apparatus for forming a wellbore casing within a wellbore has also been described that includes a tubular support member including a first fluid passage, an expansion cone coupled to the tubular support member having a second fluid passage fluidicly coupled to the first fluid passage and an outer conical surface, an annular expansion cone launcher including: a first annular portion coupled to a lower portion of the tubular member, a second annular portion coupled to the first annular portion that mates with the outer conical surface of the expansion cone, a third annular portion coupled to the second annular portion having a first outside diameter, and a fourth annular portion coupled to the third annular portion having a second outside diameter, wherein the second outside diameter is less than the first outside diameter, and a shoe having a valveable passage coupled to fourth annular portion of the expansion cone launcher.

A method of forming a wellbore casing in a wellbore has also been described that includes supporting a tubular member within the wellbore, providing a lipped portion in a portion of the tubular member, and plastically deforming and radially expanding another portion of the tubular member. In a preferred embodiment, the method further includes injecting a hardenable fluidic sealing material in an annulus between the tubular member and the wellbore. In a preferred embodiment, the method further includes curing the fluidic sealing material.

A method of forming a mono-diameter wellbore casing within a wellbore has also been described that includes supporting a first tubular member within the wellbore, providing a lipped portion in a portion of the first tubular member, plastically deforming and radially expanding another portion of the first tubular member, positioning the second tubular member inside the first tubular member in overlapping relation to the lipped portion of the first tubular member, and plastically deforming and radially expanding the second tubular member. The inside diameters of the first and second tubular members after the plastic deformations and radial expansions are substantially equal. In a preferred embodiment, the method further includes injecting a hardenable fluidic sealing material in an annulus between the first tubular member and the wellbore. In a preferred embodiment, the method further includes curing the fluidic sealing material. In a preferred embodiment, the method further includes injecting a hardenable fluidic sealing material in an annulus between the second tubular member and the wellbore. In a preferred embodiment, the method further includes curing the fluidic sealing material.

An apparatus for forming a mono-diameter wellbore casing within a wellbore has also been described that includes means for providing a lipped in the first tubular member, means for plastically deforming and radially expanding another portion of the first tubular member, means for positioning the second tubular member inside the first tubular member in overlapping relation to the lipped portion of the first tubular member, and means for plastically deforming and radially expanding the second tubular member. The inside diameters of the first and second tubular members after the plastic deformations and radial expansions are substantially equal. In a preferred embodiment, the apparatus further includes means for injecting a hardenable fluidic sealing material in an annulus between the first tubular member and the wellbore. In a preferred embodiment, the apparatus further includes means for curing the fluidic sealing material. In a preferred embodiment, the apparatus further includes means for injecting a hardenable fluidic sealing material in an annulus between the second tubular member and the wellbore. In a preferred embodiment, the apparatus further includes means for curing the fluidic sealing material.

An apparatus for plastically deforming and radially expanding a tubular member has also been described that includes means for plastically deforming and radially expanding a first end of the tubular member, and means for plastically deforming and radially expanding a second end of the tubular member. In a preferred embodiment, the apparatus further includes means for anchoring the tubular member during the radial expansion.

An apparatus for plastically deforming and radially expanding a tubular member has also been described that includes a tubular support member including a first passage, an expansion cone coupled to the tubular support having a second passage fluidicly coupled to the first passage and an outer conical surface, an annular expansion cone launcher movably coupled to outer conical surface of the expansion cone, an expandable tubular member coupled to an end of the annular expansion cone launcher, a shoe coupled to another end of the annular expansion cone launcher having a valveable fluid passage, and another annular expansion cone movably coupled to the tubular support member. The annular expansion cones are positioned in opposite orientations. In a preferred embodiment, the annular expansion cone is adapted to plastically deform and radially expand a first end of the expandable tubular member and the other annular expansion cone is adapted to plastically deform and radially expand a second end of the expandable tubular member. In a preferred embodiment, the apparatus further includes an anchoring member coupled to the tubular support member adapted to hold the expandable tubular.

A method of plastically deforming and radially expanding a tubular member has also been described that includes plastically deforming and radially expanding a first end of the tubular member, and plastically deforming and radially expanding a second end of the tubular member. In a preferred embodiment, the method further includes anchoring the tubular member during the radial expansion. In a preferred embodiment, the first end of the tubular member is plastically deformed and radially expanded before the second end. In a preferred embodiment, plastically deforming and radially expanding the second end of the tubular member includes injecting a fluidic material into the tubular member.

A method of coupling a first tubular member to a second tubular member has also been described that includes positioning the second tubular member inside the first tubular member in an overlapping relationship, plastically deforming and radially expanding the end of the second tubular member that overlaps with the first tubular member, and plastically deforming and radially expanding the remaining portion of the second tubular member. In a preferred embodiment, the method further includes plastically deforming and radially expanding at least a portion of the second tubular member. In a preferred embodiment, the inside diameters of the first and second tubular members are substantially equal after the radial expansions.

An apparatus for coupling a first tubular member to a second tubular member has also been described that includes means for positioning the second tubular member inside the first tubular member in an overlapping relationship, means for plastically deforming and radially expanding the end of the second tubular member that overlaps with the first tubular member, and means for plastically deforming and radially expanding the remaining portion of the second tubular member. In a preferred embodiment, the apparatus further includes means for plastically deforming and radially expanding at least a portion of the second tubular member. In a preferred embodiment, the inside diameters of the first and second tubular members are substantially equal after the radial expansions.

An apparatus for forming a wellbore casing within a wellbore has also been described that includes means for supporting a tubular member within the wellbore, means for plastically deforming and radially expanding a first end of the tubular member, and means for plastically deforming and radially expanding a second end of the tubular member. In a preferred embodiment, the apparatus further includes means for anchoring the tubular member during the radial expansion. In a preferred embodiment, the apparatus further includes means for injecting a hardenable fluidic sealing material into an annulus between the tubular member and the wellbore.

An apparatus for forming a wellbore casing within a wellbore has also been described that includes a tubular support member including a first passage, an expansion cone coupled to the tubular support having a second passage fluidicly coupled to the first passage and an outer conical surface, an annular expansion cone launcher movably coupled to outer conical surface of the expansion cone, an expandable tubular member coupled to an end of the annular expansion cone launcher, a shoe coupled to another end of the annular expansion cone launcher having a valveable fluid passage, and another annular expansion cone movably coupled to the tubular support member. The annular expansion cones are positioned in opposite orientations. In a preferred embodiment, the annular expansion cone is adapted to plastically deform and radially expand a first end of the expandable tubular member and the other annular expansion cone is adapted to plastically deform and radially expand a second end of the expandable tubular member. In a preferred embodiment, the apparatus further includes an anchoring member coupled to the tubular support member adapted to hold the expandable tubular.

A method of forming a wellbore casing within a wellbore has also been described that includes plastically deforming and radially expanding a first end of the tubular member, and plastically deforming and radially expanding a second end of the tubular member. In a preferred embodiment, the method further includes anchoring the tubular member during the radial expansion. In a preferred embodiment, the first end of the tubular member is plastically deformed and radially expanded before the second end. In a preferred embodiment, plastically deforming and radially expanding the second end of the tubular member includes injecting a fluidic material into the tubular member. In a preferred embodiment, the method further includes injecting a hardenable fluidic sealing material into an annulus between the tubular member and the wellbore.

A method of forming a wellbore casing within a wellbore has also been described that includes plastically deforming and radially expanding a first tubular member within the wellbore, positioning a second tubular member inside the first tubular member in an overlapping relationship, plastically deforming and radially expanding the end of the second tubular member that overlaps with the first tubular member, plastically deforming and radially expanding the remaining portion of the second tubular member. In a preferred embodiment, the method further includes plastically deforming and radially expanding at least a portion of the second tubular member. In a preferred embodiment, the inside diameters of the first and second tubular members are substantially equal after the radial expansions. In a preferred embodiment, the method further includes injecting a hardenable fluidic sealing material into an annulus between the first tubular member and the wellbore. In a preferred embodiment, the method further includes injecting a hardenable fluidic sealing material into an annulus between the second tubular member and the wellbore.

An apparatus for forming a wellbore casing within a wellbore has also been described that includes means for plastically deforming and radially expanding a first tubular member within the wellbore, means for positioning the second tubular member inside the first tubular member in an overlapping relationship, means for plastically deforming and radially expanding the end of the second tubular member that overlaps with the first tubular member, means for plastically deforming and radially expanding the remaining portion of the second tubular member. In a preferred embodiment, the apparatus further includes means for plastically deforming and radially expanding at least a portion of the second tubular member. In a preferred embodiment, the inside diameters of the first and second tubular members are substantially equal after the radial expansions. In a preferred embodiment, the apparatus further includes means for injecting a hardenable fluidic sealing material into an annulus between the first tubular member and the wellbore. In a preferred embodiment, the apparatus further includes means for injecting a hardenable fluidic sealing material into an annulus between the second tubular member and the wellbore.

An apparatus for bridging an axial gap between opposing pairs of wellbore casing within a wellbore has also been described that includes means for supporting a tubular member in overlapping relation to the opposing ends of the wellbore casings, means for plastically deforming and radially expanding the tubular member, and means for plastically deforming and radially expanding the tubular member and the opposing ends of the wellbore casings.

A method of bridging an axial gap between opposing pairs of wellbore casing within a wellbore has also been described that includes supporting a tubular member in overlapping relation to the opposing ends of the wellbore casings, plastically deforming and radially expanding the tubular member, and plastically deforming and radially expanding the tubular member and the opposing ends of the wellbore casings.

A method of forming a structure having desired strength characteristics has also been described that includes providing a first tubular member, and plastically deforming and radially expanding additional tubular members onto the interior surface of the first tubular member until the desired strength characteristics are achieved.

A method of forming a wellbore casing within a wellbore having desired strength characteristics has also been described that includes plastically deforming and radially expanding a first tubular member within the wellbore, and plastically deforming and radially expanding additional tubular members onto the interior surface of the first tubular member until the desired strength characteristics are achieved.

A method of coupling a first tubular member to a second tubular member, the first tubular member having an original outside diameter $OD_0$ and an original wall thickness $t_0$, has also been described that includes plastically deforming and radially expanding a first portion of the first tubular member to a first outside diameter, plastically deforming and radially expanding another portion of the first tubular member to a second outside diameter, positioning the second tubular member inside the first tubular member in overlapping relation to the first portion of the first tubular member, plastically deforming and radially expanding the second tubular member to a third outside diameter, and plastically deforming and radially expanding the second tubular member to a fourth outside diameter, wherein the inside diameters of the first and second tubular members after the plastic deformations and radial expansions are substantially equal, and wherein the ratio of the original outside diameter $OD_0$ of the first tubular member to the original wall thickness $t_0$ of the first tubular member is greater than or equal to 16.

A method of forming a mono-diameter wellbore casing has also been described that includes positioning a first tubular member within a wellbore, the first tubular member having an original outside diameter $OD_0$ and an original wall thickness $t_0$, plastically deforming and radially expanding a first portion of the first tubular member to a first outside diameter, plastically deforming and radially expanding another portion of the first tubular member to a second outside diameter, positioning the second tubular member inside the first tubular member in overlapping relation to the first portion of the first tubular member, plastically deforming and radially expanding the second tubular member to a third outside diameter, and plastically deforming and radially expanding the second tubular member to a fourth outside diameter. The inside diameters of the first and second tubular members after the plastic deformations and radial expansions are substantially equal, and wherein the ratio of the original outside diameter $OD_0$ of the first tubular member to the original wall thickness $t_0$ of the first tubular member is greater than or equal to 16.

An apparatus has also been described that includes a plastically deformed and radially expanded tubular member having a first portion having a first outside diameter and a remaining portion having a second outside diameter, wherein the ratio of the original outside diameter $OD_0$ of the first tubular member to the original wall thickness $t_0$ of the first tubular member is greater than or equal to 16.

An apparatus has also been described that includes a plastically deformed and radially expanded first tubular member having a first portion having a first outside diameter and a remaining portion having a second outside diameter, and a plastically deformed and radially expanded second tubular member coupled to the first portion of the first tubular member. The ratio of the original outside diameter $OD_0$ of the first tubular member to the original wall thickness $t_0$ of the first tubular member is greater than or equal to 16. In a preferred embodiment, the inside diameters of the first and second tubular members are substantially equal.

A wellbore casing formed in a wellbore has also been described that includes a plastically deformed and radially expanded first tubular member having a first portion having a first outside diameter and a remaining portion having a second outside diameter, and a plastically deformed and radially expanded second tubular member coupled to the first portion of the first tubular member. The ratio of the original outside diameter $OD_0$ of the first tubular member to the original wall thickness $t_0$ of the first tubular member is greater than or equal to 16. In a preferred embodiment, the inside diameters of the first and second tubular members are substantially equal.

An apparatus has also been described that includes a plastically deformed and radially expanded tubular member. In a preferred embodiment, the ratio of the original outside diameter $OD_0$ of the tubular member to the original wall thickness $t_0$ of the tubular member is greater than or equal to 16.

In several alternative embodiments, the methods and apparatus described and referenced above may be used to form or repair wellbore casings, pipelines, and structural supports.

Although this detailed description has shown and described illustrative embodiments of the invention, this description contemplates a wide range of modifications, changes, and substitutions. In some instances, one may employ some features of the present invention without a corresponding use of the other features. Accordingly, it is appropriate that readers should construe the appended claims broadly, and in a manner consistent with the scope of the invention.

What is claimed is:

1. A method of coupling a first tubular member to a second tubular member, comprising:

radially expanding and plastically deforming an end portion of a first tubular member;

positioning the first tubular member within a preexisting structure;

positioning a second tubular member within the preexisting structure with an end portion of the second tubular member in overlapping relation to, and within, the radially expanded and plastically deformed end portion of the first tubular member; and radially expanding and plastically deforming the end portion of the second tubular member into engagement with the radially expanded and plastically deformed end portion of the first tubular member within the preexisting structure;

wherein, after the completion of the radial expansion and plastic deformation of the second tubular member, the first and second tubular members together define a passage having a substantially constant cross sectional area.

2. A method of forming a wellbore casing structure within a wellbore having a constant inside diameter, comprising:

radially expanding and plastically deforming an end portion of a first tubular member;

positioning the first tubular member within the wellbore;

positioning a second tubular member within the wellbore with an end portion of the second tubular member in overlapping relation to, and within, the radially expanded and plastically deformed end portion of the first tubular member; and radially expanding and plastically deforming the end portion of the second tubular member into engagement with the radially expanded and plastically deformed end portion of the first tubular member within the wellbore;

wherein, after the completion of the radial expansion and plastic deformation of the second tubular member, the first and second tubular members together define a passage having a substantially constant inside diameter.

3. A method of coupling a first pipeline to a second pipeline, comprising:

radially expanding and plastically deforming an end portion of a first pipeline member;

positioning the first pipeline within a preexisting structure;

positioning a second pipeline within the preexisting structure with an end portion of the second pipeline in overlapping relation to, and within, the radially expanded and plastically deformed end portion of the first pipeline; and radially expanding and plastically deforming the end portion of the second pipeline into engagement with the radially expanded and plastically deformed end portion of the first pipeline within the preexisting structure;

wherein, after the completion of the radial expansion and plastic deformation of the second pipeline, the first and second pipelines together define a passage having a substantially constant cross sectional area.

4. The method of claim 3, wherein, after the completion of the radial expansion and plastic deformation of the second pipeline, the first and second pipelines together define a passage having a constant inside diameter.

5. A method of forming a wellbore casing structure within a wellbore having a constant inside diameter, comprising:

positioning the first tubular member within the wellbore;

injecting a hardenable fluidic material into an annulus between the first tubular member and the wellbore;

radially expanding and plastically deforming an end portion of a first tubular member;

positioning a second tubular member within the wellbore with an end portion of the second tubular member in overlapping relation to, and within, the radially expanded and plastically deformed end portion of the first tubular member; and radially expanding and plastically deforming the end portion of the second tubular member into engagement with the radially expanded and plastically deformed end portion of the first tubular member within the wellbore;

wherein, after the completion of the radial expansion and plastic deformation of the second tubular member, the first and second tubular members together define a passage having a substantially constant cross sectional area.

* * * * *